US005624610A

United States Patent [19]

Yokoya et al.

[11] Patent Number: 5,624,610

[45] Date of Patent: Apr. 29, 1997

[54] HUMIDIFIER

[75] Inventors: Hisao Yokoya; Kenzo Takahashi, both of Gifu, Japan

[73] Assignee: Mitsubishi Denki Kabushiki Kaisha, Tokyo, Japan

[21] Appl. No.: 680,554

[22] Filed: Jul. 9, 1996

Related U.S. Application Data

[63] Continuation of Ser. No. 472,048, Jun. 6, 1995, abandoned.

[30] Foreign Application Priority Data

Feb. 17, 1995 [JP] Japan ..... 7-029594
Mar. 1, 1995 [JP] Japan ..... 7-041998

[51] Int. Cl.[6] ..... B01F 3/04
[52] U.S. Cl. ..... 261/104
[58] Field of Search ..... 261/104

[56] References Cited

U.S. PATENT DOCUMENTS

| | | | |
|---|---|---|---|
| 2,990,696 | 2/1961 | Fisher | 261/104 |
| 3,045,450 | 7/1962 | Chandler | 261/104 |
| 3,369,343 | 2/1968 | Robb | 261/104 |
| 3,735,559 | 5/1973 | Salemme | 261/104 |
| 4,758,385 | 7/1988 | Acker et al. | 261/104 |
| 4,921,642 | 5/1990 | LaTorraca | 261/104 |
| 5,318,731 | 6/1994 | Yokoya et al. | 261/104 |

FOREIGN PATENT DOCUMENTS

| | | | |
|---|---|---|---|
| 54100 | 1/1938 | Denmark | 261/104 |
| 60-171337 | 9/1985 | Japan . | |
| 61-72948 | 4/1986 | Japan | 261/104 |
| 61-175421 | 8/1986 | Japan . | |
| 61-237942 | 10/1986 | Japan . | |
| 4-366335 | 12/1992 | Japan | 261/104 |
| 650581 | 2/1994 | Japan . | |

*Primary Examiner*—Tim R. Miles

[57] ABSTRACT

A humidifier includes water guide members (107) made of sheet-like porous material and the water guide member (107) is enclosed in an envelope-shaped film member formed of moisture permeable films (108) which allow no water but water vapor to permeate therethrough. The water guide member (107) and the film member are both combined to form a flat water guide component (104) of composite structure. Rows of ribs (105) for forming a plurality of parallel air channels (115) and water supply members (106) each having water supply holes (111) communicating with the water guide components (104) to supply water thereto are provided, and the ribs (105) and the water supply member (106) are joined to one side of the water guide component (104) to constitute a moistening function member (101) permeable to water. A plurality of moistening function members (101) are laminated so that the water supply holes tightly stick each other and that air supply layers (102) with the ribs (105) and water retention layers (103) with the water guide components (Q04) are alternately arranged one over another.

18 Claims, 29 Drawing Sheets

| | EM. 2 | EM. 3 | COM. 1 | COM. 2 |
|---|---|---|---|---|
| DIMENSION (mm) | 300 × 230 | 300 × 230 | 300 × 230 | 300 × 230 |
| M. Q. (Kg/h) | 0. 65 | 0. 60 | 0. 45 | 0. 50 |
| S. P. L. (mmAq) | 1. 8 | 1. 8 | 5. 4 | 6. 4 |

| | A | B | C | D | E |
|---|---|---|---|---|---|
| N | 5 | 10 | 20 | 30 | 40 |
| H | 50mm | 25mm | 12.5mm | 8.33mm | 6.25mm |
| M.Q. (Kg/h) | 0.49 | 0.46 | 0.45 | 0.43 | 0.41 |
| S.P.L. (mmAq) | 1.76 | 2.12 | 2.77 | 3.75 | 5.01 |

| | A | B | C | D | E |
|---|---|---|---|---|---|
| N | 5 | 10 | 20 | 30 | 40 |
| H | 50mm | 25mm | 12.5mm | 8.3mm | 6.2mm |

| | COM. 3 | COM. 4 | EM. 7 | EM. 8 | EM. 9 | EM. 10 | EM. 11 |
|---|---|---|---|---|---|---|---|
| DIMENSION (mm) | 300 × 230 | 300 × 230 | 300 × 230 | 300 × 230 | 300 × 230 | 300 × 230 | 300 × 200 |
| M. Q. (Kg/h) | 0. 45 | 0. 50 | 0. 46 | 0. 46 | 0. 51 | 0. 63 | 0. 58 |
| S. P. L. (mmAq) | 6. 4 | 6. 4 | 2. 1 | 2. 1 | 2. 1 | 3. 4 | 3. 9 |

HUMIDIFIER

This application is a continuation of application Ser. No. 08/472,048 filed on Jun. 6, 1995, now abandoned.

BACKGROUND OF THE INVENTION a) Field of the Invention

The present invention relates to a humidifier for producing moist or humid atmospheric air by supplying moisture to air in dry atmosphere.

b) Description of the Related Art

As a humidifier for producing a moist atmosphere, there are available a natural evaporation type humidifier, an electrically heating type humidifier, a water spray type humidifier, an ultrasonic type humidifier; however, they have peculiar problems. More specifically, the natural evaporation type humidifier is small in humidifying or moistening capacity, whereas the electrically heating type humidifier is high in running cost. Further, the water spray type humidifier tends to become large in size and is low in moistening efficiency, whereas the ultrasonic type humidifier suffers from problems in that it is short in service life and high in initial cost, and further it is liable to scatter bacteria and fine particles of calcium carbonate contained in the water.

Among these humidifiers described above, the natural evaporation type humidifier is still advantageous in that it is lower in running and initial costs and higher in safety as being less scattering bacteria and fine particles of calcium carbonate, except its moistening capacity is small. In view of the above-noted advantage, various attempt has been made to improve moistening capacity of the natural evaporation type humidifier, as disclosed, for instance, in Japanese Patents Laid-Open Nos. 171337/1985, 175421/1986, 237942/1986 and 50581/1994.

The humidifiers proposed in the Japanese Patent Publications are basically designed to increase the evaporation area while preventing air to be moistened from directly coming in contact with water. For example, the humidifier disclosed in Japanese Patent Publication No. 50581/1994 (corresponding to U.S. Pat. No. 5,318,731) employs the following arrangement: That is, as shown in FIG. 60, a tubular film member 248 is formed of a moisture permeable film which prohibits liquid water from permeate therethrough but permits water vapor to permeate or penetrate therethrough. Within the tubular film member 248, there is provided a spacer by which a water-containing space of several millimeters thick is secured. The tubular film member 248 with a corrugated spacer plate 249 placed thereon is wound up into a vortex configuration to define spaces into which air to be humidified is introduced. With this arrangement, it is possible to obtain a greater moistening capacity through the enlarged evaporation area in comparison to the conventional natural evaporation type humidifier wherein water is supplied to an open container, or a plate or cloth made of hydrophilic material, as well as to prevent scattering of bacteria and fine particles of calcium carbonate.

Even in the case of the humidifier of the natural evaporation type employing the tubular film member 248, there still exist some problems.

Problem 1: The spacer plate 249 is an important component for defining the spaces into which air to be humidified is introduced. However, the corrugated space plate 249 is structurally restricted in the crest-to-crest dimension with respect to the amplitude of the wave, and the ratio of the crest-to-crest length to the amplitude of the wave is not so high. Consequently, the space into which the air is introduced becomes unavoidably small, and resistance to the flow of the air becomes considerably high.

Problem 2: The space plate 249 is large in length, and the number of crests per projection plane is relatively large as the crest-to-crest length is not so great. Consequently, the total contact area between the tubular film member 248 and the crests is considerably large. Since the permeable-to-moisture function is impaired by the crest at portions where the tubular film member 248 and the crest contact each other, the moistening capability is lowered as much as the contact area is set larger.

Problem 3: Although winding the tubular film member 248 in the form of a vortex is effective to enlarge the evaporation area, that structure lengthens the time required to supply water therein. Further, since a very long tubular film member 248 ranging from 10 m to 40 m has to be dealt with, manufacturing is not so easy and thus the humidifier is low in productivity. In other words, the process of folding the long tubular film member 48 while putting the space plate 49 in between the folded sections renders the contents of work considerably complicated and thus makes automated production hardly possible.

SUMMARY OF THE INVENTION

The present invention was made in order to solve the foregoing problems, and an object of the invention is to provide a humidifier of a natural evaporation type easy to manufacture with high productivity which is designed to increase moistening capability, decrease resistance to air flow, improve water supply properties, and ensure longer service life.

A first aspect of the present invention for accomplishing the object above employs a humidifier comprising: water guide members each made of three-dimensional rigid porous plates permeable to water, the water guide member being enclosed in an enveloped-shaped film member formed of porous moisture permeable films which allow no water but water vapor to permeate therethrough, the water guide member and the film member both being combined to form a flat water guide component of composite structure; first plate-like spacers and second plate-like spacers coupled together in such a manner that the first and second spacers are sufficiently separated from each other, the first spacer being joined onto one plane of the water guide component closer to one side thereof, the second spacer being joined onto the other side thereof, the first spacer having a water supply hole communicating with the water guide component to supply water thereto so as to constitute a moistening function member, wherein a plurality of moistening function members are laminated so that the water supply holes communicate with each other and that air supply layers with the first and second spacers and water retention layers with the water guide components are alternately arranged one over another.

A second aspect of the present invention for accomplishing the object above employs a humidifier comprising: water guide members each made of three-dimensional rigid porous plates permeable to water, the water guide member being enclosed in an enveloped-shaped film member formed of porous moisture permeable films which allow no water but water vapor to permeate therethrough, the water guide member and the film member both being combined to form a flat water guide component of composite structure; first plate-like spacers and second plate-like spacers coupled together in such a manner that the first and second spacers are sufficiently separated from each other, the first spacer being joined onto one plane of the water guide component closer to one side thereof, the second spacer being joined onto the other side thereof, the first and second spacers each having a water supply hole and an air vent hole each communicating with the water guide component to supply water thereto and allow air to escape from the air vent hole so as to constitute a moistening function member, wherein a plurality of moistening function members are laminated so that the water supply hole and the air vent hole communicate with each other and that air supply layers with the first and second spacers and water retention layers with the water guide components are alternately arranged one over another.

A third aspect of the present invention for accomplishing the object above employs a humidifier of the first aspect, wherein the water supply hole is placed on the lower side; and the outer-surface-side water supply section of one of the two moistening function members forming the outermost layers is closed so as to supply water from the water supply hole of the other moistening function member to the water supply pipe.

A fourth aspect of the present invention for accomplishing the object above employs a humidifier of the second aspect, wherein the water supply hole is placed on the lower side; the outer-surface-side water supply section of one of the two moistening function members forming the outermost layers is closed; a section communicating with the outer-surface-side air vent hole is closed with a porous moisture permeable film which allows no water but air to permeate therethrough; water is supplied through the water supply hole to the other moistening function member from the water supply pipe; and the air vent hole of the other moistening function member is closed with a porous moisture permeable film which allows no water but air to permeate therethrough.

A fifth aspect of the present invention for accomplishing the object above employs a humidifier comprising: water guide members made of sheet-like porous material, the water guide member being enclosed in an envelope-shaped film member formed of moisture permeable films which allow water vapor to permeate therethrough, the water guide member and the film member both being combined to form a flat water guide component of composite structure; rows of ribs for forming a plurality of parallel air channels; and water supply members each having water supply holes communicating with the water guide components so as to supply water thereto, the ribs and the water supply member being joined to one side of the water guide component to constitute a moistening function member permeable to water, wherein a plurality of moistening function members are laminated so that the water supply holes communicate with each other.

A sixth aspect of the present invention for accomplishing the object above employs a humidifier comprising: water guide members made of sheet-like porous material, the water guide member being enclosed in an envelope-shaped film member formed of moisture permeable films which allow water vapor to permeate therethrough, the water guide member and the film member both being combined to form a flat water guide component of composite structure; rows of ribs for forming a plurality of parallel air channels; water supply members each having water supply holes each communicating with the water guide components so as to supply water thereto; and air vent members each having air vent holes each communicating with the water guide components so as to let the air escape from the inside, the ribs and the water supply member and the air vent member being joined to one side of the water guide component to constitute a moistening function member permeable to water, wherein a plurality of moistening function members are laminated so that the water supply holes and the air vent holes communicate with each other.

A seventh aspect of the present invention for accomplishing the object above employs a humidifier comprising: water guide members made of sheet-like porous material, the water guide member being enclosed in an envelope-shaped film member formed of moisture permeable films which allow water vapor to permeate therethrough, the water guide member and the film member both being combined to form a flat water guide component of composite structure; rows of ribs for forming a plurality of parallel air channels; water supply sections each having water supply holes each communicating with the water guide components so as to supply water thereto, the ribs and the water supply section being combined together by monolithic molding into a plastic frame, which is joined to one side of the water guide component to constitute a moistening function member permeable to water, wherein a plurality of moistening function members are laminated so that the water supply holes communicate with each other.

An eighth aspect of the present invention for accomplishing the object above employs a humidifier comprising: water guide members made of sheet-like porous material, the water guide member being enclosed in an envelope-shaped film member formed of moisture permeable films which allow water vapor to permeate therethrough, the water guide member and the film member both being combined to form a flat water guide component of composite structure; rows of ribs for forming a plurality of parallel air channels; water supply sections each having water supply holes each communicating with the water guide components so as to supply water thereto; and air vent sections each having air vent holes each communicating with the water guide components so as to let the air escape from the inside, the ribs and the water supply member and the air vent member being combined together by monolithic molding into a plastic frame, which is joined to one side of the water guide component to constitute a moistening function member permeable to water, wherein a plurality of moistening function members are laminated so that the water supply holes and the air vent holes communicate with each other.

A ninth aspect of the present invention for accomplishing the object above employs a humidifier of either the fifth or seventh aspect, wherein one of the water retention layers constitutes a functional member for special use in supplying water which has a connection port connected to a water supply source and is equipped with a water conduit for supplying water flowing in from the connection port to an adjoining moistening function member, and provided with rows of ribs each for forming air channels on its surface.

A tenth aspect of the present invention for accomplishing the object above employs a humidifier of either the fifth or seventh aspect, wherein one of the water retention layers constitutes a functional member for special use in supplying water which has a water conduit communicating with a water supply pipe connected to the water supply source and is used for supplying water from one end of the water conduit to an adjoining moistening function member; and the functional member for special use in supplying water is also provided with rows of ribs each for forming air channels.

An eleventh aspect of the present invention for accomplishing the object above employs a humidifier of either the sixth or eighth aspect, wherein one of the water retention layers constitutes a functional member for special use in supplying water and air venting which has a connection port connected to a water supply source and is equipped with a water conduit for supplying water flowing in from the connection port to an adjoining moistening function member, a discharge channel for collectively discharging air escaping from the moistening function member, and also provided with rows of ribs each for forming air channels.

A twelfth aspect of the present invention for accomplishing the object above employs a humidifier of either the sixth or eighth aspect, wherein one of the water retention layers constitutes a functional member for special use in supplying water and air venting which has a water conduit communicating with a water supply pipe connected to the water supply source and is used for supplying water from one end of the water conduit to an adjoining moistening function member and is provided with a discharge channel communicating with an air vent pipe for collectively discharging air escaping from the moistening function member; and the functional member for special use in supplying water and air venting is also provided with rows of ribs each for forming air channels.

A thirteenth aspect of the present invention for accomplishing the object above employs a humidifier of any one of the fifth to ninth aspects, wherein the space between the ribs of the moistening function member is set in the range of three to thirty times the height of the rib involved.

A fourteenth aspect of the present invention for accomplishing the object above employs a humidifier of any one of the fifth to eighth aspects, wherein the material of the rib of the moistening function member and the water supply member or the plastic frame is selected from the group consisting of vinyl chloride resin, polypropylene resin, polyethylene resin, polystyrene resin, ABS resin, nylon, urethane resin, ethylene-vinyl acetate copolymer, ethylene acrylate copolymer and epoxy resin.

According to the first aspect, the water guide member which is rigid and permeable to water is enclosed in the enveloped-shaped film member formed of porous moisture permeable films which allow no water but water vapor to permeate therethrough so as to form the flat water guide component. The first plate-like spacer and the second plate-like spacer are coupled together in such a manner as to provide a space wide enough to sufficiently separate both from each other, the first spacer being joined onto one plane of the water guide component closer to one side thereof, the second spacer being joined closer to the other side thereof, the first spacer has the water supply hole communicating with the water guide component to supply water thereto. The moistening function member is thus constructed. The humidifier whose air supply layers with the first and second spacers and water retention layers with the water guide components are alternately arranged one over another can be obtained only by laminating the plurality of moistening function members so as to make the water holes communicate with each other. Water is supplied from the water supply holes to make the water guide member enclosed in each water guide component of each moistening function member retain water in such a state that the water guide member is impregnated with water. When air to be moistened is sent to each air supply layer, water vapor permeating through the outer surface of each of the water guide components retaining water while facing and holding each air supply layer therebetween is contain in the air. Moistening resulting from natural evaporation is thus carried out continuously.

The air supply layer having a wide opening area without an obstacle is formed between the water guide components, the air supply layer being held by the first and second spacers and the water guide member supported by the first and second spacers within the water guide component in the form of a beam therebetween. Unlike a corrugated spacer plate, the first and second spacers constituting the air supply layer remains substantially unrestricted by the space with respect to height, and the number of them is as small as two, which results in making small the contact area of the spaces with the outer surface of the water guide component accordingly. Moreover, a percentage of loss of the moisture permeable function of the outer surface of the water guide component is lowered.

According to the second aspect, the water guide member which is rigid and permeable to water is enclosed in the enveloped,shaped film member formed of porous moisture permeable films which allow no water but water vapor to permeate therethrough so as to form the flat water guide component. The first plate-like spacer and the second plate-like spacer are coupled together in such a manner as to provide a space wide enough to sufficiently separate both from each other, the first spacer being joined onto one plane of the water guide component closer to one side thereof, the second spacer being joined closer to the other side thereof. The first spacer has the water supply hole communicating with the water guide component to supply water thereto, and the second spacer has the air vent hole communicating with the water guide component to allow air to escape therefrom. The moistening function member is thus constructed. The humidifier whose air supply layers with the first and second spacers and water retention layers with the water guide components are alternately arranged one over another can be obtained only by laminating the plurality of moistening function members so as to make the water hole and the air vent hole communicate with each other. Water is supplied from the water supply holes to make the water guide member enclosed in each water guide component of each moistening function member retain water in such a state that the water guide member is impregnated with water. When air to be moistened is sent to each air supply layer, water vapor permeating through the outer surface of each of the water guide components retaining water while facing and holding each air supply layer therebetween is contain in the air. Moistening resulting from natural evaporation is thus carried out continuously.

Simultaneously when water is supplied to the water guide component of each moistening function member, the air in the water guide component is allowed to escape therefrom, so that water is smoothly and speedily thereto. The air supply layer having a wide opening area without an obstacle is formed between the water guide components, the air supply layer being held by the first and second spacers and the water guide member supported by the first and second spacers within the water guide component in the form of a beam therebetween. Unlike a corrugated spacer plate, the first and second spacers constituting the air supply layer remains substantially unrestricted by the space with respect to height, and the number of them is as small as two, which results in making small the contact area of the spaces with the outer surface of the water guide component accordingly. Moreover, a percentage of loss of the moisture permeable function of the outer surface of the water guide component is lowered.

According to the third aspect, together with the functions of the first aspect, water can be supplied from the water supply hole of the moistening function member as the outermost layer via the water supply pipe to each moistening function member; and the water supply pipe is usable for collectively discharging water within the water guide component of each moistening function member.

According to the fourth aspect, together with the functions of the second aspect, water can be supplied from the water supply hole of the moistening function member as the outermost layer via the water supply pipe to each moistening function member while air is allowed to escape from what is opposite to the water supply side; and the water supply pipe is usable for collectively discharging water within the water guide component of each moistening function member.

According to the fifth aspect, the rows of ribs for forming the plurality of parallel air channels and the water supply member having the water supply hole communicating with the flat water guide component so as to supply water thereto are joined to one side of the water guide component to constitute the moistening function member permeable to water, and the plurality of moistening function members are laminated so that the water supply holes communicate with each other. This constitution makes obtainable the humidifier of layer structure in which the air supply layers with the rows of the ribs and the water retention layers with the water guide components are alternately arranged one over another. Water is supplied from the water supply holes so as to make the water guide member enclosed in each water guide component of each moistening function member retain water in such a state that the water guide member is impregnated with water. When air to be moistened is sent to each air supply layer, water vapor permeating through the outer surface of each of the water guide components retaining water while facing and holding each air supply layer therebetween is contained in the air. Moistening resulting from natural evaporation is thus carried out continuously.

Since water is supplied to the moistening function members in parallel, it does not take much time to supply water thereto. Unlike a corrugated spacer plate, the air supply layer between the water guide components with the ribs remains substantially unrestricted by the rib-to-rib space with respect to its height and since it is free from variation in height as in the case of a corrugated plate, excellent stability of its shape is ensured. Further, it is possible to sufficiently enlarge the area of each air channel and the number of them per unit area is also reducible. At an increase in the space between the ribs, not only the contact area of the outer surface of the water guide component with the ribs but also pressure loss concerning the air sent by the air supply layer becomes small, so that a percentage of loss of the moisture permeable function of the outer surface of the water guide component due to the contact of the ribs is lowered.

According to the sixth aspect, the rows of ribs for forming the plurality of parallel air channels, the water supply members each having the water supply holes each communicating with the flat water guide components so as to supply water thereto, and the air vent members each having the air vent holes each communicating with the water guide components so as to let the air escape from the inside are joined to one side of the water guide component to constitute the moistening function member permeable to water, and the plurality of moistening function members are laminated so that the water supply holes and the air vent holes communicate with each other. This constitution makes obtainable the humidifier of layer structure in which the air supply layers with the rows of the ribs and the water retention layers with the water guide components are alternately arranged one over another. Water is supplied from the water supply holes so as to make the water guide member enclosed in each water guide component of each moistening function member retain water in such a state that the water guide member is impregnated with water. When air to be moistened is sent to each air supply layer, water vapor permeating through the outer surface of each of the water guide components retaining water while facing and holding each air supply layer therebetween is contained in the air. Moistening resulting from natural evaporation is thus carried out continuously.

Water is supplied to the moistening function members in parallel, and the air in the water guide component is allowed to escape simultaneously with the supply of water, so that water is smoothly and speedily supplied thereto. Consequently, even though the water guide component is made of material not or hardly permeable to air, water is speedily supplied to each moistening function member. Unlike a corrugated spacer plate, the air supply layer between the water guide components with the ribs remains substantially unrestricted by the rib-to-rib space with respect to its height and since it is free from variation in height as in the case of a corrugated plate, excellent stability of its shape is ensured. Further, it is possible to sufficiently enlarge the area of each air channel and the number of them per unit area is also reducible. At an increase in the space between the ribs, not only the contact area of the outer surface of the water guide component with the rib but also pressure loss concerning the air sent by the air supply layer becomes small, so that a percentage of loss of the moisture permeable function of the outer surface of the water guide component due to the contact of the ribs is lowered.

According to the seventh aspect, the rows of ribs for forming the plurality of parallel air channels, and the water supply sections each having water supply holes each communicating with the flat water guide components so as to supply water thereto are combined together by monolithic molding into the plastic frame, which is joined to one side of the water guide component to constitute the moistening function member permeable to water, and the plurality of moistening function members are laminated so that the water supply holes communicate with each other. This constitution makes obtainable the humidifier of layer structure in which the air supply layers with the rows of the ribs and the water retention layers with the water guide components are alternately arranged one over another. Water is supplied from the water supply holes so as to make the water guide member enclosed in each water guide component of each moistening function member retain water in such a state that the water guide member is impregnated with water. When air to be moistened is sent to each air supply layer, water vapor permeating through the outer surface of each of the water guide components retaining water while facing and holding each air supply layer therebetween is contained in the air. Moistening resulting from natural evaporation is thus carried out continuously.

Since water is supplied to the moistening function members in parallel, it does not take much time to supply water thereto. Unlike a corrugated spacer plate, the air supply layer between the water guide components with the ribs of the plastic frame remains substantially unrestricted by the rib-to-rib space with respect to its height and since it is free from variation in height as in the case of a corrugated plate, excellent stability of its shape is ensured. Further, it is possible to sufficiently enlarge the area of each air channel and the number of them per unit area is also reducible. At an increase in the space between the ribs, not only the contact area of the outer surface of the water guide component with the rib but also pressure loss concerning the air sent by the air supply layer becomes small, so that a percentage of loss of the moisture permeable function of the outer surface of the water guide component due to the contact of the ribs is lowered. Particularly, the moistening function member equipped with the ribs and the water supply section can be fabricated only by connecting the plastic frame and the water guide component. Moveover, the water guide component is prevented from being damaged since the plastic frame totally bears the external force applied to the ribs.

According to the eighth aspect, the rows of ribs for forming the plurality of parallel air channels, the water supply sections each having water supply holes each communicating with the flat water guide components so as to supply water thereto, and the air vent sections each having the air vent holes each communicating with the water guide components so as to let the air escape from the inside are combined together by monolithic molding into the plastic frame, which is joined to one side of the water guide component to constitute the moistening function member permeable to water, and the plurality of moistening function members are laminated so that the water supply holes and the air vent holes communicate with each other. This constitution makes obtainable the humidifier of layer structure in which the air supply layers with the rows of the ribs and the water retention layers with the water guide components are alternately arranged one over another. Water is supplied from the water supply holes so as to make the water guide member enclosed in each water guide component of each moistening function member retain water in such a state that the water guide member is impregnated with water. When air to be moistened is sent to each air supply layer, water vapor permeating through the outer surface of each of the water guide components retaining water while facing and holding each air supply layer therebetween is contained in the air. Moistening resulting from natural evaporation is thus carried out continuously.

Water is supplied to the moistening function members in parallel, and the air in the water guide component is allowed to escape simultaneously with the supply of water, so that water is smoothly and speedily supplied thereto. Consequently, even though the water guide component is made of material not or hardly permeable to air, water is speedily supplied to each moistening function member. Unlike a corrugated spacer plate, the air supply layer between the water guide components with the ribs of the plastic frame remains substantially unrestricted by the rib-to-rib space with respect to its height and since it is free from variation in height as in the case of a corrugated plate, excellent stability of its shape is ensured. Further, it is possible to sufficiently enlarge the area of each air channel and the number of them per unit area is also reducible. At an increase in the space between the ribs, not only the contact area of the outer surface of the water guide component with the rib but also pressure loss concerning the air sent by the air supply layer becomes small, so that a percentage of loss of the moisture permeable function of the outer surface of the water guide component due to the contact of the ribs is lowered. Particularly, the moistening function member equipped with the ribs and the water supply section can be fabricated only by connecting the plastic frame and the water guide component. Moveover, the water guide component is prevented from being damaged since the plastic frame totally bears the external force applied to the ribs.

According to the ninth aspect, in addition to the functions performed in either the fifth or seventh aspect, one of the water retention layers constitutes a functional member for special use in supplying water which has the rows of the ribs. Water from the water supply source can be introduced from the connection port of the functional member for special use in supplying water via the water conduit into each water guide component. Therefore, water can be supplied to the water guide component of each moistening function member from even a position different from that of the water supply hole of the moistening function member.

According to the tenth aspect, in addition to the functions performed in either the fifth or seventh aspect, one of the water retention layers constitutes the functional member for special use in supplying water which has the rows of the ribs. Water can be supplied to the water guide component of each moistening function member from even a position different from that of the water supply hole of the moistening function member so as to introduce the water passed through the water supply pipe from the water conduit of the functional member for special use in supplying water via the water conduit into each water guide component.

According to the eleventh aspect, in addition to the functions performed in either the sixth or eighth aspect, one of the water retention layers constitutes the functional member for special use in supplying water and air venting which has the rows of the ribs. Water supplied from the water supply source can be introduced from the connection port of the functional member for special use in supplying water and air venting via the water conduit into each water guide component. Moreover, air escaping from each water guide component can also collectively be discharged from the discharge channel. Further, water can be supplied to the water guide component of each moistening function member from even a position different from that of the water supply hole of the moistening function member, and air escaping from the water guide component of each moistening function member can also be discharged from a position different from that of the air vent hole of the moistening function member.

According to the twelfth aspect, in addition to the functions performed in either the sixth or eighth aspect, one of the water retention layers constitutes the functional member for special use in supplying water and air venting which has the rows of the ribs. Water passed through the water supply pipe can be introduced from the water conduit of connection port of the functional member for special use in supplying water via the water conduit into each water guide component. Moreover, air escaping from each water guide component can also collectively be discharged into the air vent pipe. Further, water can be supplied to the water guide component of each moistening function member from even a position different from that of the water supply hole of the moistening function member, and air escaping from the water guide component of each moistening function member can also be discharged from a position different from that of the air vent hole of the moistening function member.

According to the thirteenth aspect, in addition to the functions performed in any one of the fifth to ninth aspects, air resistance in each air channel of the air supply layer renders instability of the shape less frequent.

According to the fourteenth aspect, in addition to the functions performed in any one of the fifth to eighth aspects, the formability, strength, adhesion and the like of the rib and the water supply member or the plastic frame may be made with greater convenience to the attribute of each material for use.

DETAILED DESCRIPTION OF THE PREFERRED EMBODIMENTS

Figure 2:
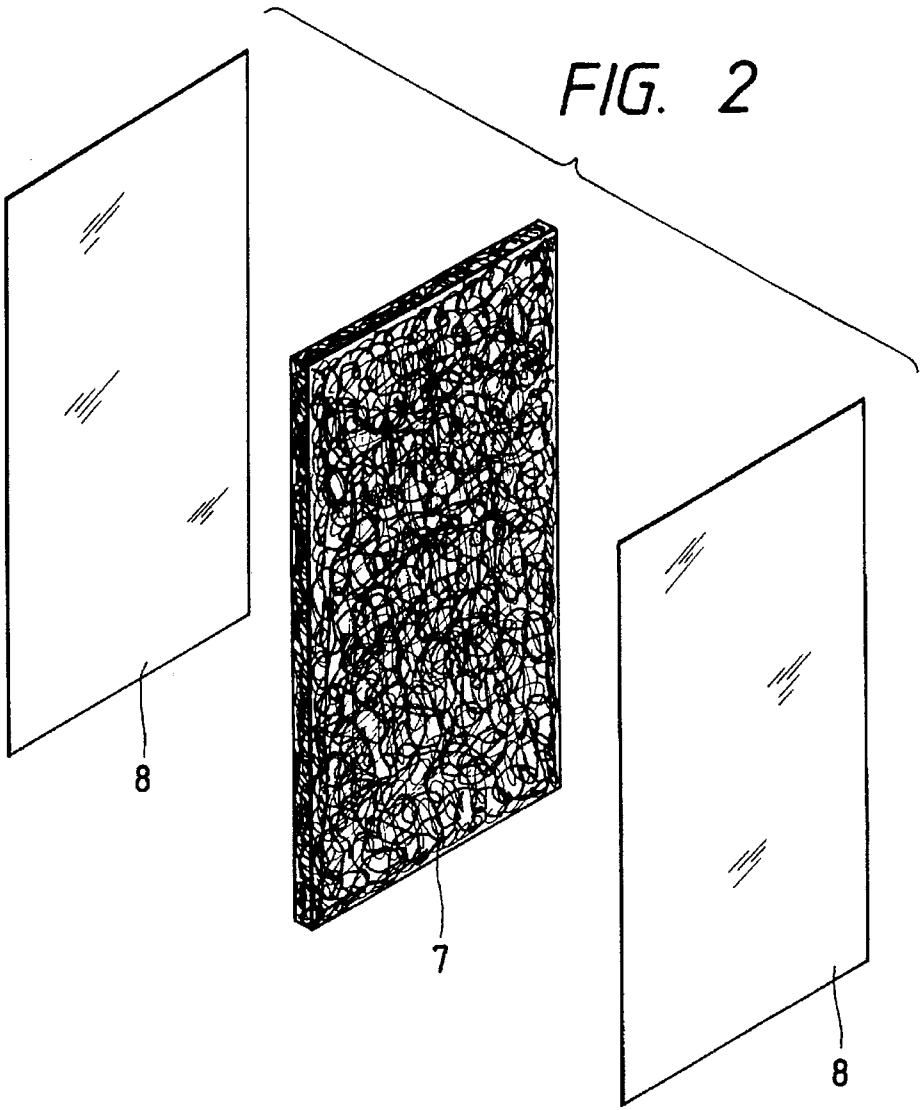
FIG. 2 is a perspective view of a water guide component used in the humidifier of the first embodiment of the present invention.

Referring to the drawings, preferred embodiments of the present invention will subsequently be described.

Embodiment 1

Figure 1:
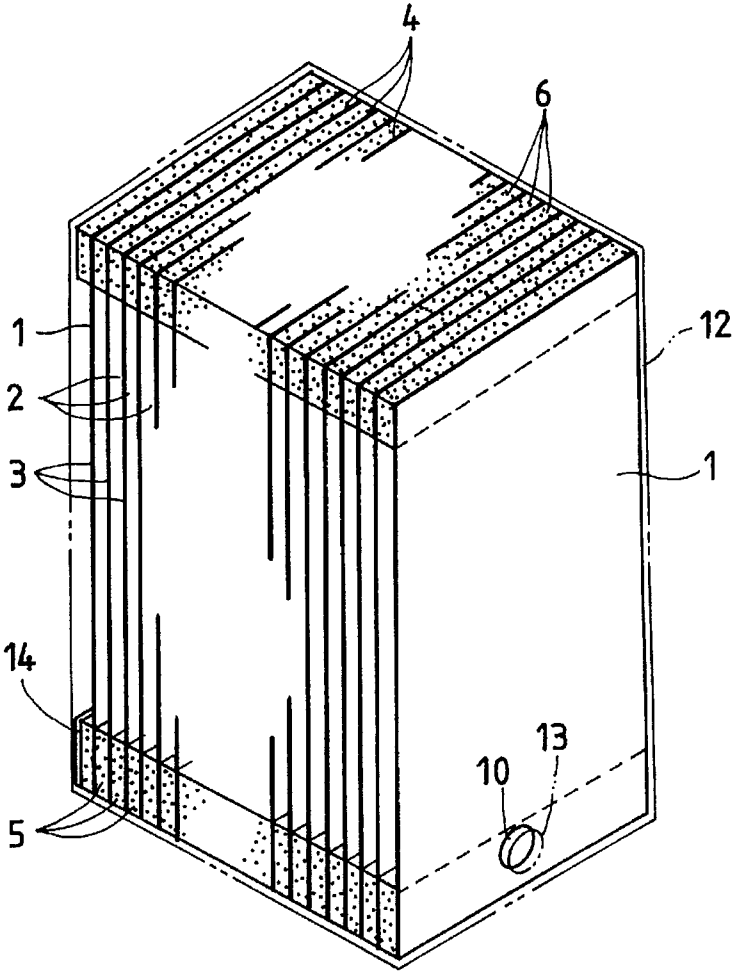
FIG. 1 is a perspective view of a humidifier according to a first embodiment of the present invention.

FIGS. 1 through 4 inclusive, illustrate a humidifier according to a first embodiment of the invention. The humidifier shown in FIG. 1 is of a natural evaporation type for moistening air by natural evaporation. A plurality of moistening function members 1 having the same shape and dimension are laid one over another to form a parallelepiped structure wherein air supply layers 2 thorough which air can flow and water retention layers 3 for storing water therein are arranged alternately. Each moistening function member 1 comprises a water guide component 4 forming the water retention layer 3, and first and second spacers 5, 6 for defining the air supply layer 2.

The water guide component 4 forming the water retention layer 3 is constructed such that a sheet-like water guide member 7 formed of a three-dimensional porous material having water-permeable, rigid characteristic is enclosed by an envelope-like film member 9 formed by moisture permeable, porous films 8 which is water-proofed but permits water vapor to permeate therethrough and they are combined together as a multi-layer composite structure into, for example, a rectangular or ribbon-shaped, relatively flat contour. In this embodiment of the invention, the water guide member 7 is formed of a sintered porous plate of hydrophilic polyethylene having a thickness of 2 mm and a porosity of 50%, and the moisture permeable, porous film 8 is of a 50μ-thick porous polytetrafluoroethylene sheet.

Figure 3:
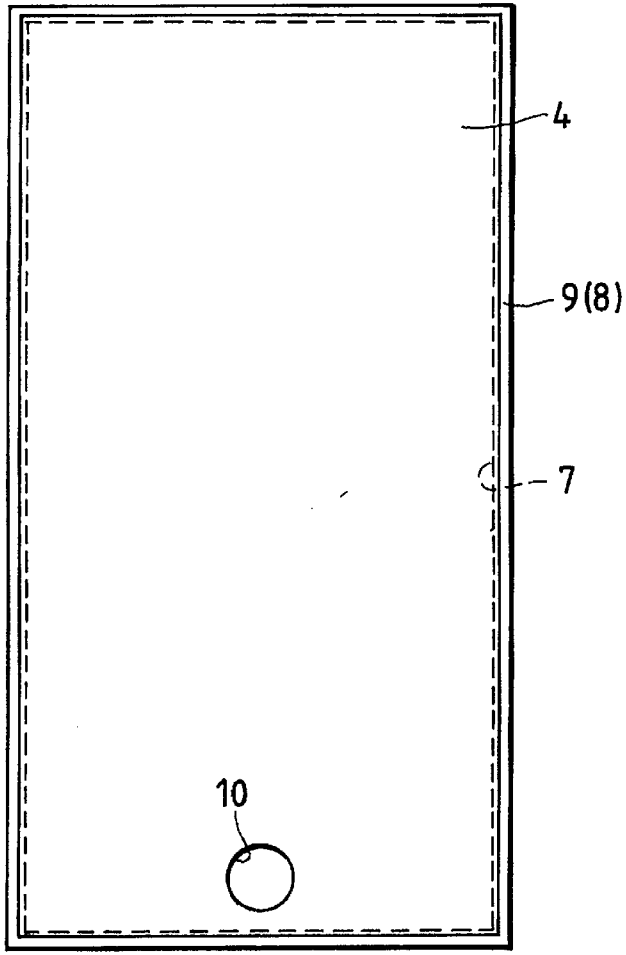
FIG. 3 is an elevational view of the water guide component according to the present invention.

The water guide component 4 of the above-noted structure can be made in a relatively simple manner. That is, two sheets of moisture permeable films 8 having a plane area greater than that of the water guide member 7 are each point-bonded to both sides of the water guide member 7 that has been formed into a rectangle as shown in FIG. 2, to form a sheet of three-layer structure wherein the water guide member 7 is held between the moisture permeable films 8. The outer peripheral sections of the moisture permeable films 8 are cut away with a bond-up margin be left, and then the outer peripheral sections of the moisture permeable films 8 in combination are bonded together by thermal fusion of adhesive to sealingly enclose the water guide member 7 as shown in FIG. 3. In this embodiment of the invention, such a rectangular water guide component 4 having 16 cm short side and 29.5 cm long side is formed by the method above. The water guide component 4 is perforated to form a water hole 10, about 20 mm in diameter for example, at the center closer to one of the short sides.

Figure 4:
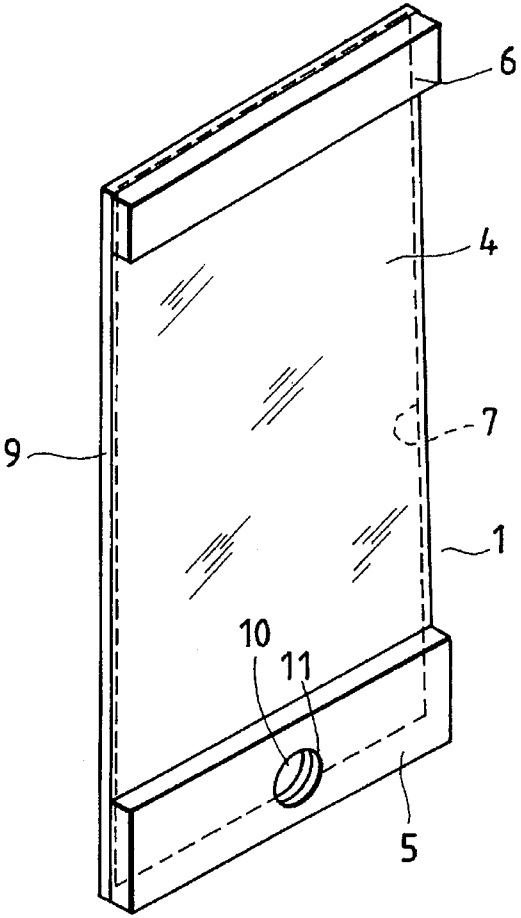
FIG. 4 is a perspective view of a moistening function member used in the humidifier of the first embodiment of the present invention.

The first spacer 5 for defining the air supply layer 2 in this embodiment is formed of a rectangular plastic plate of vinyl chloride having 3.3 mm thick, 50 mm long and 16 cm wide. As shown in FIG. 4, a water supply hole 11 to be aligned with the water hole 10 of the water guide component 4 is bored at the center. The first spacer 5 also functions as a water supply member and is bonded with a polyurethane-based adhesive along one short side of a surface of the water guide component 4 onto the surface of the water guide component 4 in a watertight manner so that the water hole 10 and the water supply hole 11 are aligned with each other.

The second spacer 6 for defining the air supply layer 2 in this embodiment is formed of a rectangular plastic plate of vinyl chloride having 3.3 mm thick, 20 mm long and 16 cm wide, and, as shown in FIG. 4, bonded with the polyurethane based adhesive along the other short side of the same surface of the water guide component 4 as the first spacer 5 is provided. The distance between the first and second spacers 5, 6 is as sufficiently wide as 225 mm.

The moistening function members 1, each so constructed as to have the first and second spacers 5, 6 joined to respective ends of the water guide component 4 as shown in FIG. 4, are laid one over another in the same orientation such that the first and second spacer sides of each moistening function member 1 are aligned respectively with the first and second spacer sides of adjacent moistening function member 1 and the first and second spacers 5, 6 contact the surface of the adjacent moistening function member 1 where the first and second spacers are not provided, and then the whole assembly is incorporated into a casing 12, whereby the humidifier shown in FIG. 1 is constructed. The moistening function members 1 thus laid one over another are integrated together such that the surface of each first spacer 5 is water-sealingly bonded onto the surface of the water guide component 4 of the adjacent moistening function member 1 where the first spacer 5 is not provided. Further, a water supply hole 11 of one of the outermost two moistening function members 1 is communicated with a water supply port 13 formed in the casing 12 by their essential parts being bonded together, and a water hole 10 of the other outermost moistening function member 1 is hermetically sealed by sticking a blind plate 14 onto the back of the moistening function member 1.

When the water supply port 13 of the casing 12 of the humidifier thus constructed is connected to a water supply source and then water is supplied thereto, the water is introduced via the water supply hole 11 into the water guide component 4 of each moistening function member 1. The water thus introduced is retained in the water guide component 4 in such a state that the water guide member 7 enclosed in the water guide component 4 of each moistening function member 1 is impregnated therewith. When air to be. moistened is sent into each air supply layer 2 in that state, the air is humidified by the water vapor permeating through the outer surfaces of the water-retaining water guide components 4 located to face the air supply layer 2 with the air supply layer 2 being interposed therebetween. Moistening by natural evaporation is thus carried out continuously.

In contrast to a humidifier that uses a corrugated plate as a spacer plate, the air supply layer 2 can be formed between the water guide components 4 by the first and second spacers 5, 6 without the substantial restriction as to the distance relative to the height, and the sufficiently wide opening area can be secured, for instance 3.3 mm×225 mm in this embodiment, and thus the static pressure loss is extremely small. In this embodiment, nothing exists between the first and second spacers 5, 6 and the intended shape is maintained due to the rigidity of the water guide members 7 of the adjacent moistening function members 1. Consequently, since, unlike the corrugated spacer plate, no element contacts the outer surface of the water guide component 4 between the first and second spacers 5, 6, a percentage of loss of the moisture permeable function of the moisture permeable film 8 is extremely small and the moistening performance is improved accordingly. Since the opening area of the individual air supply layer 2 is wide, and thus the total pressure loss of the entire supply layers 2 to the sent air is considerably reduced, the space between the moistening function members 1 can be narrowed if the flow path resistance is set equal to what ensured by the corrugated spacer plate. Accordingly, the humidifier can be made small in size. In other words, if the external dimensions are equal, the larger number of the moistening function members 1 can be laid, whereby a high-performance humidifier offering high moistening capability is attainable. Water is supplied to each water guide component 4 in parallel and since the individual flow path is not so long, the water supply time is shortened. The rising time in the initial operation of the humidifier can thus be shortened.

As this humidifier can be fabricated through relatively simple work steps of, for example, cutting, stacking and bonding without the troublesome, complicated step of winding a material of large length into the form of a vortex, the productivity during the process of manufacture is high and the process automation is relatively readily implemented.

Embodiment 2

FIGS. 5 through 8 inclusive, illustrate a humidifier according to a second embodiment of the invention in which a modification regarding the water supply is applied to the humidifier of the first embodiment of the invention. The arrangement except the water supply structure is basically similar to that of the first embodiment of the invention, so that like reference characters are given to like or corresponding component parts of the first embodiment and the description thereof will be omitted.

Figure 6:
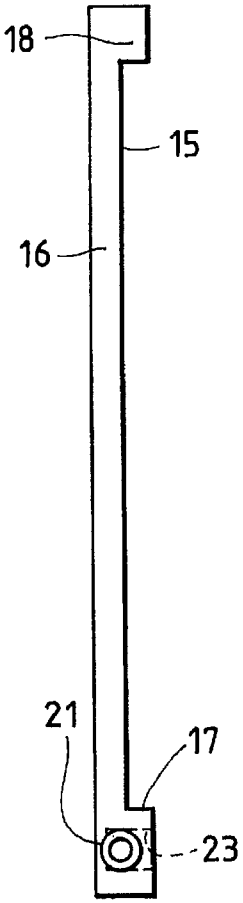
FIG. 6 is a side view of the functional member shown in FIG. 5.
Figure 5:
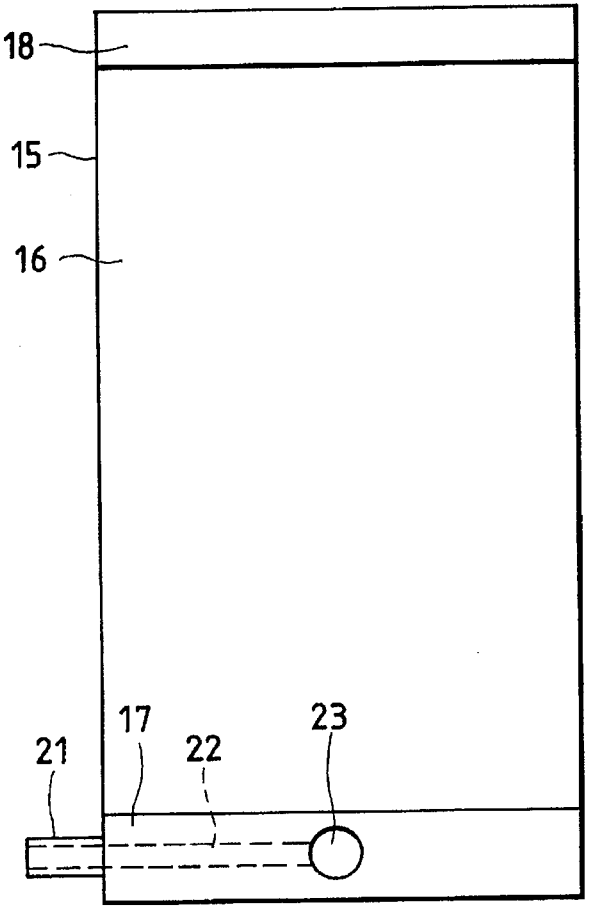
FIG. 5 is an elevational view of a functional member of exclusive use for supplying water, according to a second embodiment of the present invention.
Figure 9:
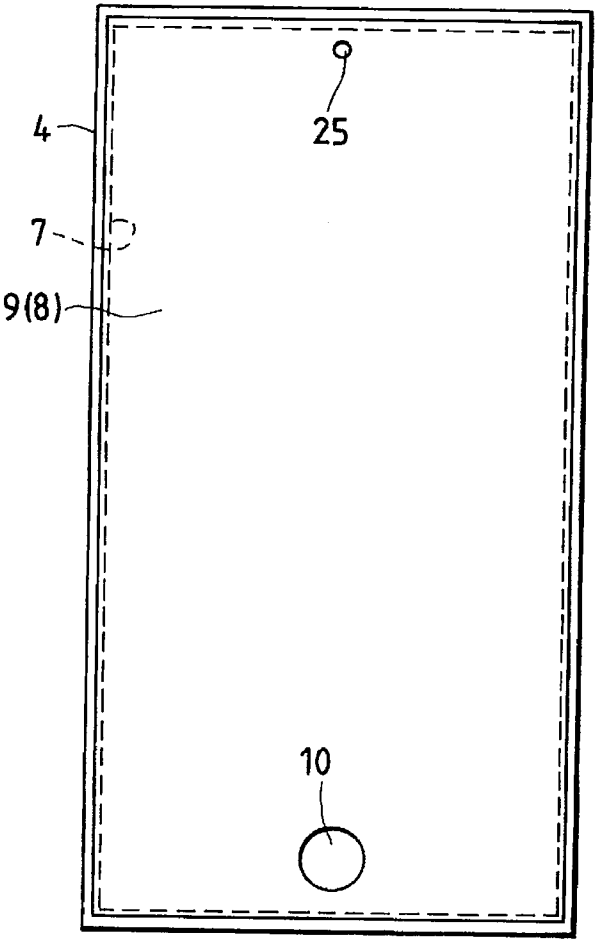
FIG. 9 is an elevational view of a water guide component according to a third embodiment of the present invention.

In the humidifier according to the second embodiment of the invention, one of the water retention layers 3 of the humidifier of the first embodiment is constructed by a water supply function member 15 serving exclusively to supply water to guide components 4 as shown in FIGS. 5, 6. The water supply function member 15 is integrally molded of ABS resin into the same outer contour as that of the moistening function member 1. That is, a water supply section 17 corresponding to the first spacer 5 of the moistening function member 1 and a space holding section 18 corresponding to the second spacer 6 are integrally protruded from one side of a flat plate section 16 having the same plane area as that of the moistening function member 1. The water supply section 17 is provided with a pipe connection port 21 on one side, to which a water supply source 19 (see FIG. 8) is connected via a water supply pipe 20, and a water supply hose. A water conduit 22 communicating with the pipe connection port 21 is formed in the water supply section 17, and one end of the water conduit 22 is connected with a communicating hole 23 bored at the center of the water supply section 17. The communicating hole 23 of the water supply section 17 is formed in a position to be aligned with the water hole 10 opened in the water guide component 4 of the moistening function member 1. The pipe connection port 21 and the water conduit 22 may also be replaced with a pipe which is inserted to communicate with the water supply pipe 20.

Figure 7:
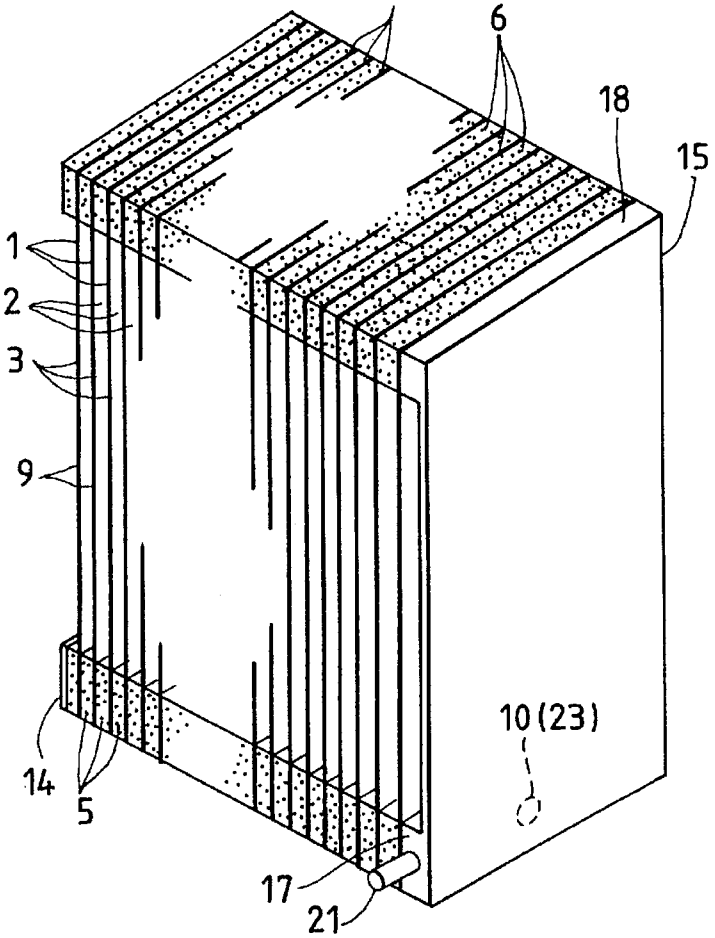
FIG. 7 is a perspective view of a humidifier according to the second embodiment of the present invention.
Figure 8:
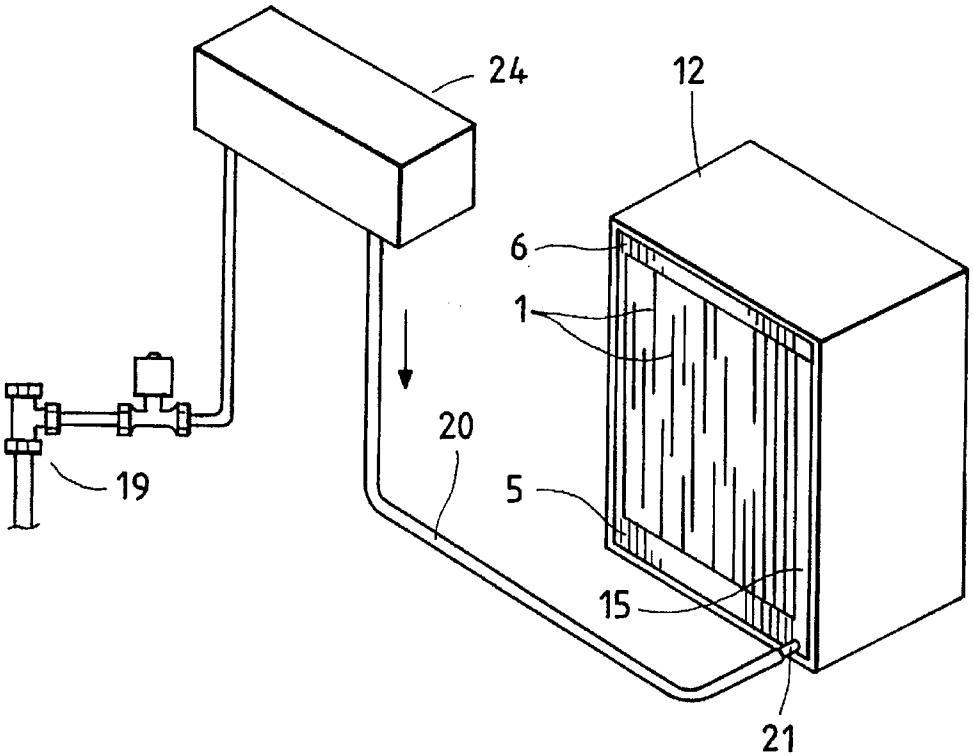
FIG. 8 is a perspective view of the humidifier in a functional mode according to the second embodiment of the present invention.
Figure 11:
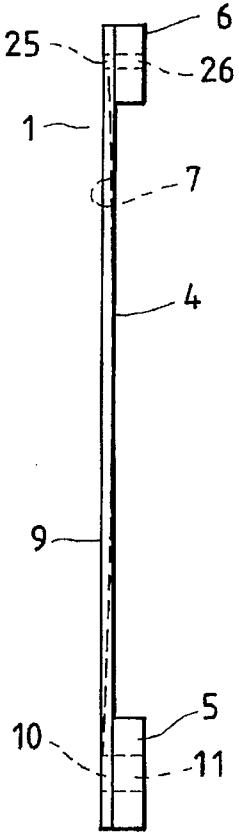
FIG. 11 is a side view of the moistening function member according to the third embodiment of the present invention.
Figure 10:
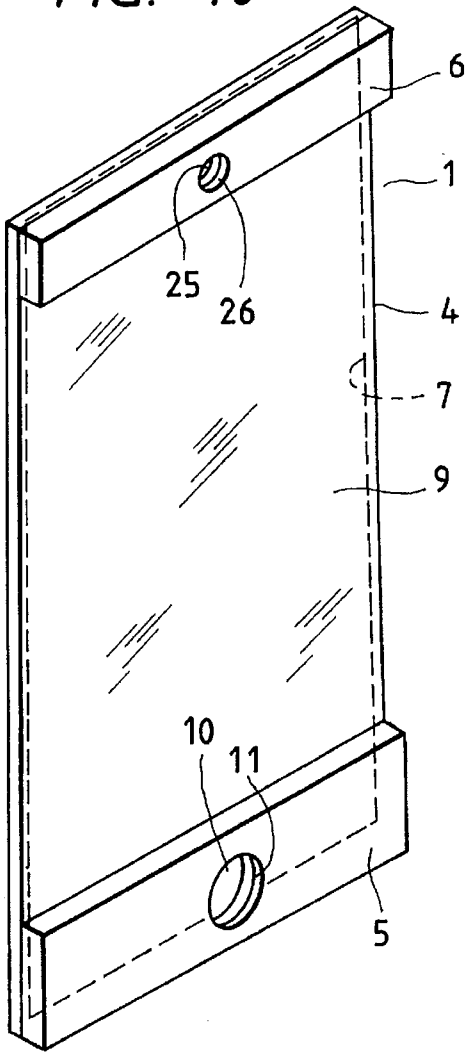
FIG. 10 is an elevational view of a moistening function member according to the third embodiment of the present invention.

The water supply function member 15 is stacked on the outermost moistening function member 1 at the water supply side in the first embodiment of the invention, and the water hole 11 of the outermost moistening function member 1 is aligned with the communicating hole 23 of the water supply section 17, and further, they are bonded together through the water supply section 17 and the space holding section 18. The whole assembly including the water supply function member 15 thus laid together is incorporated into the casing 12 as shown in FIG. 8 to complete the humidifier with the water supply side placed on a lower side. As the pipe connection port 21 of the water supply function member 15 is, as shown in FIG. 7, positioned on a side of the openings of the air supply layers 2, and the casing 12 is rendered to be 300 mm in height, 230 mm in width and 180 mm in length. Unlike the casing 12 in the first embodiment of the invention, any structure concerning water supply is unnecessary. The supply of water to each moistening function member 1 is made possible by connecting the pipe connection port 21 of the water supply function member 15 through the water supply pipe 20 to the water supply source 19 as shown in FIG. 8.

Since the pipe connection port 21 is placed on the lower side, moreover, the water supplied to fill up each moistening function member 1 can collectively be discharged outside. Therefore, inorganic substances in molten and concentrated condition can be discharged outside together with the water being discharged, whereby it is possible to lengthen the service life of the water guide component 4. The provision of the water supply function members 15 like this makes it possible to supply water even from a position different from that of the water supply hole 11 of the moistening function member 1. In case a plurality of humidifier are set adjacent one another to provide a large-sized humidifier, the pipework of the water supply pipe 20 is made simple and besides the humidifier can be disposed in tight contact with each other. As other functions are similar to those referred to in the first embodiment of the invention, the description thereof will be omitted.

A humidifier was constructed with 42 sheets of moistening function members 1 thus laid one over another and, as shown in FIG. 8, supplied with water by connecting the pipe connection port 20 of the water supply functional member 15 to the water supply source 19 through a water supply tank 24 and the water supply pipe 20. Then each water guide component 4 was filled with water within 10 minutes even in the case of a water supply pressure of 0.05 kg/cm$^2$. When air having a temperature of 20° C. and a humidity of 50% was sent to the air supply layer 2 at a rate of 300 cubic meter/hour, a moistening quantity of 0.52 kg/hour was obtained, whereas static pressure loss was 1.9 mm in terms of water-gauge pressure.

Embodiment 3

FIGS. 9 through 15 inclusive, illustrate a humidifier according to a third embodiment of the invention in which an arrangement is made not only to supply water to each moistening function member 1 but also to let air escape from the water guide component 4 of the humidifier of the above second embodiment of the invention. This humidifier is basically similar in construction to what has been introduced in the second embodiment of the invention except the provision of an air vent. Like reference characters are given to like or corresponding component parts in the first and second embodiments of the invention and the detailed description thereof will be omitted accordingly.

For the moisture permeable films 8 constituting the envelope-like film member 9 in the third embodiment of the invention, there are used non-porous composite moisture permeable films each prepared by coating a porous polytetrafluoroethylene sheet of 40μ thick with hydrophilic polyurethane resin. To both sides of the water guide member 7 formed of a sintered porous plate of hydrophilic polyethylene that has been formed into a rectangle and is 2 mm thick, the hydrophilic polyurethane sides of two sheets of moisture permeable films 8 having a plane area greater than that of the water guide member 7 are point-bonded, so that the water guide component 4 is formed as in the first embodiment of the invention. Like those in the first and second embodiments of the invention, the water guide component 4 in the third embodiment of the invention is also a rectangle having short sides 16 cm long and long sides 29.5 cm long. A water hole 10 about 15 mm in diameter, for example, is bored through the center of the water guide component 4 closer to the one of the short sides thereof, whereas another hole 25 about 10 mm in diameter, for example, is bored through the center closer to the other short side thereof (see FIG. 9).

The first spacer 5 for defining the air supply layer 2 is formed as a rectangular plastic plate of vinyl chloride which is 3.3 mm thick, 50 mm long and 16 cm wide as in the first and second embodiments of the invention. Moreover, the second spacer 6 for defining the air supply layer 2 is also formed as a rectangular plastic plate of vinyl chloride which is 3.3 mm thick, 20 mm long and 16 cm wide as in the first and second embodiments of the invention. Further, the air vent hole 26 to be aligned with the punched hole 25 of the water guide component 4 is bored through the center of the second spacer 6, and the second spacer 6 is bonded to the water guide component 4 with a polyurethane-based adhesive so that the punched hole 25 and the air vent hole 26 are aligned together.

The plurality of moistening function members 1, each of which is constructed by the water guide component 4 with the first and second spacers 5, 6 bonded thereto, are laid so that the first spacer side and the second spacer side are aligned respectively with the first spacer side and the second spacer side of the adjacent moistening function member 1 and the first and second spacers contact the surface of the adjacent moistening function member 1 where no spacer is provided, and then the whole assembly is incorporated into the casing 12 to form the humidifier with the water supply side be located at a lower side. The moistening function members 1 thus laid one over another are integrated in such a manner that the surface of each first spacer 5 and the surface of the water guide component 4 of the adjacent moistening function member 1 where the first spacer 5 is not provided are bonded together to ensure watertightness and that the second spacer side 6 is integrally bonded thereto likewise. The water hole 10 and the punched hole 25 in the outermost moistening function member 1 are each also closed with the blind plate 14.

Figure 13:
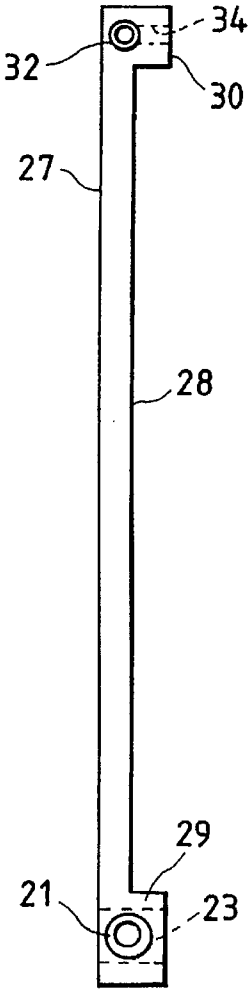
FIG. 13 is a side view of the functional member of exclusive use for supplying water and venting air according to the third embodiment of the present invention.
Figure 12:
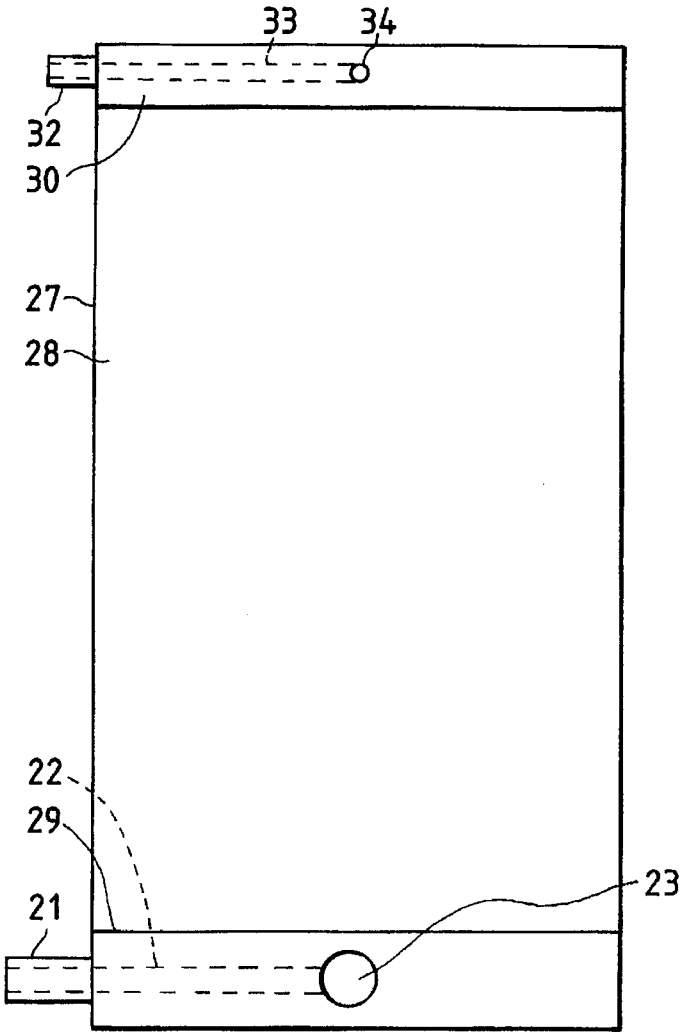
FIG. 12 is an elevational view of a functional member of exclusive use for supplying water and venting air venting according to the third embodiment of the present invention.
Figure 15:
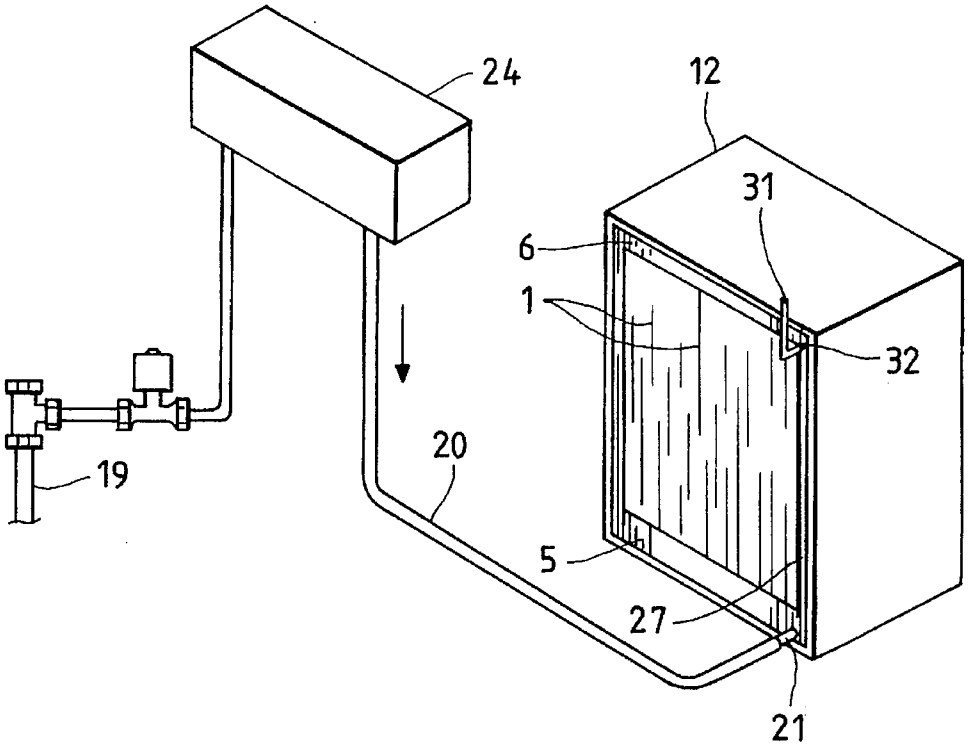
FIG. 15 is a perspective of the humidifier in a functional mode according to the third embodiment of the present invention.

The humidifier according to the third embodiment of the invention is provided also with a water supply and air vent function member 27 which is constructed by adding an air vent structure to the water supply function member 15 of the second embodiment, the water supply and air vent function member being provided in the same way as the water supply function member 15 is provided in the second embodiment. More specifically, the water supply and air vent function member 27 is, as shown in FIGS. 12, 13, integrally molded of ABS resin into the same outer contour as that of the moistening function member 1. A water supply section 29 corresponding to the first spacer 5 of the moistening function member 1 and an air vent section 30 located opposite from the water supply section 29 are integrally protruded from one side of a flat plate section 28 having the same plane area as that of the moistening function member 1. The water supply section 29 is similar in construction to the water supply function member 15 in the second embodiment, and the air vent section 30 is provided with a connection port 32 on one side for connection to an air vent pipe 31 (FIG. 15). A discharge channel 33 communicating with the connection port 32 is formed in the air vent section 30, and one end of the discharge channel 33 is communicated with an air vent hole 34 bored through the center of the air vent section 30. The air vent hole 34 is formed at a position so as to be aligned with the punched hole 25 opened in the water guide component 4 of the moistening function member 1. The connection port 32 and the discharge channel 33 may also be replaced with a pipe inserted to communicate the air vent hole 34 with the air vent pipe 31. The other arrangement is similar in construction to the second embodiment of the invention.

Figure 14:
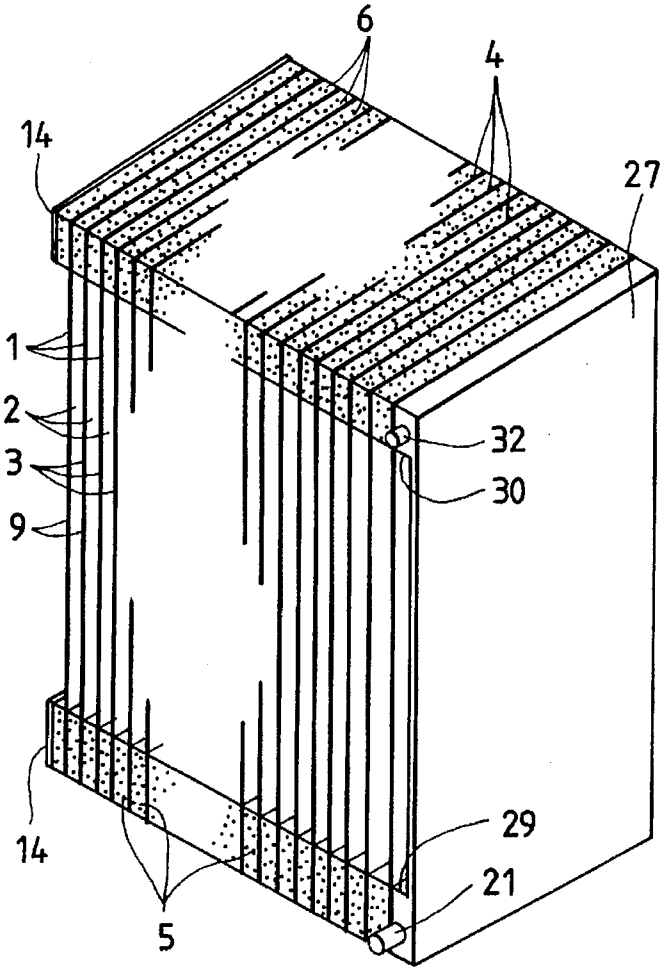
FIG. 14 is a perspective of a humidifier according to the third embodiment of the present invention.

The whole assembly including the plurality of moistening function members 1 as well as the water supply and air vent function members 27 laid thereon as shown in FIG. 14 are incorporated into the casing 12 shown in FIG. 15 as similarly to the second embodiment to form the humidifier. The pipe connection port 21 and the connection port 32 of the water supply and air vent function member 27 are, as shown in FIG. 15, located on the opening side of the air supply layer 2. When the pipe connection port 21 of the water supply and air vent function member 27 are connected via the water supply pipe 20 and the water supply tank 24 to the water supply source 19 as shown in FIG. 15, water is supplied to each water guide component 4 as in the second embodiment of the invention. While water is being supplied, air in each water guide component 4 escapes from the air vent hole 34 of the air vent section 30 located opposite to the water supply side and is collectively discharged by the air vent pipe 31 from the connection port 32 via the discharge channel 33 of the water supply and air vent function member 29. Even though the moisture permeable film 8*a* is made of material which is not or hardly permeable to air, water is smoothly supplied to each moistening function member 1. As the other arrangement is similar in construction to the first and second embodiments, the description thereof will be omitted accordingly.

A humidifier according to the third embodiment of the invention was constructed with 42 sheets of moistening function members 1 thus laid one over another and supplied with water from the water supply tank 25 as shown in FIG. 15 as similarly to the second embodiment of the invention.

Then each water guide component 4 was filled with water within 10 minutes even in the case of a water supply pressure of 0.05 kg/cm$^2$. When air having a temperature of 20° C. and a humidity of 50% was sent to the air supply layer at a rate of 300 cubic meter/hour, a moistening quantity of 0.52 kg/hour was obtained, whereas static pressure loss was 1.9 mm in terms of water-gauge pressure. When water was supplied while the air vent pipe 31 was closed, moreover, each water guide component 4 was filled with water 24 hours later even at a water supply pressure of 0.5 kg/cm$^2$.

Embodiment 4

Figure 16:
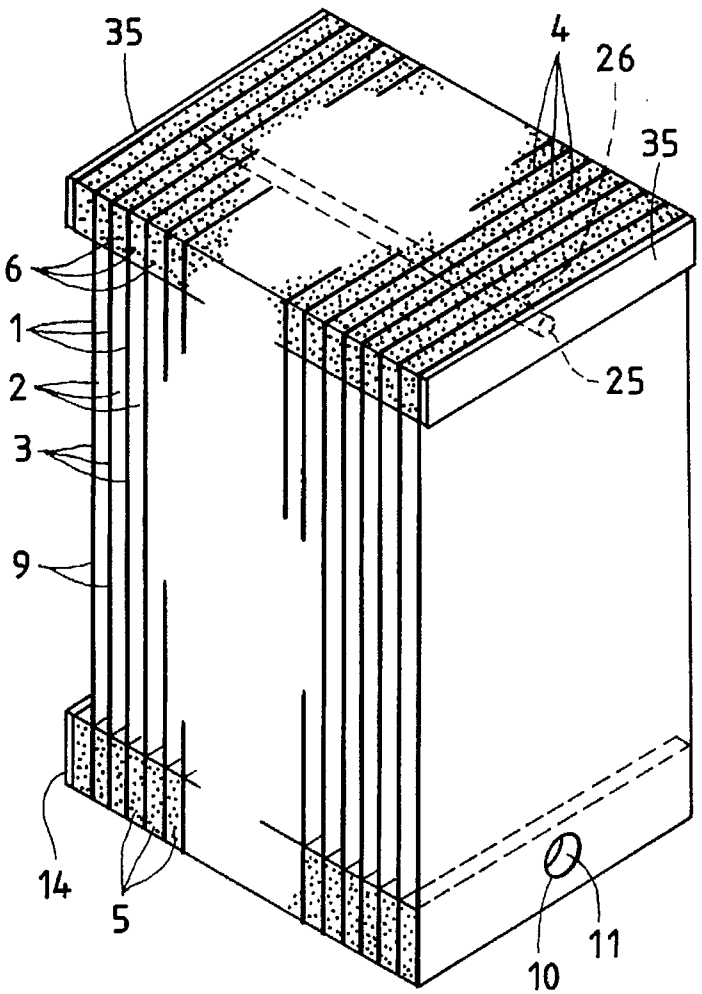
FIG. 16 is a perspective view of a humidifier according to a fourth embodiment of the present invention.

FIG. 16 illustrates a humidifier according to a fourth embodiment of the invention in which, excluding the water supply and air vent function member 27 of the third embodiment, an arrangement of the humidifier is made such that a moisture permeable, porous film 35 which is waterproofed but permits air to penetrate therethrough is bonded to close the air vent hole 26 and the punched hole 25 of the second spacer 6 of the outermost moistening function member 1, whereby any special pipework is dispensed with to cause the air in each water guide component 4 to escape outside. As the remainder is basically similar in construction to the first and third embodiments of the invention, like reference characters are given to like component parts and the detailed description thereof will be omitted accordingly.

Embodiment 5

Figure 17:
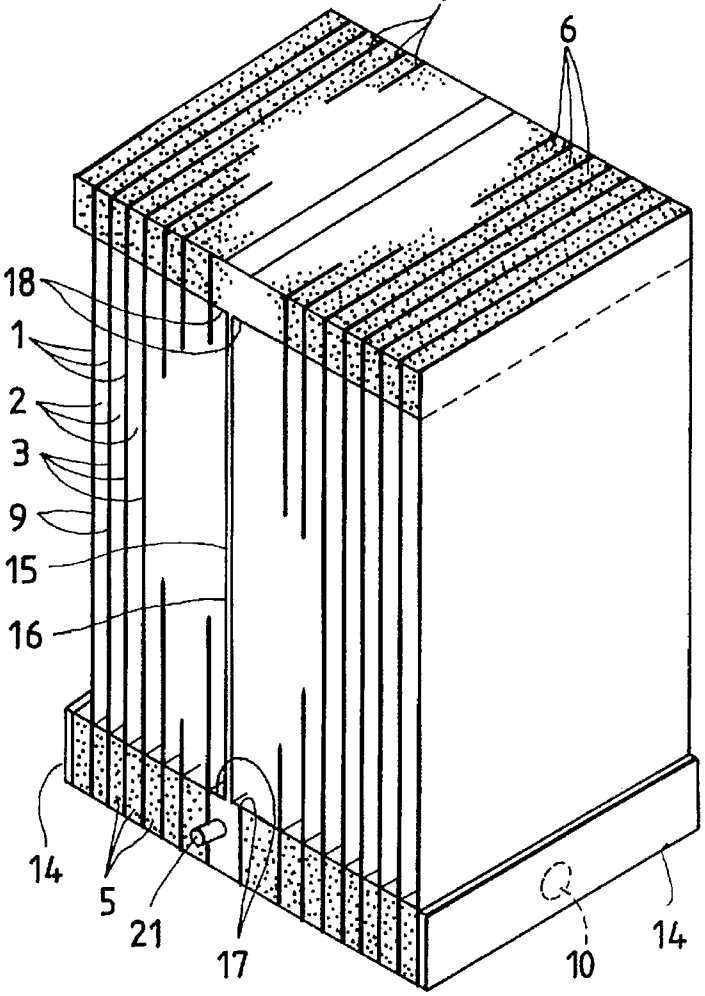
FIG. 17 is a perspective view of a humidifier according to a fifth embodiment of the present invention.

A humidifier according to a fifth embodiment of the invention employs, as shown in FIG. 17, the water supply function member 15 located as an intermediate layer, and as the remainder is similar in construction to the second embodiment of the invention, like reference characters are given to like component parts and the description thereof will be omitted accordingly.

Figure 19:
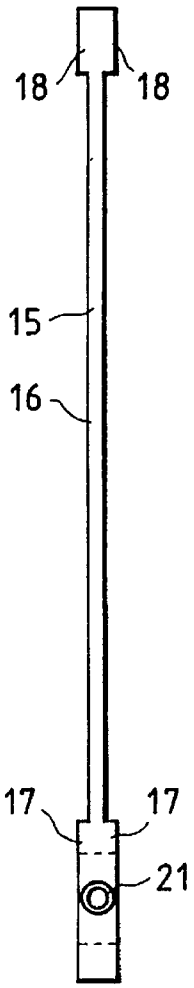
FIG. 19 is a side view of the functional member of exclusive use for supplying water according to the fifth embodiment of present invention.
Figure 18:
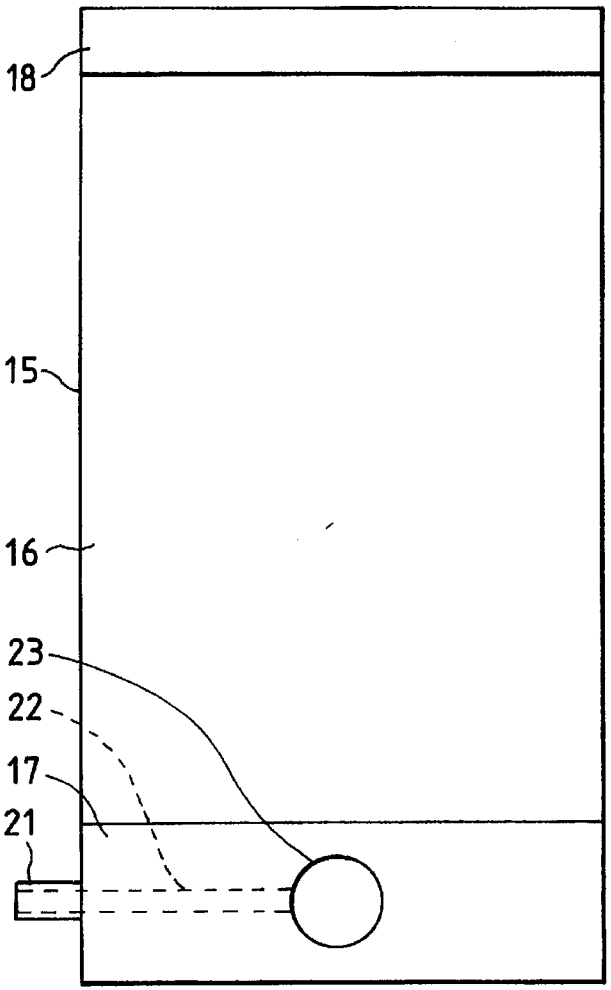
FIG. 18 is an elevational view of a functional member of exclusive use for supplying water according to the fifth embodiment of present invention.

The humidifier according to the fifth embodiment of the invention is so constructed that a water supply section is provided in an intermediate layer as shown in FIG. 17. More specifically, as shown in FIGS. 18 and 19, the water supply function member 15 is integrally molded of ABS resin into the substantially same outer contour as that of the moistening function member 1. The 3.3-mm water supply section 17 similar to the first spacer 5 of the moistening function member 1 and the space holding section 18 which is equivalent to the second spacer 6 and has the same height as that of the first spacer 5 are integrally protruded from each side of the flat plate section 16 having the same plane area as that of the moistening function member 1 and a thickness of 1.5 mm. The water supply section 17 is provided with the pipe connection port 21 on one side for connection to the water supply source via the water supply pipe. The water conduit 22 connected to the pipe connection port 21 is formed in the water supply section 17, and one end of the water conduit 22 communicates with the communicating hole 23 provided in the center of the water supply section 17. The communicating hole 23 of the water supply section 17 is formed at a position to be aligned with the water hole 10 opened in the water guide component 4 of the moistening function member 1.

The water supply function member 15 thus constructed is held at an arbitrary position between layers of the moistening function members 1, and they are bonded together with polyurethane-based resin in the stacked state as similarly to the second embodiment, thereby providing the humidifier as shown in FIG. 17. Since the water supply function member 15 of the humidifier in the fifth embodiment is located as the intermediate layer, the water holes 10 and the water supply holes 11 of the outermost two moistening function members are tightly closed with the blind plates 14. The remainder is similar in construction to the second embodiment of the invention.

Since the water supply section of the humidifier according to the fifth embodiment can be placed in any desired layer-to-layer position, the freedom of design with regard to water supply pipework and water supply location is increased. As the basic function other than the aforementioned is similar in construction to the second embodiment of the invention, the description thereof will be omitted. With respect to the water supply and air vent function member 27 explained in the third embodiment, it may be interposed between layers by using the similar arrangement explained for the water supply function member 15 of this embodiment, so that the freedom of design with regard to water supply and air vent location is increased.

Figure 20:
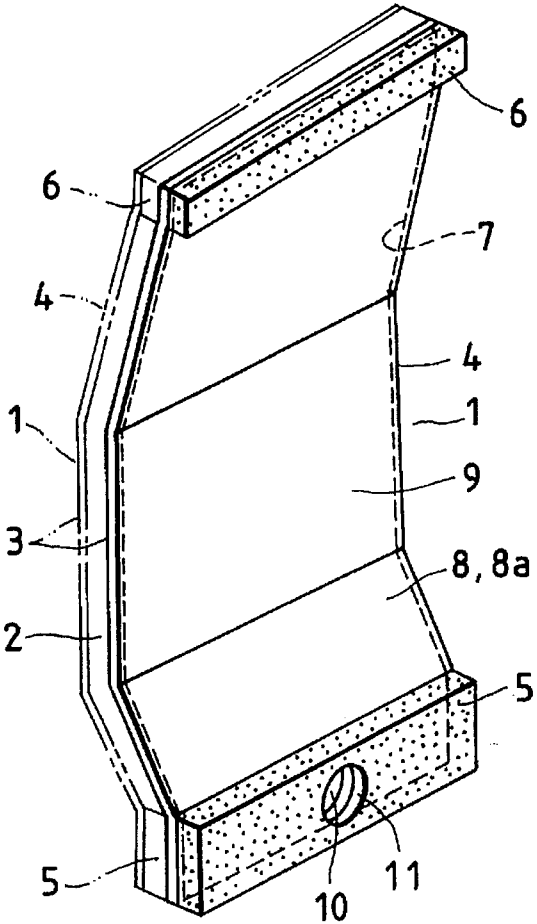
FIG. 20 is a perspective view of another moistening function member in another mode according to the present invention.

The moistening function members 1 according to the first to fifth embodiments are generally planar and rectangular in shape; however, they may be shaped differently; namely, curved or bent as shown in FIG. 20 or shaped into what is other than a rectangle, depending on the shape of the water guide component 4. Although the use of conventional corrugated spacer plates inevitably renders the side view of the apparatus rectangular or square in view of poor yields, the moistening function member 1 according to each embodiment of the invention may be shaped and formed into any configuration other than a rectangle or a square. Consequently, it is possible to flexibly deal with the shape and size of the humidifier in accordance with the installation space of an equipment to which the humidifier is to be installed, the shape of the equipment or the like.

The moisture permeable film 8 may be of any moisture permeable film as long as it prevents liquid water to permeate therethrough but permits water vapor to permeate therethrough, and, other than the materials referred to in the above embodiments of the present invention, it may be, for example, a porous polyethylene or polypropylene film, or a non-woven fabric with which a thin film of ion exchange resin is combined. Further, it is conceivable to use a composite moisture permeable film which is prepared by combining a woven fabric or knit (knitted cloth) or the like with a thin moisture permeable film of polytetrafluoroethylene.

As the water guide member 7, any material may be used as long as it has three-dimensional water-permeability and rigidity and is free from deflection when it is mounted between the first and second spacers 5, 6. For example, the following is applicable: for example, knit (knitted cloth) composed of fibers looped in the direction of its thickness or cloth material such as a three-dimensional woven fabric, to which the rigidity is added; a sintered resin composed of resin particles fusion bonded with spaces left among them (Brand Name: Ever-Right Scot, Bridgestone Corporation); or a porous material made of foamed metal (foamed nickel or the like).

With respect to the method of sealing the outer peripheral portions of the moisture permeable films 8, commonly known sealing methods such as thermal fusion bonding, ultrasonic fusion bonding, impregnation of sheet material and the like can be widely used other than the bonding with adhesive.

Although vinyl chloride widely known as material for water pipes and water tanks is preferable as the material for the first and second spacers 5, 6, polypropylene and polyethylene resin may also be employed. With importance attached to ease of molding, moreover, selection may be made of polystyrene or ABS resin; with importance attached to flexibility, nylon or urethane resin; with importance attached to flexibility and adhesion, ethylene-vinyl acetate copolymer (EVA) or ethylene-ethyl acrylate copolymer (EEA); and with importance attached to strength, epoxy resin, for the first and second spacers 5, 6, that is, suitable selection can be made in relation to the water guide component 4.

Regarding the bonding adhesive, not only an urethane-based adhesive but also what has adhesive properties applicable to the materials of the first and second spacers 5, 6 and that of the moisture permeable films 8, 8*a* may properly be selected.

The following comparative examples of humidifier were manufactured to conduct comparative tests for the purpose of making clear the performance and characteristics of the humidifier according to the above embodiments of the invention.

COMPARATIVE EXAMPLE 1

One side of a porous polytetrafluoroethylene sheet was coated with hydrophilic polyurethane resin, and reinforcing cloth highly permeable to air was bonded onto the other side thereof to produce a composite material (Brand Name: Goatex In the Second Generation, Japan Goatex Co.), which was used as a moisture permeable film for a humidifier of the natural evaporation type.

Figure 21:
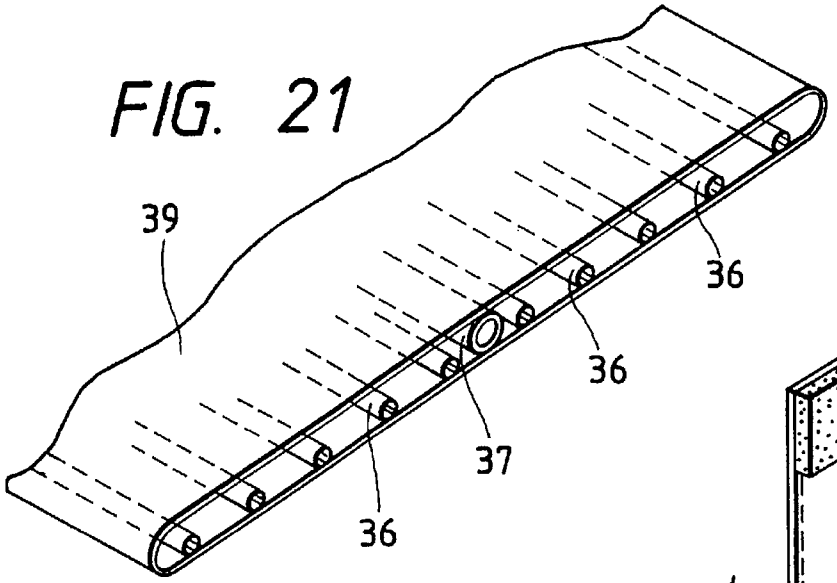
FIG. 21 is a perspective view of the principal part of Comparative Example 1 used in a test for verifying the performance and characteristics of the embodiments of the present invention.
Figure 60:
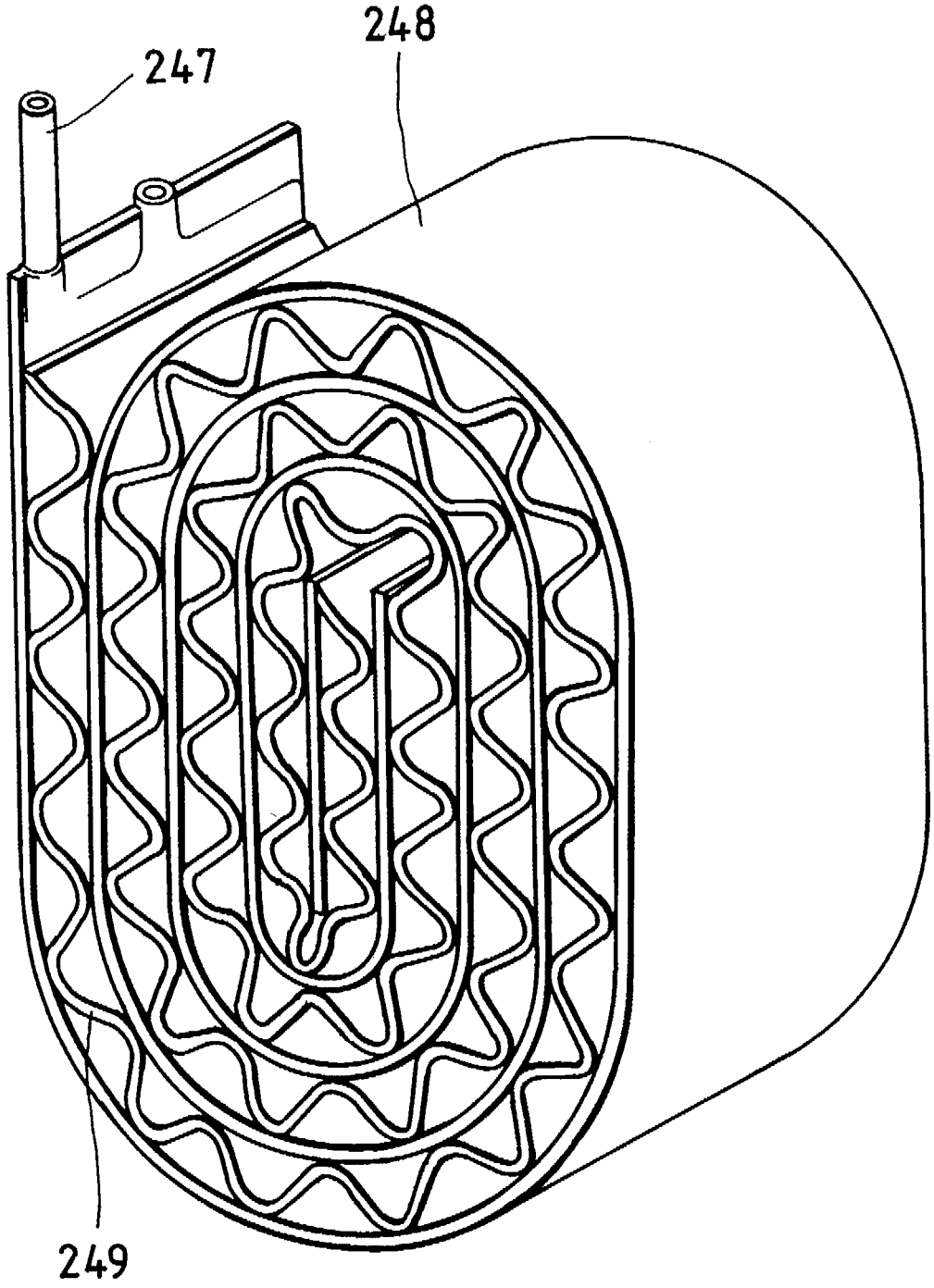
FIG. 60 is a perspective view of a humidifier disclosed in U.S. Pat. No. 5,318,731.

Ten pieces of vinyl-chloride ribs 36 having a diameter of 2 mm were bonded substantially every 20 mm intervals onto a half of the hydrophilic-polyurethane-coated side of a moisture permeable film of 40 cm wide and 10 m long with a polyurethane-based bonding adhesive as shown in FIG. 21. The moisture permeable film was folded in two and then it was formed into a tube by sticking the end portions together. Further, a pipe-like porous hollow member 37, which was waterproofed but permitted air to permeate therethrough and had a length of 10 m and an inner diameter of 3 mm was inserted into the tube. A water supply port was provided at the one end of the tube and the remainder was closed to form an envelope so as to produce the tubular film member 39. By using this tubular film member 39, a conventional humidifier as shown in FIG. 60 was constructed. That is, the tubular film member 39 (248) having a length of 10 m and the corrugated spacer plate (249) having a length of 10 m were stacked and spirally wound in such a manner that one side onto which the ribs 36 of the tubular film member 48 had been bonded and the spacer plate (249) were located inside.

The humidifier was incorporated in a casing whose external dimensions were 300 mm in height, 230 mm in width and 200 mm in length, and then the humidifier was supplied with water from a water supply tank. In a case where water supply pressure was 0.05 kg/cm$^2$, it took 30 minutes to fill up the apparatus with water. When air having a temperature of 20° C. and a humidity of 50% was sent in at a rate of 300 cubic meter/hour, moreover, a moistening quantity of 0.45 kg/hour was obtained, whereas static pressure loss was 5.4 mm in terms of water-gauge pressure.

COMPARATIVE EXAMPLE 2

Figure 22:
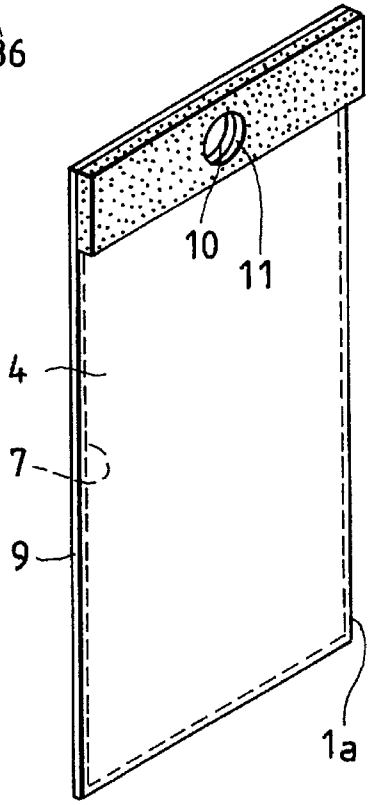
FIG. 22 is a perspective view of the principal part of Comparative Example 2 used in a test for verifying the performance and characteristics of the embodiments of the present invention.

A unit 41 was obtained by laminating moistening function members 1a (FIG. 22) which is basically similar in construction to that in the second embodiment of the invention but has no second spacers 6 in such a manner that first spacers 5 are each stacked on the moistening function members 1*a*. A corrugated spacer plate 49 having a height of 3.3 mm was inserted in between the water guide components 4 of the unit 41 and bonded thereto to provide a humidifier of the natural evaporation type as shown in FIG. 23.

The humidifier was incorporated in a casing whose external dimensions were 300 mm in height, 230 mm in width and 180 mm in length, and then it was supplied with water from the water supply tank. In a case where water supply pressure was 0.05 kg/cm$^2$, it took 10 minutes or less to fill up the interlaminar sections each formed by the spacer plates 42 with water. When air having a temperature of 20° C. and a humidity of 50% was sent in at a rate of 300 cubic meter/hour, moreover, a moistening quantity of 0.50 kg/hour was obtained, whereas static pressure loss was 6.4 mm in terms of water-gauge pressure.

Figures 23, 24:
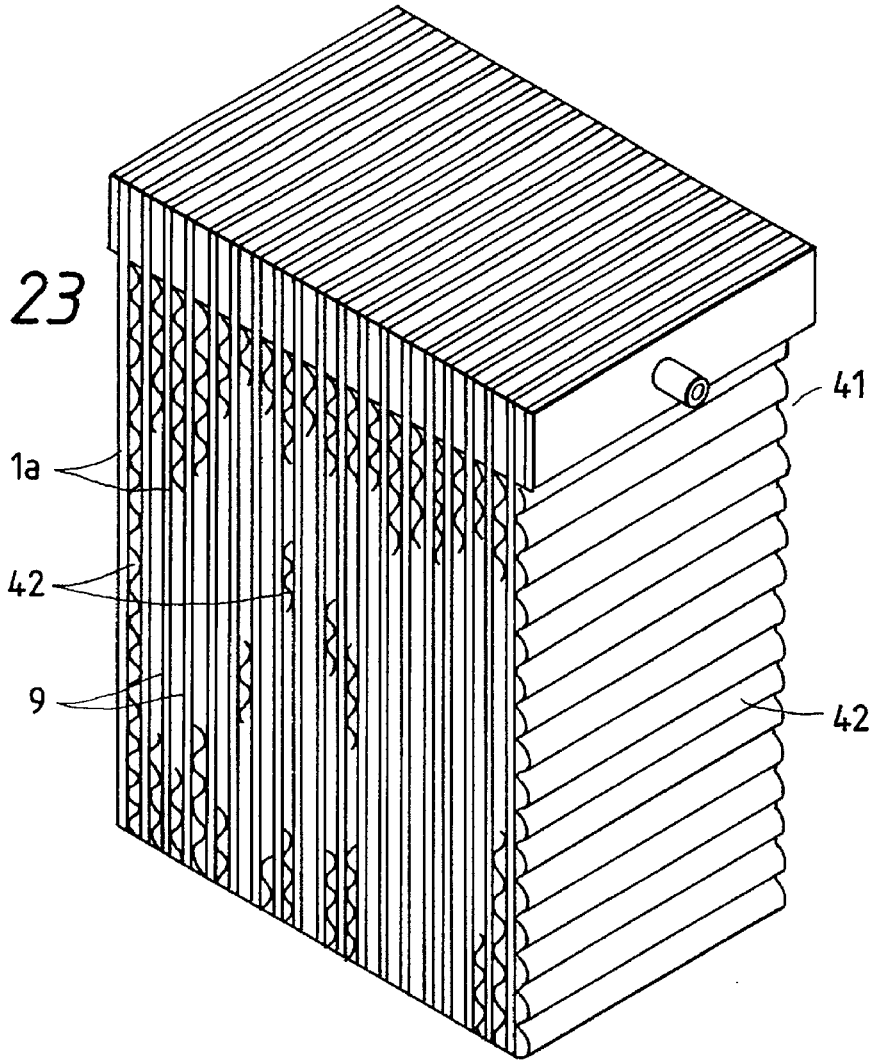
FIG. 23 is a perspective view of a humidifier of the Comparative Example 2.
FIG. 24 is a table showing the test results of the embodiments of the present invention and Comparative Examples 1 and 2

FIG. 24 shows a table illustrating the performance of these Comparative Examples 1, 2 together with that of the representative embodiments 2 and 3 of the invention. In other words, the humidifier in the embodiments 2 and 3 exhibit performance higher than and pressure loss extremely lower than those in Comparative Example 1. Although Comparative Example 2 is an improved version of Comparative Example 1 in that the problem of continuous length has been solved and the moistening quantity is greater than that in Comparative Example 1, the static pressure loss is greater than that in Comparative Example 1 and any one of the embodiments of the invention, and the moistening quantity is lower than that in the embodiments 2, 3 of the invention.

Water supply time in the embodiments 2 through 5 of the invention (not shown) is shorter than that in Comparative Example 1, so that water can obviously be supplied for a short time. In a case where the apparatus is large-sized, the time required to supply water is lengthened further as the tubular film member 39 becomes longer with the arrangement of Comparative Example 1. Since the water retention layers 3 are arranged in parallel in each embodiment of the invention above, the time required to supply water is hardly made longer even though the number of layers is increased.

As is obvious from the description of the embodiments of the present invention, according to the first aspect of the invention, since water is supplied to the water retention layers in parallel, the water absorption or supply properties are improved; the pressure loss of the fluid supply later is greatly reduced; and a percentage of loss of the moisture permeable function is also reducible, so that not only improvement in the performance but also reduction in the size of the humidifier is promoted. Consequently, the humidifier can be produced through relatively simple cutting and laminating processes without the step of winding a spacer plate of continuous length, whereby it is possible to produce such a humidifier by automation with excellent productivity.

According to the second aspect of the present invention, since water is supplied to the water retention layers in parallel while air is allowed to escape, the water absorption properties are improved further; the pressure loss of the fluid supply later is greatly reduced; and a percentage of loss of the moisture permeable function is also reducible, so that not only improvement in the performance but also reduction in the size of the humidifier is promoted. Consequently, the humidifier can be produced through relatively simple cutting and laminating processes without the step of winding a spacer plate of continuous length, whereby it is possible to produce such a humidifier by automation with excellent productivity.

According to the third aspect of the present invention, the invention has the effect of collectively discharging the water in the water guide component of each moistening function member by means of water supply structure and smudges therein, thus prolonging the life of the water guide component, in addition to the effect of the first aspect of the invention.

According to the fourth aspect of the present invention, the invention has the effect of collectively discharging the water in the water guide component of each moistening function member by means of water supply structure and smudges therein, thus prolonging the life of the water guide component, in addition to the effect of the second aspect of the invention.

Referring to the drawings, embodiments of the present invention wherein a plurality of ribs are provided will subsequently described.

Embodiment 6

FIGS. 25 through 28 inclusive, illustrate a humidifier in the first embodiment of the invention. The humidifier shown in FIG. 24 is of a natural evaporation type for moistening air by natural evaporation. A plurality of moistening function members 101 having the same shape and dimension are laid one over another to form a hexahedron in which air supply layers 102 and water retention layers 103 are alternately arranged. Each moistening function member 101 comprises a water guide component 104 forming the water retention layer 103, rows of ribs 105 for defining the air supply layer 102, and a water supply member 106 for supplying water to the water guide layer 104. The water supply member 6 may be regarded as the first spacer 5 of the first to fifth embodiments, whereas one of the ribs 105 may be considered as the second spacer 6 of the first to fifth embodiments.

The water guide component 104 forming the water retention layer 103 is constructed such that a sheet-like water guide member 107 made of porous material is enclosed by an envelope-like film member 109 formed from moisture permeable films 108, which prevent liquid water to permeate therethrough but permit water vapor to permeate therethrough, into, for example, a rectangular or ribbon-shaped flat contour of composite multi-sheet structure. In this embodiment of the invention, the water guide member 107 is formed of 2mm-thick polyester non-woven fabric, whereas the moisture permeable films 8 is formed of a 50μ-thick porous polytetrafluoroethylene sheet.

Figure 26:
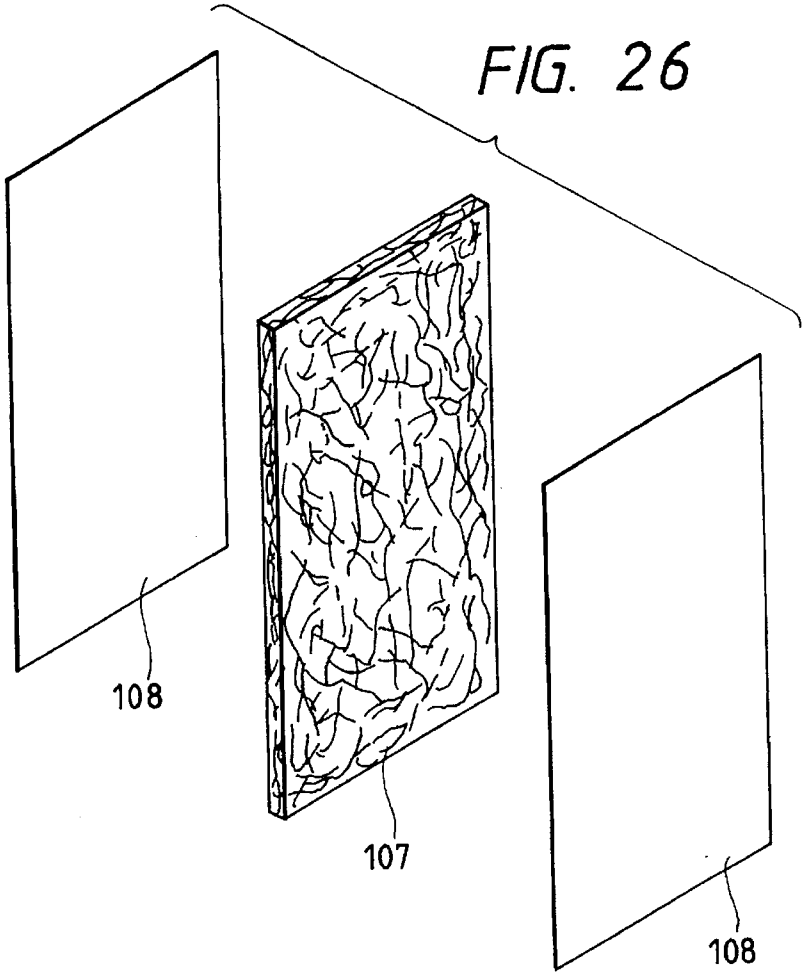
FIG. 26 is a perspective view of a water guide component according to the sixth embodiment of the present invention.
Figure 27:
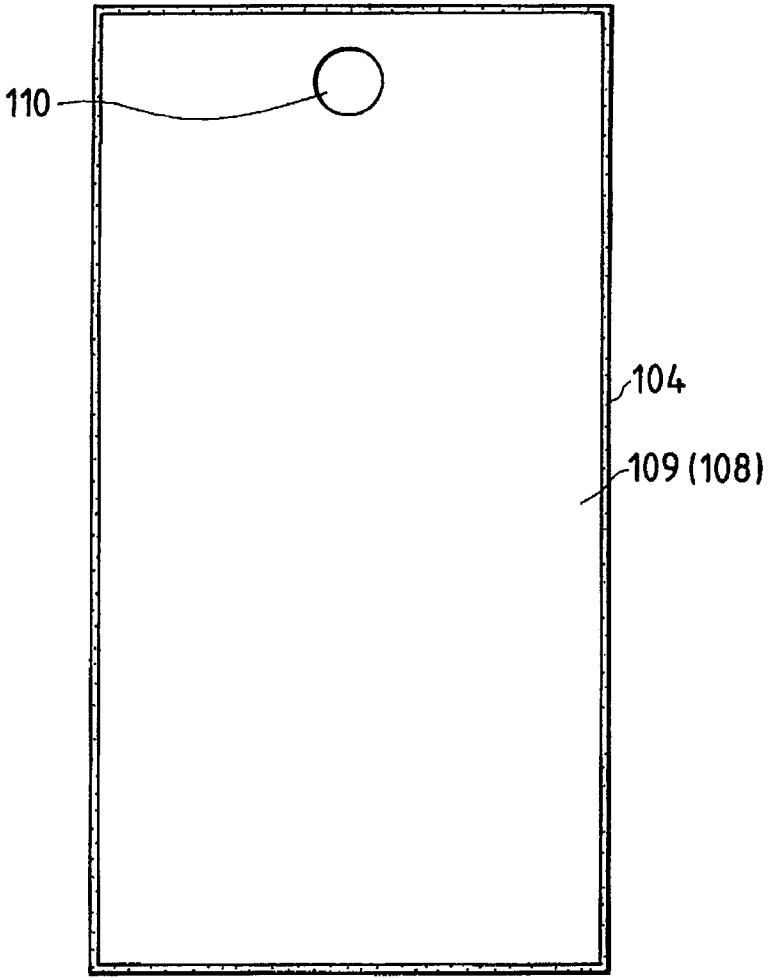
FIG. 27 is an elevational view of the water guide component according to the sixth embodiment of the present invention.

The water guide component 104 like this can relatively simply be made. In other words, two sheets of moisture permeable films 108 having a plane area greater than that of the water guide member 107 are each point-bonded to both sides of the water guide member 107 that has been cut rectangular as shown in FIG. 26 to form a sheet of three-layer structure with the water guide member 107 be held between the moisture permeable films 108. The outer peripheral sections of the moisture permeable films 108 are cut away with a bond-up margin be left, and then the outer peripheral sections of the moisture permeable films 108 in combination are bonded together to sealingly enclose the water guide member 107 as shown in FIG. 27. In this embodiment of the invention, such a rectangular water guide component 104 whose short sides are 16 cm wide and long sides 29.5 cm long is formed by the method above. A water hole 110 about 20 mm in diameter is bored through the water guide component 104 at the center closer to the one of the short sides thereof.

The rows of ribs 105 is provided for defining the air supply layer 2 divided into a plurality of sections, and each rib 105 is formed of a thin piece of vinyl chloride resin which is 3.3 mm long and 3 mm wide and rectangular in cross section. More specifically, as shown in FIG. 28, ten thin resin pieces are placed every 25 mm of intervals on one side of the water guide component 104 in parallel to each other along the short sides, and the flank of each piece is bonded to the surface of the water guide component 104 with a polyurethane resin adhesive to form the rib 105.

The water supply member 106 is a flat plate of vinyl chloride which is 16 cm long, 50 mm wide and 3.3 mm thick corresponding to the height of the rib 105. As shown in FIG. 28, a water supply hole 111 to be aligned with the water hole 110 of the water guide component 104 is bored through the center of the water supply member 106. The water supply member 106 is also water-tightly bonded with the polyurethane adhesive, in parallel to the rib 105, along one of the short sides of the water guide component 104, onto the same plane of the water guide component 104 where the ribs 105 are provided, so that the water hole 110 and the water supply hole 111 are aligned with each other.

Figure 25:
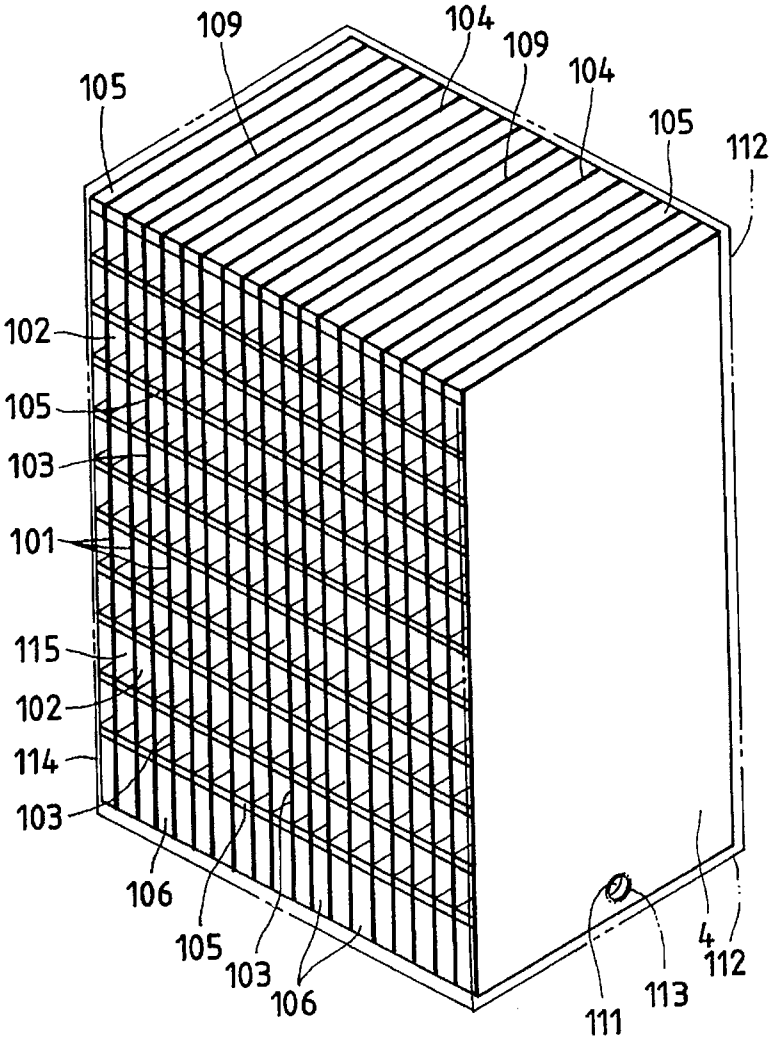
FIG. 25 is a perspective view of a humidifier according to a sixth embodiment of the present invention.
Figure 28:
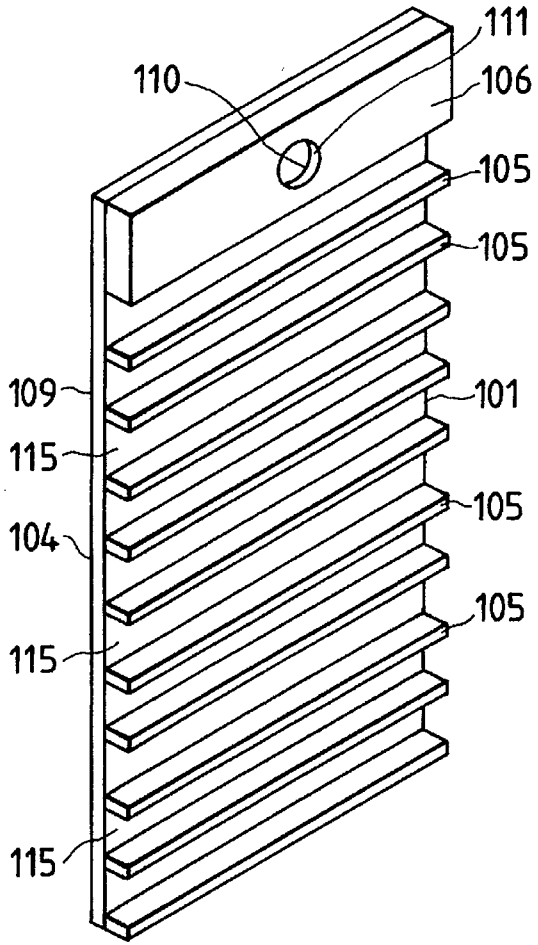
FIG. 28 is a perspective view of a moistening function member according to the sixth embodiment of the present invention, illustrating the constitution thereof.

The moistening function members 101 so constructed as to have the ribs 105 and the water supply members 106 each joined to the water guide components 104 as shown in FIG. 28 are laid one over another in such a manner that the water supply member side of each moistening function member 101 is aligned with the water supply side of the adjacent moistening function member 101 and the ribs 105 contact the surface of the adjacent moistening function member 101 where ribs 105 are not provided, and then the whole assembly is incorporated into a casing 112, to thereby form the humidifier shown in FIG. 25. The moistening function members 101 thus laid one over another are integrated by water-tightly bonding together one side of each water supply member 106 and the surface of the water guide component 104 of the adjacent moistening function member 101 where the water supply member 106 is not provided. A water hole 110 of one of the outermost two moistening function members 101 is communicated with a water supply port 113 of the casing 112 by bonding, whereas a water hole 110 of the other outermost moistening function member 101 is hermetically sealed by a blind plate 114 bonded to the back of the moistening function member 101.

When the water supply port 113 of the casing 112 of the humidifier thus constructed is connected to a water supply source so as to supply water, water is introduced via the water supply hole 111 into the water guide component 104 of each moistening function member 101. The water thus introduced is retained in the water guide component 104 in such a state that the water guide member 107 enclosed in the water guide component 104 of each moistening function member 101 is impregnated with the water. When air to be moistened is sent into each air supply layer 102 in that state, the air is humidified by the water vapor permeating through the outer surface of each of the water-retaining water guide components 104 facing both sides of the air supply layer 102. Moistening by natural evaporation is thus carried out continuously.

In contrast to a corrugated spacer plate, the air supply layer 102 can be defined between the water guide components 104 having the ribs 105 without the substantial restriction regarding the rib-to-rib distance with respect to its height, and as the opening area of an air channel 115 existing between the two adjacent ribs 105 is set sufficiently wide, for instance 3.3 mm×25 mm in this embodiment, its height is free from unevenness occurring in the case of the corrugated plate, and the number of channels of the air supply layer 102 per unit area is also small. Consequently, the moistening performance is improved because of the following attributes: the structural stability as a laminated body is excellent; the contact area of the rib 105 with the outer surface of the water guide component 104 is small; and a percentage of loss of the moisture permeable function of the outer surface of the water guide component 104 due to the contact to the rib 105 is small. The opening area of the individual air channel 115 is wide, so that pressure loss resulting from sending air to the whole air supply layer 102 is reduced. Therefore, the space between the moistening function members 101 can be narrowed on condition that the flow path resistance is set equal to what ensues from a corrugated spacer plate; the whole size becomes thus reducible. Provided the external dimensions are equal, more moistening function members 101 may be laminated, whereby a high-performance humidifier offering high moistening capability is attainable. Water is supplied to each water guide component 104 in parallel and since the individual flow path is not so long, the water supply time is shortened. The rising time in the initial operation of the humidifier can thus be shortened.

As this humidifier can be fabricated through relatively simple work steps of, for example, cutting, laminating and bonding without the troublesome, complicated step of winding a material of continuous large length into the form of a vortex, productivity during the process of manufacture is high and process automation is relatively readily implemented.

Embodiment 7

FIGS. 29 through 32 inclusive, illustrate a humidifier according to a seventh embodiment of the invention in which a modification regarding the water supply structure is applied to the humidifier of the sixth embodiment of the invention. The arrangement except for what is related to the water supply structure is basically similar to that of .the sixth embodiment of the invention. Accordingly, like reference characters designate like or corresponding component parts in the sixth embodiment of the invention and the detailed description thereof will be omitted.

Figure 29:
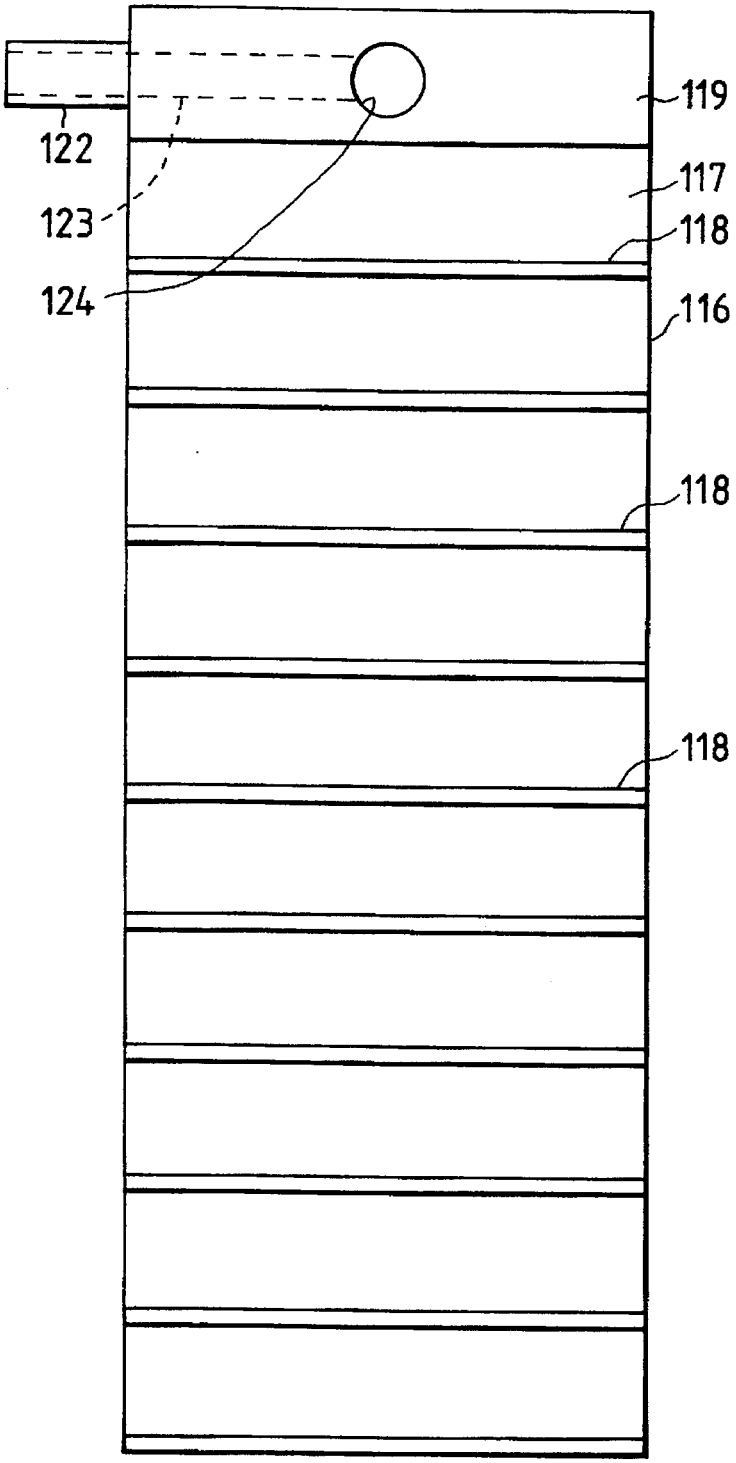
FIG. 29 is an elevational view of a functional member of exclusive use for supplying water according to a seventh embodiment of the present invention.
Figure 30:
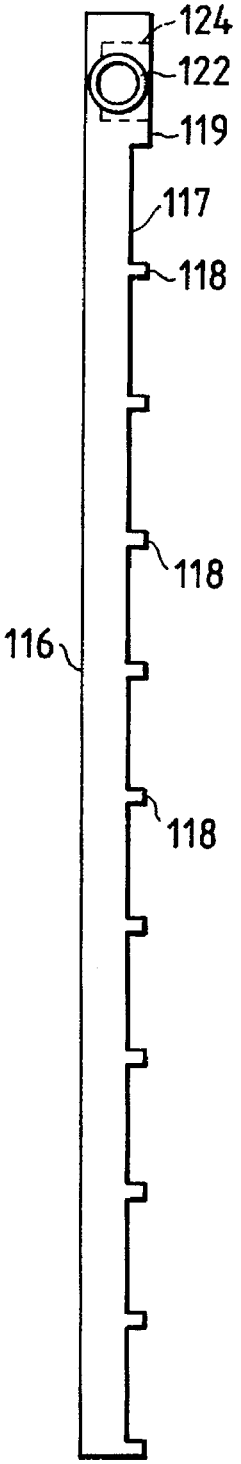
FIG. 30 is a side view of the functional member of exclusive use for supplying water according to the seventh embodiment of the present invention.

The humidifier of the seventh embodiment uses one of the water retention layers 103 of the humidifier of the sixth embodiment of the invention as a water supply function member 116 as shown in FIGS. 29, 30, so that the water is supplied to each water guide component 104 via the water supply function member 116. The water supply function member 116 is integrally molded of ABS resin into the same external contour as that of the moistening function member 101. In other words, ribs 118 similar to the ribs 105 of the moistening function member 101 and water supply sections 119 equivalent to the water supply members 106 are integrally protruded from one side of a flat plate section 117 having the same plane area as that of the moistening function member 101. The water supply section 119 is provided with a pipe connection port 122 on one side for connection to a water supply source 120 (FIG. 32) via a water supply pipe 121. A water conduit 123 communicating with the pipe connection port 122 is formed in the water supply section 119, and one end of the water conduit 123 is connected with a communicating hole 124 bored through the center of the water supply section 119. The communicating hole 124 of the water supply section 119 is formed in a position to be aligned with the water hole 110 opened in the water guide component 104 of the moistening function member 101. The pipe connection port 122 and the water conduit 123 may be replaced with a pipe inserted to communicate the water hole 110 with the water supply pipe 121.

Figure 32:
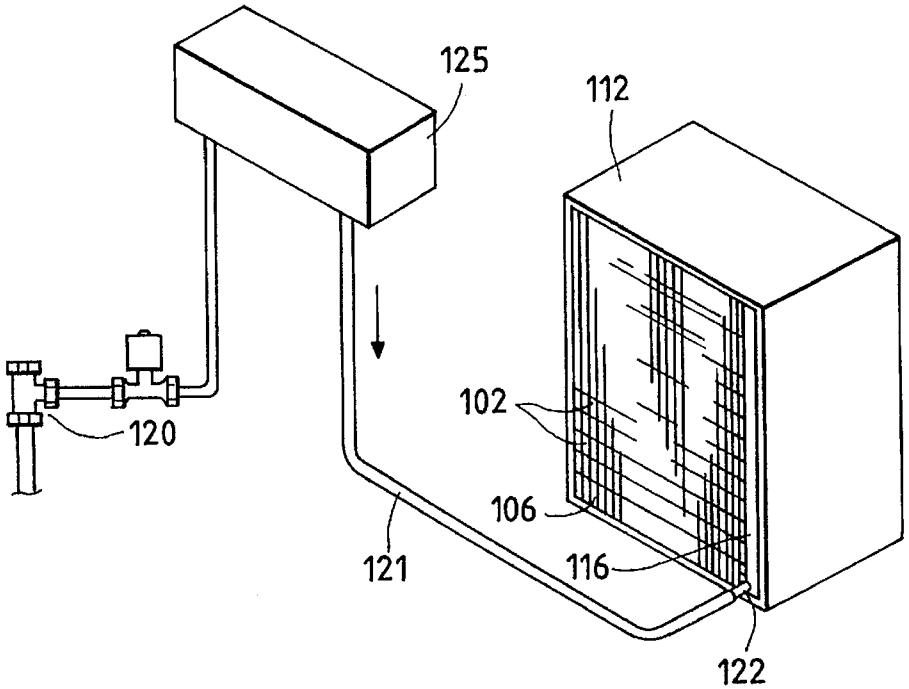
FIG. 32 is a perspective view of the humidifier in a functional mode according to the seventh embodiment of present invention.
Figure 31:
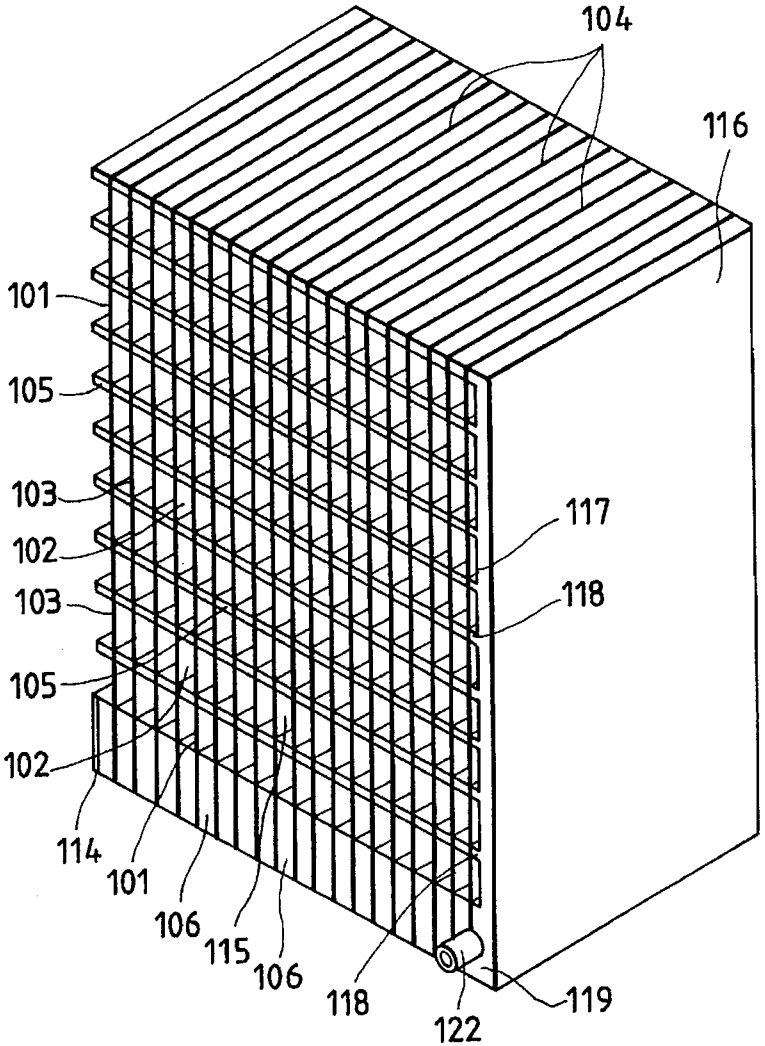
FIG. 31 is a perspective view of a humidifier according to the seventh embodiment of the present invention.

The water supply function members 116 are stacked and bonded, through the water supply section 119, onto one of the outermost moistening function members 101 at the water supply side in the sixth embodiment of the invention so that the water hole 110 of the outermost moistening function member 101 is aligned with the communicating hole 124 of the water supply section 119. The whole assembly including the water supply function members 116 thus laminated together with the moistening function members 101 is incorporated into the casing 112 as shown in FIG. 32 to complete the humidifier. As the pipe connection port 122 of the water supply function member 16 is, as shown in FIG. 31, positioned on the opening plane side of the air supply layer 102, the casing 112 is rendered to be 300 mm in height, 230 mm in width and 180 mm in length. Unlike the casing 112 in the sixth embodiment of the invention, any structure concerning water supply is unnecessary for the casing 112. The supply of water to each moistening function member 101 is made possible by connecting the water supply pipe 121 connected to the water supply source 120 to the pipe connection port 122 of the water supply function member 116 as shown in FIG. 32. The provision of the water supply function member 116 like this makes it possible to supply water even from a position different from that of the water supply hole 111 of the moistening function member 101. Even when a plurality of humidifier are set adjacent one another to provide a large-sized humidifier, the water supply pipe 121 is readily laid and besides the humidifier can be disposed in tight contact with each other. As other functions are similar to those referred to in the sixth embodiment of the invention, the detailed description thereof will be omitted.

A humidifier was constructed with 41 sheets of moistening function members 101 thus laminated up and, as shown in FIG. 32, supplied with water by connecting a water supply tank 125 connected to the water supply source 120 and the pipe connection port 122 of the water supply function member 116 together via the water supply pipe 121. Then each water guide component 104 was filled with water within 10 minutes even in the case of a water supply pressure of 0.05 kg/cm$^2$. When air having a temperature of 20° C. and a humidity of 50% was sent to the air supply layer 102 at a rate of 300 cubic meter/hour, a moistening quantity of 0.46 kg/hour was obtained, whereas static pressure loss was 2.1 mm in terms of water-gauge pressure.

Embodiment 8

FIGS. 33 through 39 inclusive, illustrate a humidifier according to an eighth embodiment of the invention in which an arrangement is made to supply water to each moistening function member 101 as well as to let air escape from the water guide component 104 of the humidifier in the above seventh embodiment of the invention. This humidifier is basically similar in construction to what has been introduced in the seventh embodiment of the invention except the provision of an air vent. Like reference characters designate like or corresponding component parts in the sixth and seventh embodiments of the invention and the detailed description thereof will be omitted accordingly.

For the moisture permeable films 108 constituting the envelope-like film member 109 in the eighth embodiment of the invention, there are used composite moisture permeable films each prepared by coating porous polytetrafluoroethylene sheets of 40μ thick with hydrophilic polyurethane resin. To both sides of the water guide member 107 formed of polyester unwoven fabric that has been cut rectangular and is 2 mm thick, the hydrophilic polyurethane sides of two sheets of moisture permeable films 108 having a plane area greater than that of the water guide member 107 are point-bonded, so that the water guide component 104 is formed as in the sixth embodiment of the invention. Like those in the sixth and seventh embodiments of the invention, the water guide component 104 in the eighth embodiment of the invention is also a rectangle having short sides 16 cm long and long sides 29.5 cm long. A water hole 110 about 15 mm in diameter is bored through the center of the water guide component 104, closer to the one of the short sides thereof, whereas another hole 126 of 10 mm in diameter, for example, is bored in the center close to the other short side thereof (see FIG. 33).

Rows of ribs 105 for defining the air supply layer 102 are each formed with thin pieces of vinyl chloride resin which are 3.3 mm long and 3 mm wide and rectangular in cross section. More specifically, eight thin resin pieces are placed every 25 mm intervals on one side of the water guide component 104 in parallel to each other along the short sides, the flank of each piece being bonded to the surface of the water guide component 104 with a polyurethane-based resin adhesive.

The water supply member 106 is a flat plate of vinyl chloride which is 16 cm long, 30 mm wide and 3.3 mm thick which corresponds to the height of the rib 105. The water supply hole 111 aligned with the water hole 110 of the water guide component 104 is bored through the center of the water supply member 106. The water supply member 106 is also bonded with the polyurethane resin adhesive, in parallel to the rib 105, along one of the short sides of the water guide component 104, onto the same plane of the water guide component 104 where the ribs 5 are provided, so that the water hole 110 and the water supply hole 111 are aligned with each other.

Figure 35:
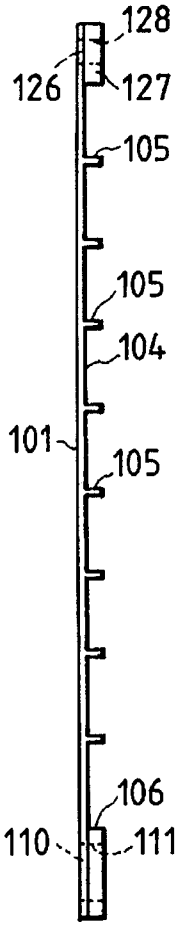
FIG. 35 is a side view of the moistening function member according to the eighth embodiment of the present invention.
Figure 34:
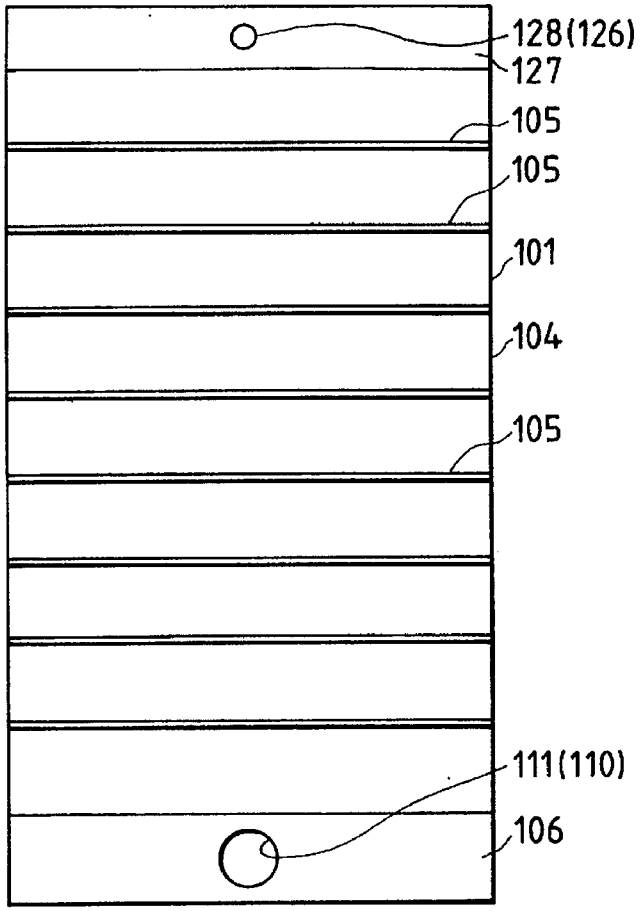
FIG. 34 is an elevational view of a moistening function member according to the eighth embodiment of the present invention.
Figure 33:
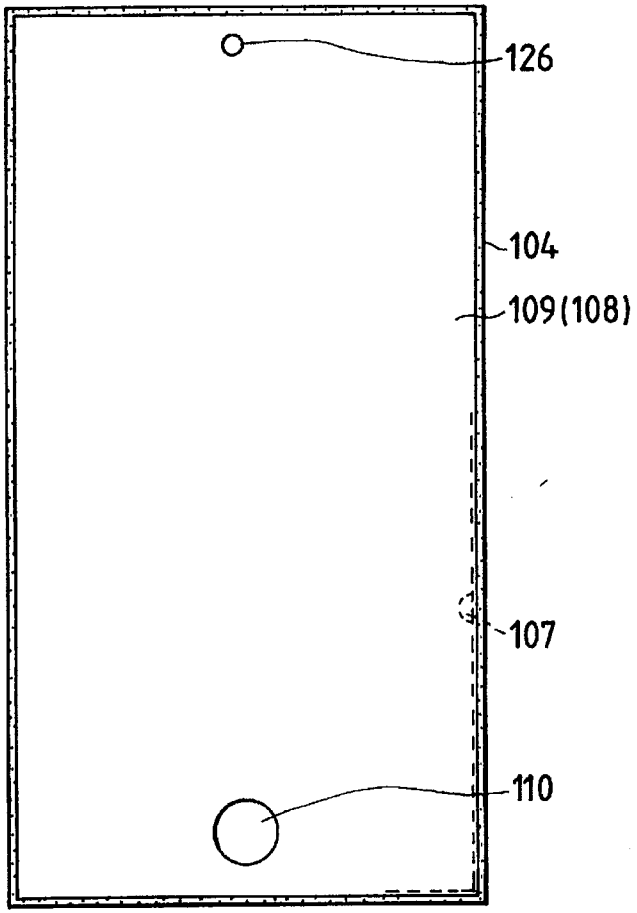
FIG. 33 is an elevational view of a water guide component according to an eighth embodiment of the present invention.

In addition to the water supply member 106, an air vent member 127 in the form of a vinyl chloride flat plate of 16 cm long, 20 mm wide and 3.3 mm thick which corresponds to the height of the rib 105 is bonded to the water guide component 104 as shown in FIGS. 34, 35. An air vent hole 128 to be aligned with the punched hole 126 of the water guide component 104 is opened in the center of the air vent member 127, which is bonded with the polyurethane resin adhesive, in parallel to the rib 105, along the other short side of the water guide component 104, onto the same plane of the water guide component 104 where the ribs 105 are provided, so that the punched hole 126 and the air vent hole 128 are aligned with each other.

The plurality of moistening function members 101, each of which has the ribs 105, the water supply member 106 and the air vent member 127 with the water guide component 104, are laminated by matching the water supply member side and the air vent member side and preventing the ribs 105 from facing one another, and then the whole assembly is incorporated into the casing 112 to form the humidifier. The moistening function members 101 thus laminated up are integrated in such a manner that one side of each water supply member 106 and the surface of the water guide component 104 of the adjacent moistening function member 101 where the water supply member 106 is not provided are bonded together to ensure watertightness and that the air vent member 27 is bonded thereto likewise. The water hole 110 and the punched hole 126 in the outermost layer of the moistening function member 101 are closed with the blind plate 114 in the eighth embodiment of the invention.

Figure 37:
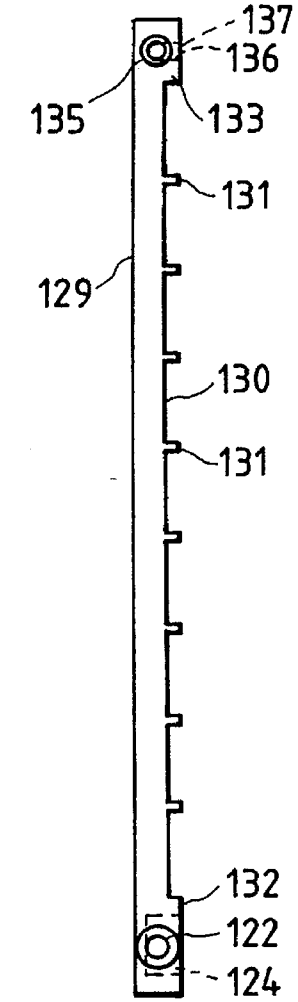
FIG. 37 is a side view of the functional member of exclusive use for supplying water and venting air according to the eighth embodiment of the present invention.
Figure 36:
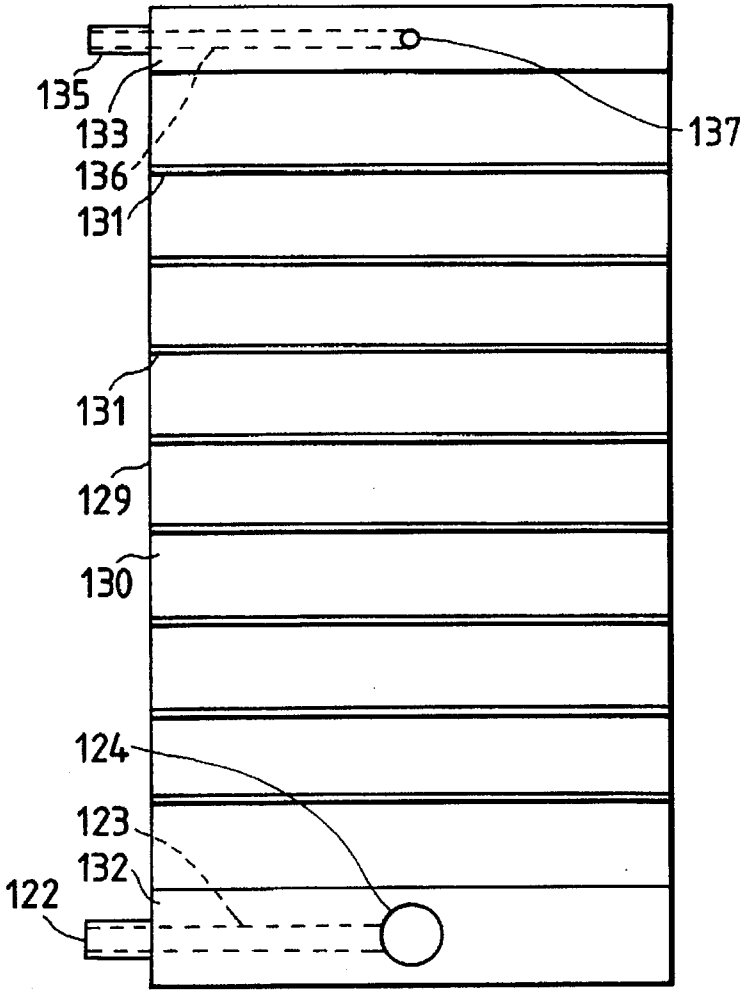
FIG. 36 is an elevational view of a functional member of exclusive use for supplying water and venting air according to the eighth embodiment of the present invention.
Figure 39:
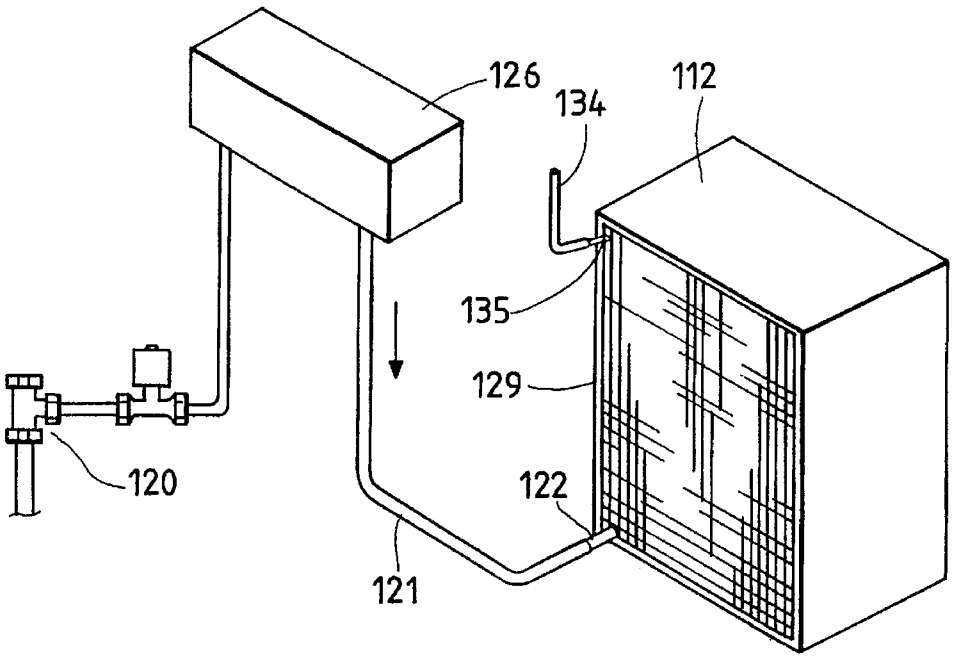
FIG. 39 is a perspective of the humidifier in a functional mode according to the eighth embodiment of the present invention.
Figure 38:
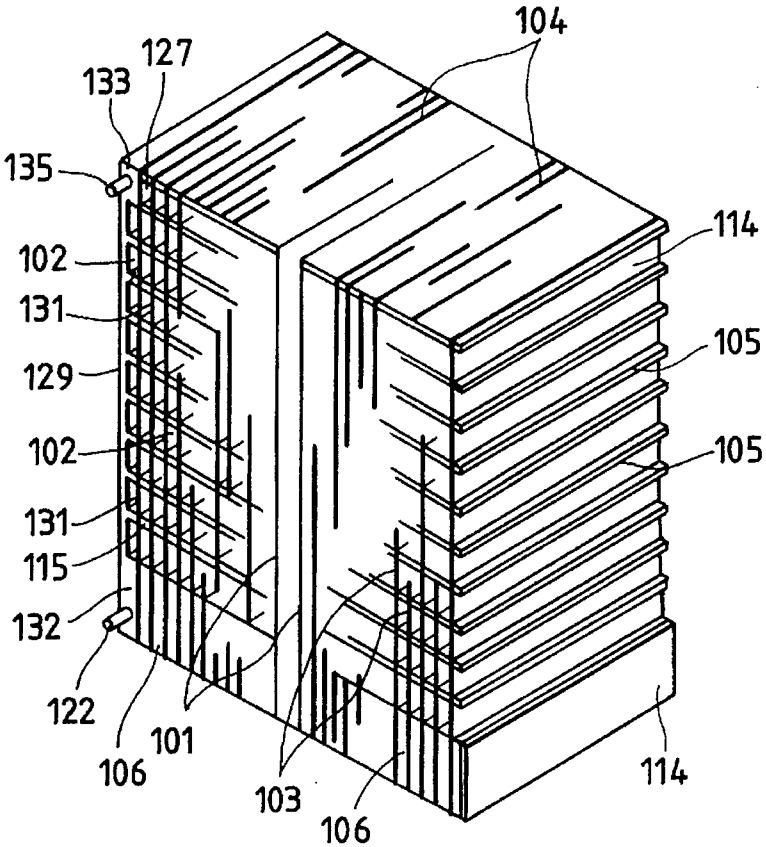
FIG. 38 is a perspective of a humidifier according to the eighth embodiment of the present invention.

The humidifier in the eighth embodiment of the invention is also provided with a water supply and air vent function member 129, which is constructed by adding the air vent structure to the water supply function member 116 of the seventh embodiment of the invention, in the same way the water supply function member 116 is included in the seventh embodiment of the invention. More specifically, the water supply and air vent function member 129 is, as shown in FIGS. 36, 37, integrally molded of ABS resin into the same external contour as that of the moistening function member 101. Ribs 131 similar to the ribs 105 of the moistening function member 101, a water supply section 132 equivalent to the water supply member 106, and an air vent section 133 located opposite to the water supply section 132 are integrally protruded from one side of a flat plate section 130 having the same plane area as that of the moistening function member 101. The water supply section 132 is similar in construction to the water supply function member 116 of the seventh embodiment of the invention, and the air vent section 133 is provided with a connection port 135 on one side for connection to an air vent pipe 134 (FIG. 39). A discharge channel 136 communicating with the connection port 122 is formed in the air vent section 133, and one end of the. discharge channel 136 is connected with an air vent hole 137 bored in the center of the air vent section 133. The air vent hole 137 is formed in a position matching the punched hole 126 opened in the water guide component 104 of the moistening function member 101. The connection port 135 and the discharge channel 136 may also be replaced with a pipe inserted therein, the pipe being allowed to communicate with the air vent pipe 134. The remainder is similar to what has been illustrated in the seventh embodiment of the invention.

The whole assembly (FIG. 38) including the stacked moistening function members 101 with the water supply and air vent function member 129 is incorporated into the casing 112, as shown FIG. 39, as similarly to the seventh embodiment of the invention to form the humidifier. The pipe connection port 122 and the connection port 135 of the water supply and air vent function member 129 are, as shown in FIG. 39, located on the side of openings of the air supply layer 102. When the water supply tank 125 communicating with the water supply source 120 and the pipe connection port 122 of the water supply and air vent function member 129 are connected via the water supply pipe 121 as shown in FIG. 39, water is supplied to each water guide component 104 as similarly to the seventh embodiment of the invention. While water is being supplied, air trapped in each water guide component 104 escapes from the air vent hole 137 of the air vent section 133 located opposite to the water supply side and is collectively discharged by the air vent pipe 134 from the connection port 135 via the discharge channel 136 of the water supply and air vent function member 129. Even though the moisture permeable film 108 is made of material not or hardly permeable to air, water is smoothly supplied to each moistening function member 101 by this air vent arrangement.

A humidifier in the eighth embodiment of the invention was constructed with 42 sheets of moistening function members 101 laid over one another, and it was supplied with water from the water supply tank 125 as similarly to the seventh embodiment of the invention and as shown in FIG. 39. Each water guide component 104 was filled with water within 10 minutes even in the case of a water supply pressure of 0.05 kg/cm$^2$. When air having a temperature of 20° C. and a humidity of 50% was sent to the air supply layer at a rate of 300 cubic meter/hour, a moistening quantity of 0.46 kg/hour was obtained, whereas static pressure loss was 2.1 mm in terms of water-gauge pressure. When water was supplied while the air vent pipe 134 was closed, moreover, each water guide component 104 was filled with water 24 hours later even at a water supply pressure of 0.5 kg/cm$^2$.

Embodiment 9

Figure 41:
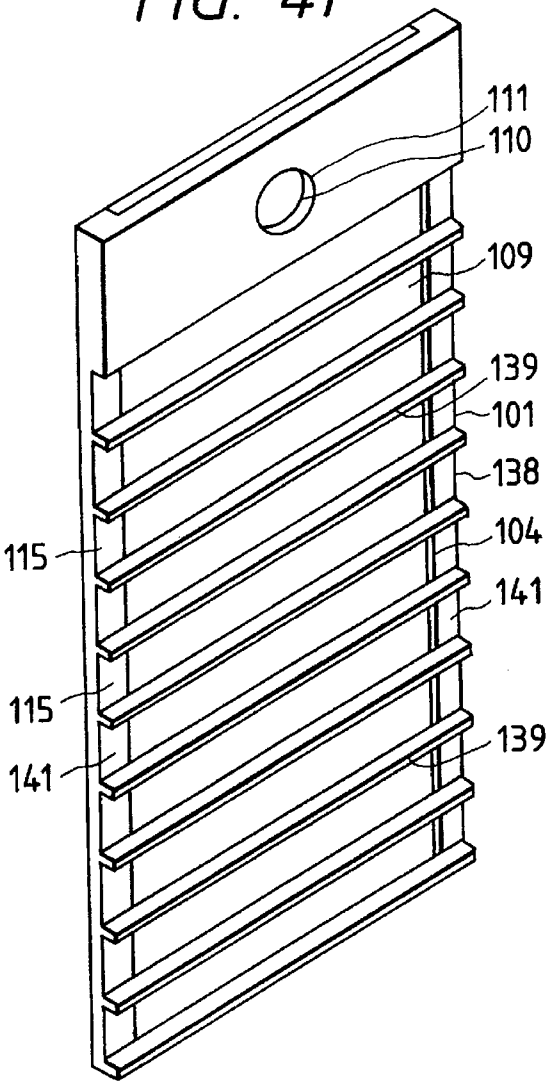
FIG. 41 is a perspective view of the moistening function member according to the ninth embodiment of the present invention.

FIGS. 40 through 44 inclusive, illustrate a humidifier according to a ninth embodiment of the invention in which the water supply member 106 and the rib 105 in the humidifier in the sixth embodiment of the invention are integrally molded as a plastic frame 38 as shown in FIG. 41. The other arrangements are basically similar to those in the sixth and seventh embodiments of the invention, so that like reference characters designate like or corresponding component parts in the sixth and seventh embodiments of the invention and the detailed description thereof will be omitted accordingly.

Figure 40:
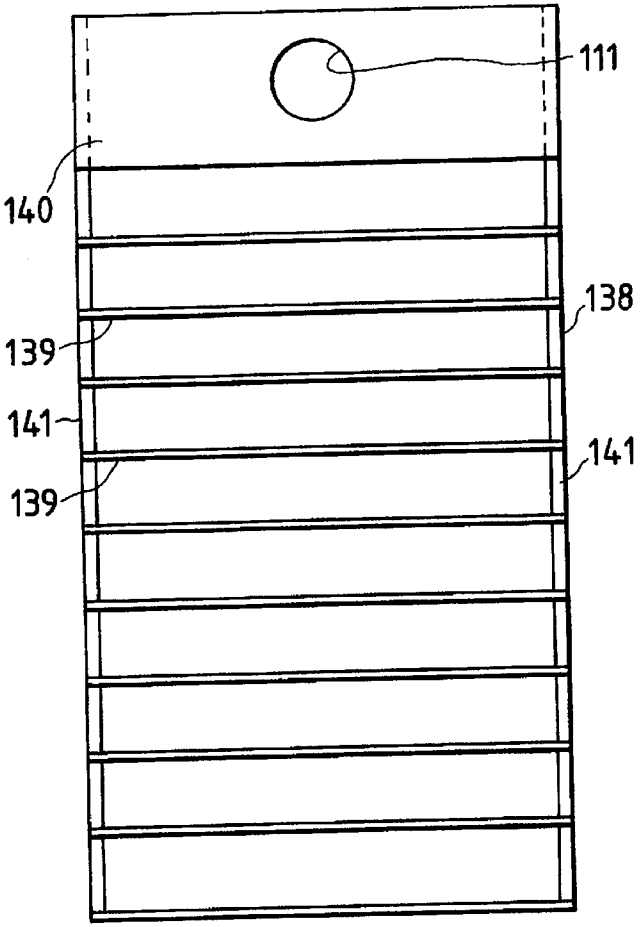
FIG. 40 is an elevational view of a plastic frame of a humidifier according to a ninth embodiment of the present invention.

The water guide component 104 in the ninth embodiment of the invention is similar to what has been illustrated in the sixth embodiment of the invention except that the envelope-like film member 109 is 30μ thick. The plastic frame 138 forming the air channel 115 and the water supply section of the moistening function member 101 is integrally molded of ABS resin and formed into such a ladder-like configuration that coupling ribs 139 and a water supply section 140, which correspond to the ribs 105 and the water supply member 106 in the sixth embodiment, connected together at both ends with coupling structures 141 as shown in FIG. 40. The plastic frame 138 is bonded to one side of the water guide component 104 with a polyurethane-based adhesive as similarly to the first embodiment of the invention. As shown in FIG. 41, the water guide component 104 is fitted in between the coupling structures 141 of the plastic frame 138 and bonded thereto.

Figure 43:
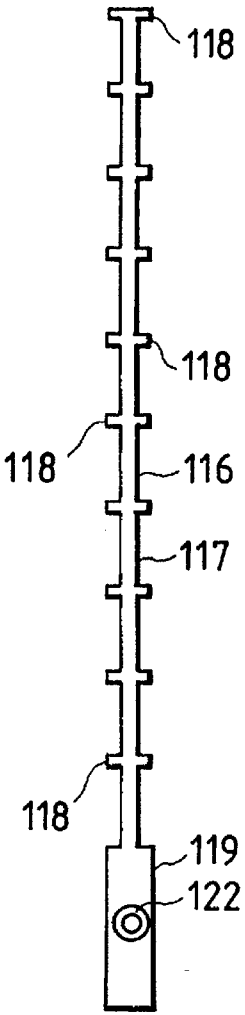
FIG. 43 is a side view of the functional member of exclusive use for supplying water according to the ninth embodiment of the present invention.
Figure 42:
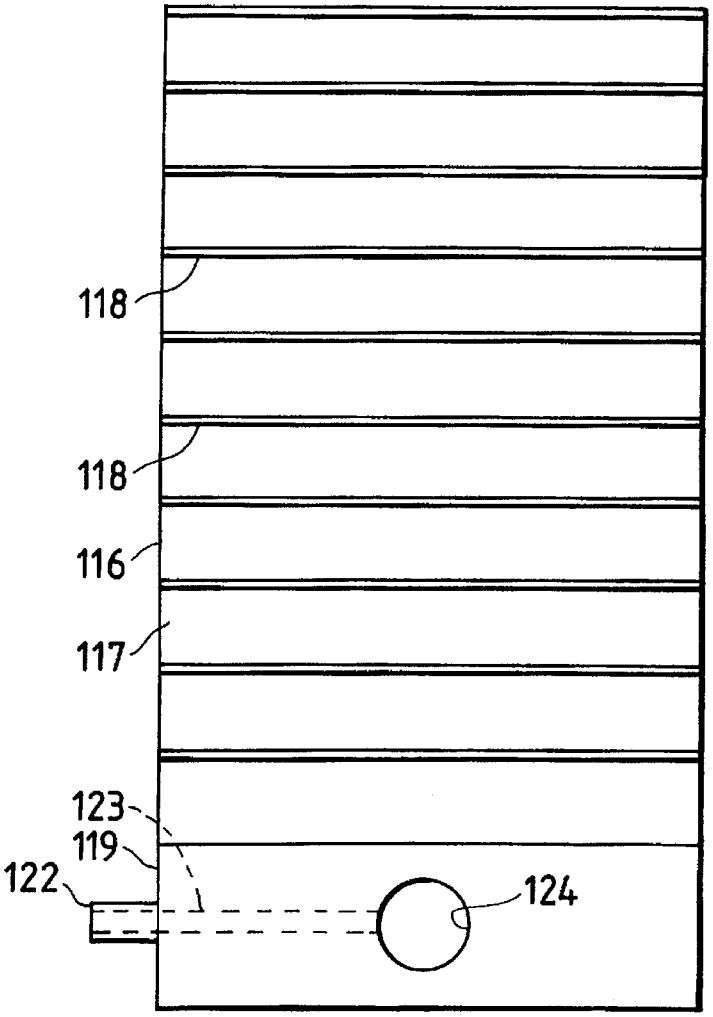
FIG. 42 is an elevational view of the functional member of exclusive use for supplying water according to the ninth embodiment of the present invention.

One of the water retention layers 103 which the water guide components 104 form is joined to the water supply function member 116 of the same construction as that of the seventh embodiment of the invention. Although the water supply function member 116 may be made similar in construction to what has been illustrated in the seventh embodiment, it is still formed so as to have a water supply section in the intermediate layer of FIG. 44 in the ninth embodiment of the invention. That is, as shown in FIGS. 42, 43, the water supply function member 116 is integrally molded of ABS resin into substantially the same outer contour as that of the moistening function member 101. From both sides of the flat plate section 117 which has the same plane area as that of the moistening function member 101 and is 1.5 mm thick, the ribs 118 which are 3.3 mm thick, that is, as thick as the ribs 139 of the moistening function member 101 and the water supply section 119 which corresponds to the water supply member 106 and has the same height as that of the ribs 139 are integrally protruded. The water supply section 119 is provided with the pipe connection port 122 on its one side and supplied with water from a water supply source via a water supply pipe. Moreover, the water conduit 123 communicating with the pipe connection port 122 is formed in the water supply section 119, and one end of the water conduit 123 communicates with the communicating hole 124 bored in the center of the water supply section 119. The communicating hole 124 of the water supply section 119 is so position as to be aligned with the water hole 110 bored in the water guide component 104 of the moistening function member 101.

Figure 44:
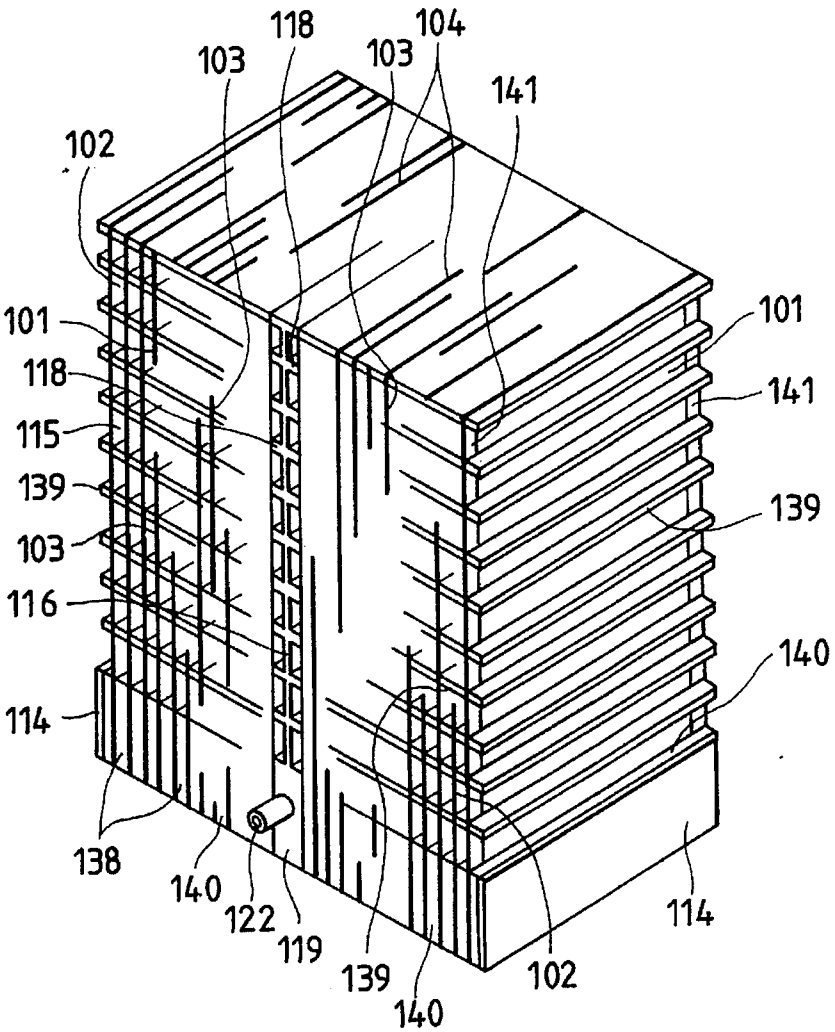
FIG. 44 is a perspective view of a humidifier according to the ninth embodiment of the present invention.

The water supply function member 116 thus constructed is held between any given moistening function members 101, and by bonding the water supply function members 16 to the respective laminated moistening function members as in the seventh embodiment of the invention, the humidifier is completed as shown in FIG. 44. Since the water supply function member 16 in the ninth embodiment of the invention is situated in the intermediate layer, the water holes 110 in the outermost two moistening function members 101 are closed with the blind plate 114. The remainder is basically similar in construction to those in the sixth and seventh embodiments of the invention.

The water supply section of the humidifier in the ninth embodiment of the invention can be placed in any desired layer-to-layer position, whereby piping and the water supply position for water supplying purposes may be set more freely. The remainder is basically similar in construction to those in the first and second practice of the invention and the detailed description thereof will be omitted accordingly.

The humidifier thus constructed was built with 42 sheets of moistening function members 101 laminated before being framed into a casing of 300 mm in height, 230 mm in width and 180 mm in length as in the seventh embodiment of the invention. Then the humidifier was supplied with water by connecting the water supply tank connected to the water supply source and the pipe connection port 122 of the water supply function member 116 together via the water supply pipe. Then each water guide component 104 was filled with water within 10 minutes even in the case of a water supply pressure of 0.05 kg/cm$^2$. When air having a temperature of 20° C. and a humidity of 50% was sent to the air supply layer 102 at a rate of 300 cubic meter/hour, a moistening quantity of 0.51 kg/hour was obtained, whereas static pressure loss was 2.1 mm in terms of water-gauge pressure.

Embodiment 10

A humidifier according to a tenth embodiment of the invention is basically similar in construction to what has been illustrated in the ninth embodiment of the invention. Like reference characters designate like or corresponding component parts in the ninth embodiment of the invention and the detailed description thereof will be omitted accordingly.

Figure 45:
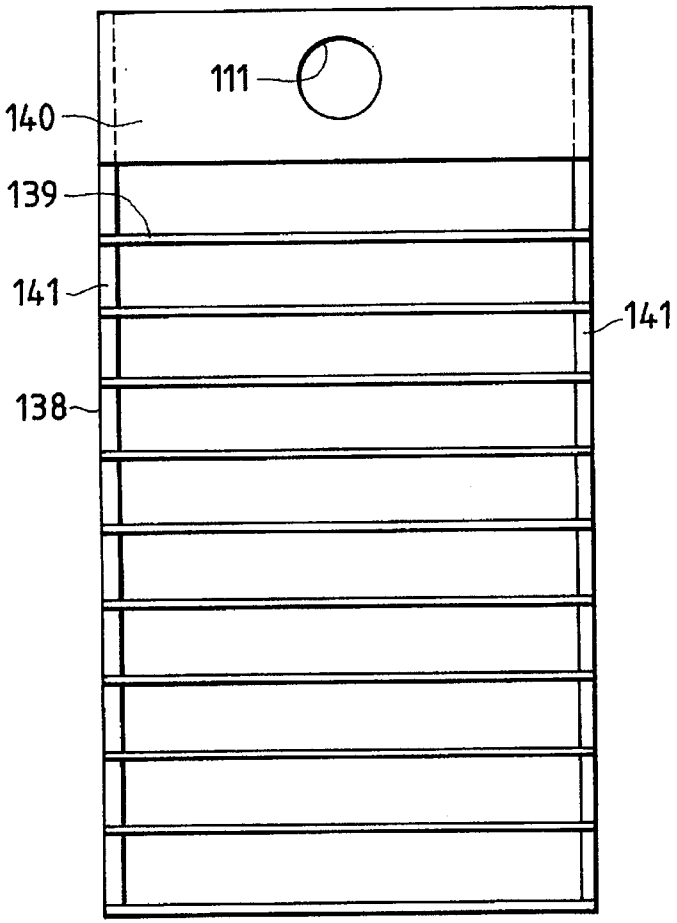
FIG. 45 is an elevational view of a plastic frame of a humidifier according to a tenth embodiment of the present invention.

In the tenth embodiment of the invention, a polyester unwoven fabric 2 mm thick is used to form the water guide member 107, whereas a porous polytetrafluoroethylene sheet is used to form the moisture permeable films 108, so that the water guide member 107 of FIG. 26 in the sixth embodiment of the invention is made. As shown in FIG. 45, the plastic frame 138 forming the water supply section and the air channel 115 of the moistening function member 101 is made of ABS resin by monolithic molding and formed by coupling the ribs 139 which is 2.2 mm high corresponding to the ribs 105 and the water supply section 140 corresponding to the water supply member 106 in the sixth embodiment of the invention with coupling structures 141 on both sides like a ladder. The plastic frame 138 is bonded to one side of the water guide component 104 with a polyurethane-based adhesive as in the ninth embodiment of the invention. The water guide component 104 is fitted in between the coupling structures 141 of the plastic frame 138 and bonded thereto.

Figure 47:
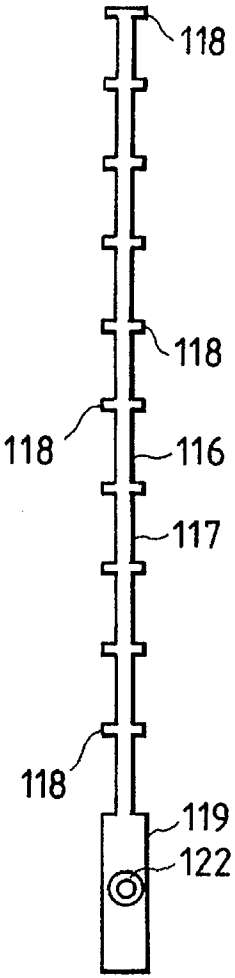
FIG. 47 is a side view of the functional member of exclusive use for supplying water according to the tenth embodiment of the present invention.
Figure 46:
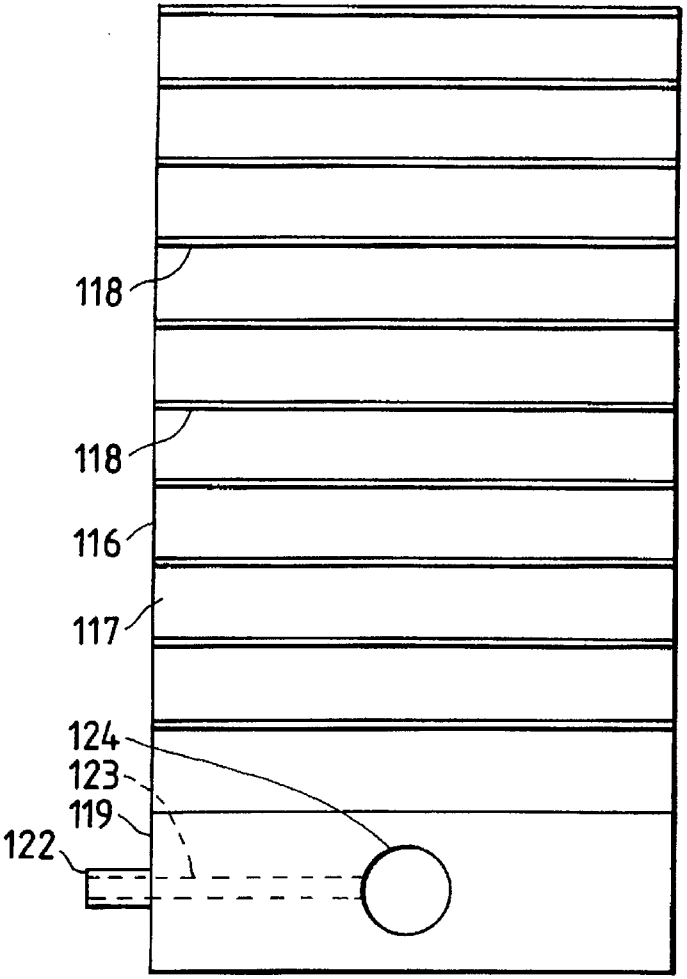
FIG. 46 is an elevational view of a functional member of exclusive use for supplying water according to the tenth embodiment of the present invention.
Figure 49:
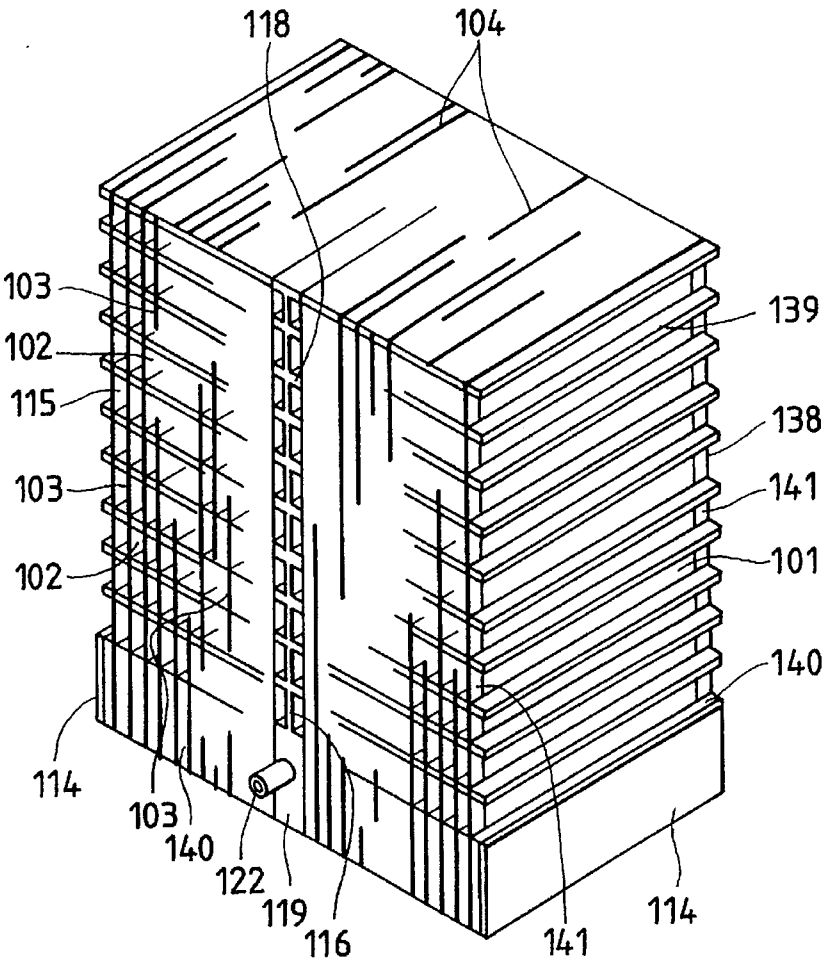
FIG. 49 is a perspective view of a humidifier according to an eleventh embodiment of the present invention.
Figure 48:
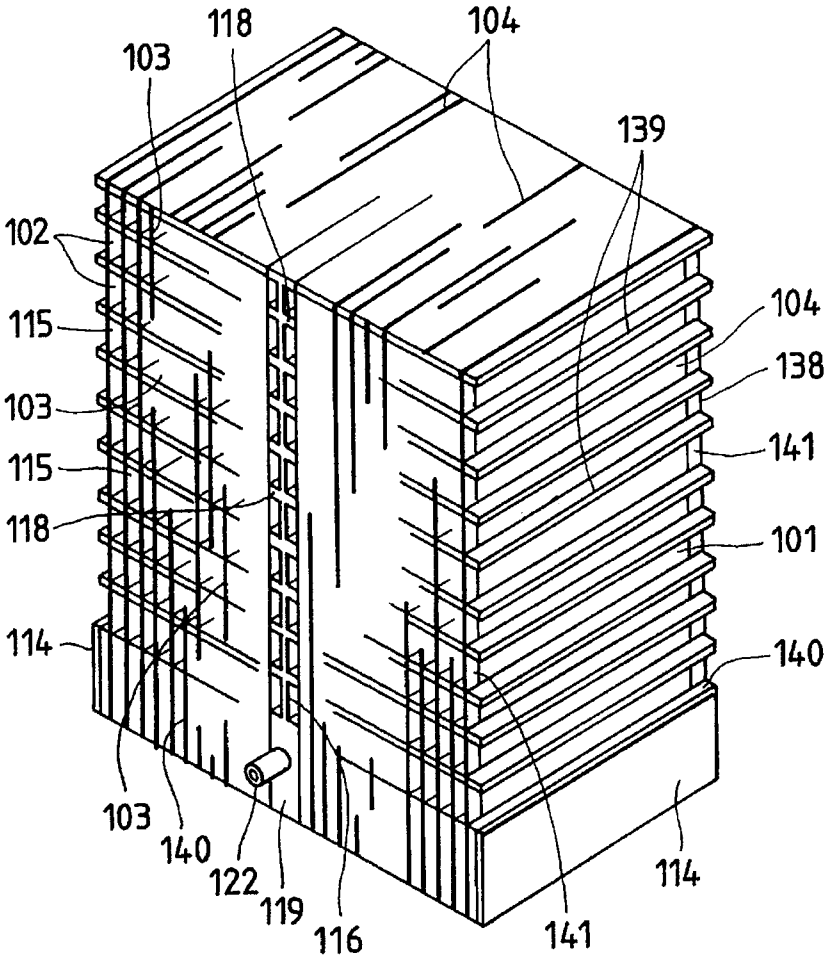
FIG. 48 is a perspective view of a humidifier according to the tenth embodiment of the present invention.

As shown in FIGS. 46, 47, one of the water retention layers 103 which the water guide components 104 form is joined to the water supply function member 116 as in the ninth embodiment of the invention. The water supply function member 116 is similar in construction to what has been illustrated in the ninth embodiment of the invention and as shown in FIG. 48, it is formed so as to have a water supply section in the intermediate layer. More specifically, the water supply function member 116 is made of ABS resin by monolithic molding and its external shape is homologous with the moistening function member 101. From both sides of the flat plate section 117 which has the same plane area as that of the moistening function member 101, the ribs 118 which are 2.6 mm thick, that is, lower than the ribs 139 of the moistening function member 101 and the water supply section 119 which is 10 mm thick corresponds to the water supply member 106 are integrally protruded. The remainder is similar in construction to that in the ninth embodiment of the invention.

The humidifier thus constructed was built with 48 sheets of moistening function members 101 laminated before being framed into a casing of 300 mm in height, 230 mm in width and 180 mm in length as in the seventh embodiment of the invention. Then the humidifier was supplied with water by connecting the water supply tank connected to the water supply source and the pipe connection port 122 of the water supply function member 116 together via the water supply pipe. Then each water guide component 104 was filled with water within 10 minutes even in the case of a water supply pressure of 0.05 kg/cm$^2$. When air having a temperature of 20° C. and a humidity of 50% was sent to the air supply layer 102 at a rate of 300 cubic meter/hour, a moistening quantity of 0.63 kg/hour was obtained, whereas static pressure loss was 3.4 mm in terms of water-gauge pressure.

Embodiment 11

A humidifier in an eleventh embodiment of the invention is built by laminating 21 sheets of the moistening function members 101 of the humidifier in the tenth embodiment of the invention on both sides of the water supply function member 16 and the remainder is similar in construction to what has been illustrated in the tenth. embodiment of the invention. Like reference characters designate like or corresponding component parts in the fourth practice of the invention and the detailed description thereof will be omitted accordingly.

The humidifier thus constructed was incorporated into a casing of 300 mm in height, 200 mm in width and 180 mm in length as in the seventh embodiment of the invention. Then the humidifier was supplied with water by connecting the water supply tank connected to the water supply source and the pipe connection port 122 of the water supply function member 116 together via the water supply pipe. Then each water guide component 104 was filled with water within 10 minutes even in the case of a water supply pressure of 0.05 kg/cm$^2$. When air having a temperature of 20° C. and a humidity of 50% was sent to the air supply layer 102 at a rate of 300 cubic meter/hour, a moistening quantity of 0.58 kg/hour was obtained, whereas static pressure loss was 3.9 mm in terms of water-gauge pressure.

Figures 50, 51:
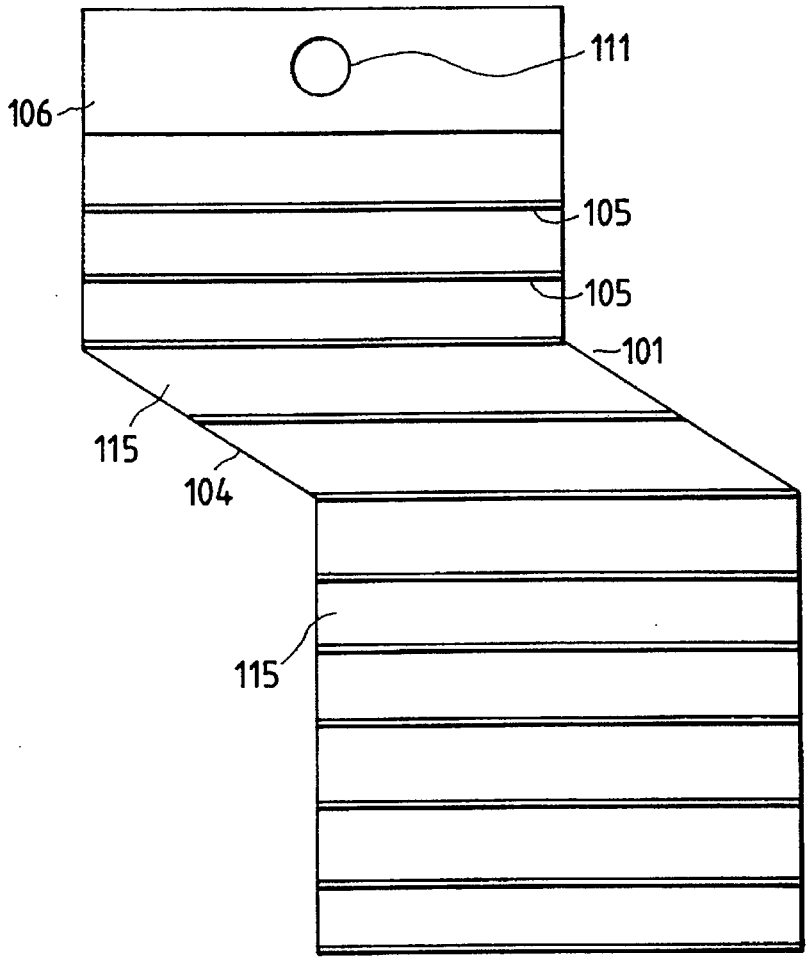
FIG. 50 is a perspective view of a moistening function member in another mode according to the present invention.
FIG. 51 is a table illustrating test results according to the present invention.

The moistening function members in the sixth to eleventh embodiment of the invention are generally planar and rectangular in shape. However, they may be shaped differently; namely, bent as shown in FIG. 50. Although the use of conventional corrugated spacer plates inevitably renders the side view of the apparatus rectangular or square in view of poor yields, the moistening function member 101 illustrated in the embodiments of the invention above may be formed in a shape other than a rectangle or a square. Consequently, it is possible to flexibly deal with the shape and size of a casing in accordance with not only equipment to be incorporated in humidifier but also an incorporating space.

As far as the cross section of the rib 105, 139 for use is concerned, it may be not only rectangular but also, for example, circular with the diameter as a height, semicylindrical with a planar base and a semicircular upper portion or trapezoidal as occasion demands.

The moisture permeable film 108 may be what is known as a moisture permeable film on condition that it allows no water but water vapor to permeate therethrough and it may be a porous polyethylene or polypropylene film, or an unwoven fabric with which a thin film of ion exchange resin, for example, is combined other than the materials referred to in the above embodiments of the present invention. In addition, use may be made of a composite moisture permeable film prepared by combining a woven fabric or knit (knitted cloth) or the like with a thin moisture permeable film of polytetrafluoroethylene.

As the water guide member 107 made of sheet-like porous material, it is advantageous to use such an unwoven fabric as is readily available and inexpensive. Notwithstanding, knit (knitted cloth) composed of fibers looped in the direction of its thickness, cloth material such as a three-dimensional woven fabric, a sintered resin composed of resin particles fusion bonded with spaces left among them (Brand Name: Ever-Right Scot, Bridgestone Corporation) or a sheet-like porous material made of porous foamed metal (foamed nickel or the like) may also be applicable to the present invention.

With respect to the method of sealing the outer peripheral portions of the moisture permeable films 108, use may widely be made of existing sealing methods such as heat fusion bonding, ultrasonic fusion bonding, sheet material impregnation and the like in addition to a bonding adhesive.

Although vinyl chloride in wide use for water pipes and water tanks is fit for use as a material in the rib 105 and the plastic frame 138 or the water supply member 106, polypropylene and polyethylene resin may also be employed. With importance attached to formability, moreover, selection may be made of polystyrene or ABS resin; with importance attached to flexibility, nylon or urethane resin; with importance attached to flexibility and adhesion, ethylene-vinyl acetate copolymer (EVA) or ethylene-ethyl acrylate copolymer (EEA); and with importance attached to strength, epoxy resin, for the rib 105, the water supply member 106 and the like, that is, selection may be made of the most suitable in connection with the water guide component 104.

Regarding the bonding adhesive, not only an urethane adhesive but also what has adhesive properties agreeable to the materials of the rib 105, the plastic frame 138 and water supply member 106, and that of the moisture permeable films 108 may properly be selected.

In any embodiment of the invention above, the smaller the number of ribs 105, 139 of the moistening function member 101 is, the greater the moistening quantity becomes. Moreover, the wider the space between the ribs 105, 139 is set, the smaller the static pressure loss is incurred. FIG. 51 shows a table of results of tests made to confirm the aforementioned fact in concrete terms.

Figure 53:
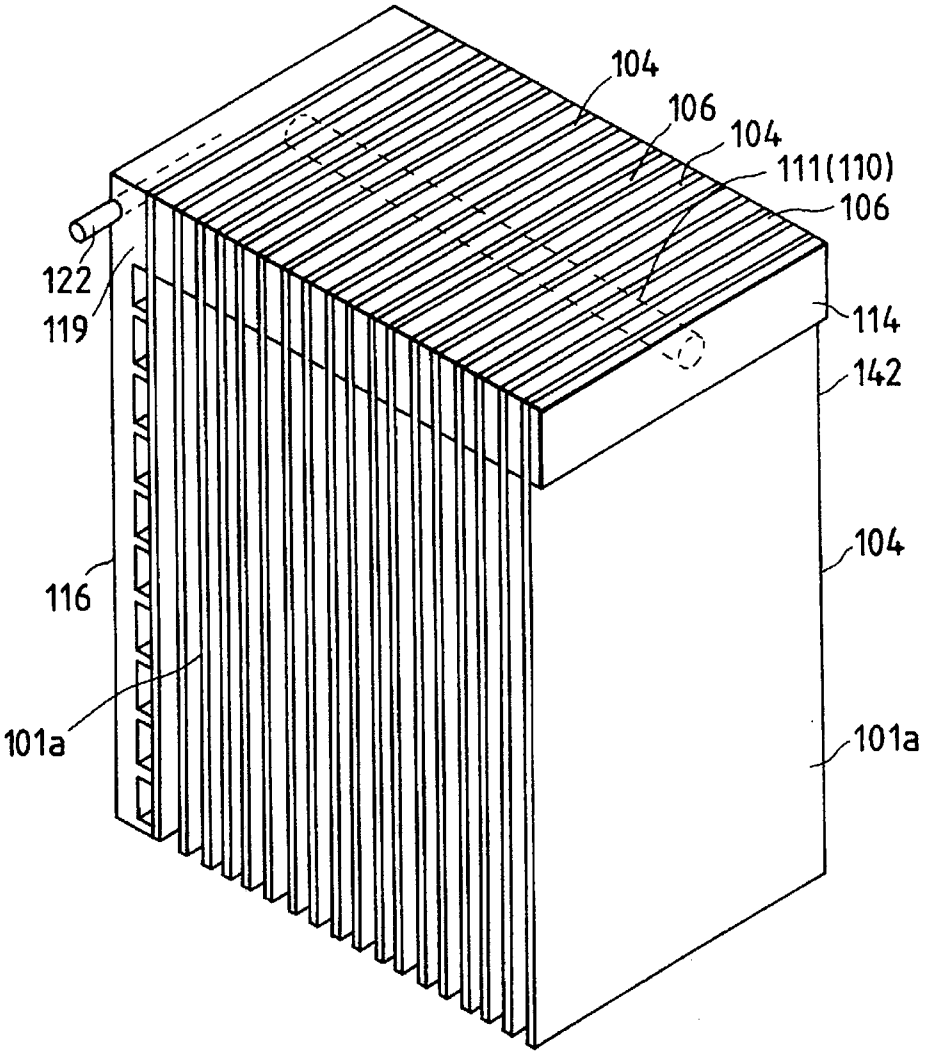
FIG. 53 is a perspective view of a basic unit used in the test.
Figures 54, 55:
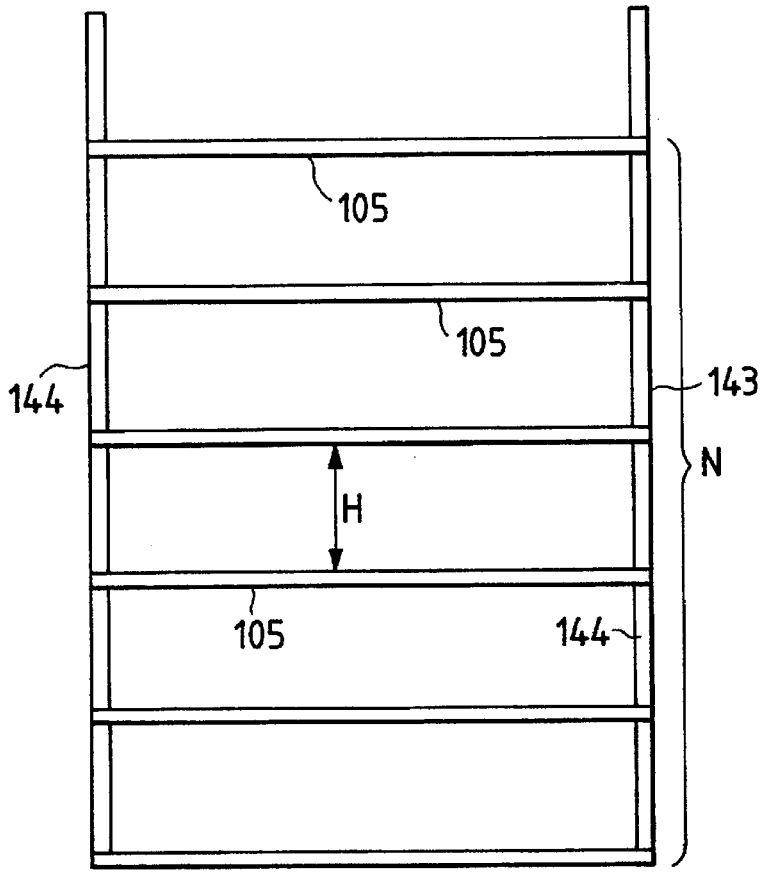
FIG. 54 is an elevational view of the rib frame used for testing the present invention.
FIG. 55 is a table showing details of rib frames used in the test.

More specifically, the tests were conducted using a basic unit 42 as shown in FIG. 53 which was substantially similar in construction to the humidifier illustrated as the seventh embodiment of the invention. The basic unit 42 was obtained by laminating moistening function members 101*a* having no ribs 105 (FIG. 52) in such a manner that the water supply members 106 are stacked, and several kinds of rib frames 143 so arranged as shown in FIG. 54 were each held between the water guide components 104 of the basic unit 142 so as to measure the moistening quantity and the static pressure loss.

Figure 52:
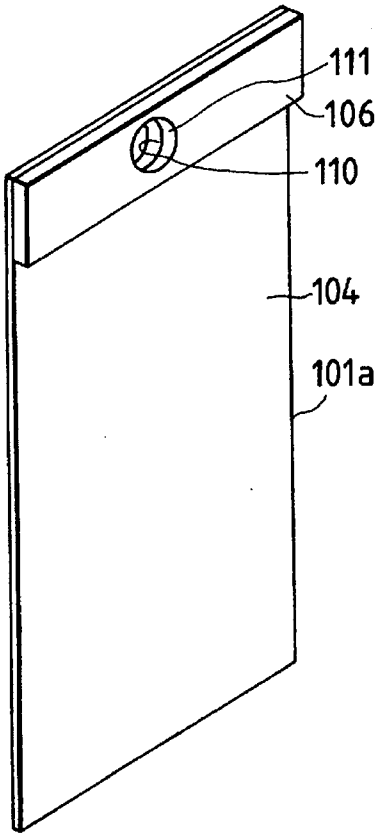
FIG. 52 is a perspective view of a moistening function member prepared for a test.

The moistening function members 101*a* constituting the basic unit 142 were each formed without the ribs 105 of the moistening function members 101 in the seventh embodiment of the invention as shown in FIG. 52. The dimensions and shape of the water guide component 104 were set similar to those in the seventh embodiment of the invention, and 42 sheets of moistening function members were laminated. The water supply function member 116 formed by monolithic molding with ABS resin shown in the seventh embodiment of the invention was coupled to one of the outermost moistening function members 101*a* (FIG. 53). Both ends of the 3.3 mm-high ribs 105 were coupled together with coupling structures 144 to form the ladder-like rib frame 143 first and the rib frame 143 was held between the moistening function members 101*a* of the basic unit 142 thus constructed as shown in FIG. 54. Then the whole assembly was incorporated into a casing, and water was supplied to each water guide component 104, whereas air having a temperature of 20° C. and a humidity of 50% was sent to the air supply layer 102 at a rate of 300 cubic meter/hour. Five kinds of rib frames 143 (A, B, C, D, E) different in the number N of ribs 105 and the space H between the ribs 105 were used to measure the moistening quantity and the static pressure loss of each rib frame 143 under the conditions above. A table of FIG. 51 shows the results of measurement. The results of measurement revealed that the moistening quantity became large in numerical value and the static pressure loss became small in numerical value as the number N of ribs 105 decreased in numerical value and as the space H increased in numerical value.

Figure 56:
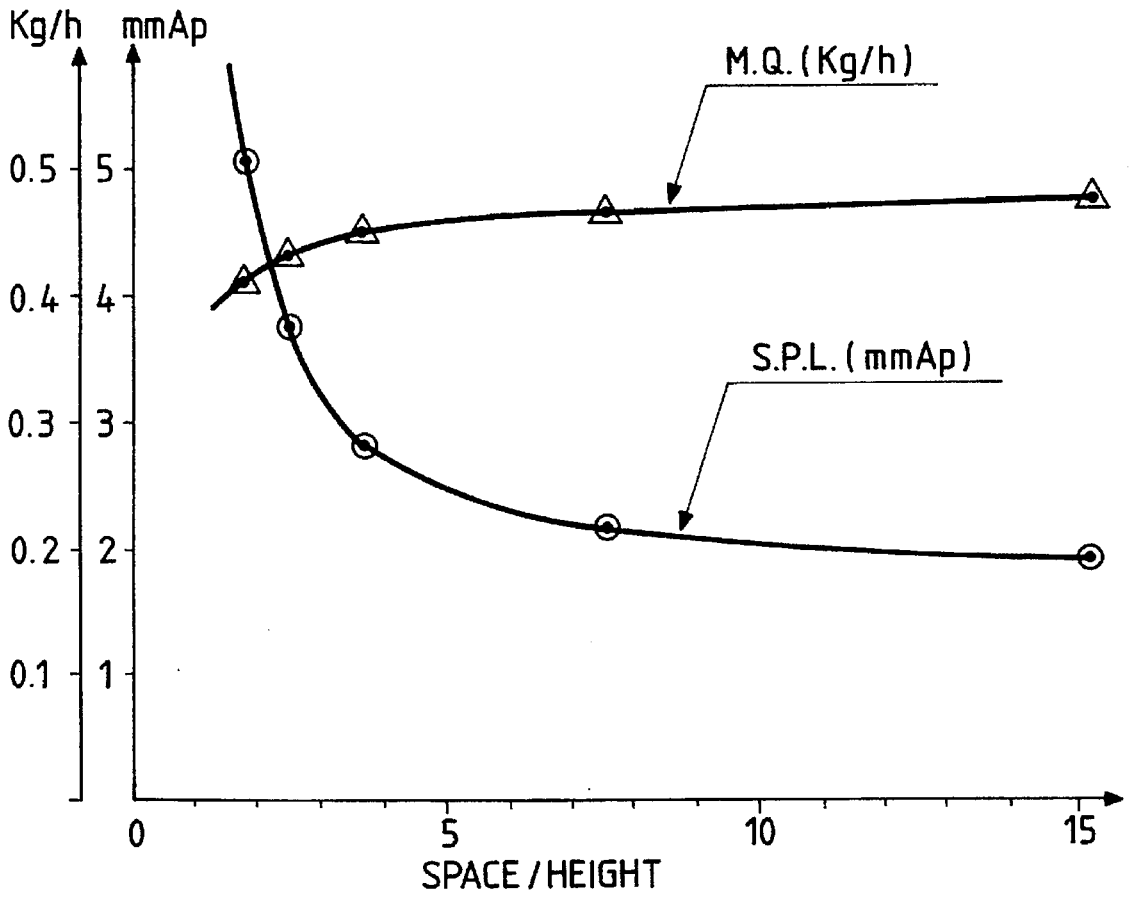
FIG. 56 is a graphic representation illustrating characteristics of rib in reference to ratio of its height to space according to the present invention.

The ratio of the height of the rib 105 to the space therebetween and the relation between the moistening quantity and the static pressure loss are as shown in FIG. 56. It is therefore confirmable that the static pressure loss sharply rises and the moistening performance lowers when the ratio of the height of the rib to the space therebetween is 3 or less. In the combination of the basic unit 142 and the rib frames 143, the dimension between the water guide components 104 in the mid-portion between the ribs 105 tends to become unstable as the space between the ribs 105 in comparison with the height of the rib 105 is large. While water is being supplied, the water guide components 104 come in contact with each other and become deflected. The performance is thus rendered unstable.

Therefore, the ratio of the height of the rib 105 to the space therebetween should preferably be 3 or greater and when the water guide member 107 is made of flexible material such as an unwoven fabric, an upper limit ratio is about 15. When the water guide member 107 is as thin as 2 mm thick or less, the upper limit ratio between the height of the rib 105 and the space therebetween is about 30.

Further, the following comparative examples of humidifier were manufactured to make comparative tests so as to make clear the performance and characteristics of the humidifier in the above embodiments of the invention.

COMPARATIVE EXAMPLE 3

One side of a porous polytetrafluoroethylene sheet was coated with hydrophilic polyurethane resin, and reinforcing cloth highly permeable to air was bonded onto the other side thereof to produce a composite material (Brand Name: Goatex In the Second Generation, Japan Goatex Co.), which was used as a moisture permeable film for a humidifier of the natural evaporation type.

Figure 57:
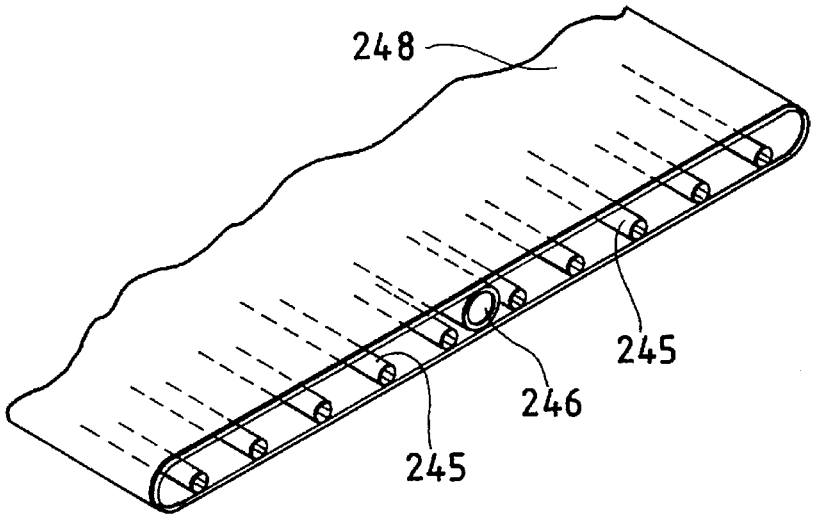
FIG. 57 is a perspective view of the principal part of Comparative Example 3 used in a test for verifying the performance and characteristics of the embodiments of the present invention.

Ten pieces of vinyl-chloride ribs 245 having a diameter of 2 mm were bonded substantially every 20 mm onto half the hydrophilic-polyurethane-coated side of a moisture permeable film 40 cm wide and 10 m long with a polyurethane bonding adhesive as shown in FIG. 57. The moisture permeable film was folded in two and then it was formed into a tube by sticking the end portions together. Further, a pipe-like porous member 246 which allowed no water but air and had a length of 10 m and an inner diameter of 3 mm was inserted into the tube. A water supply port 247 was provided at the one end and the remainder was closed to form an envelope so as to produce the tubular film member 248. The corrugated spacer plate 249 and the tubular film member 148 each having a length of 10 m were stacked spirally in such a manner that one side onto which the ribs 245 of the tubular film member 248 had been bonded and the spacer plate 249 were located inside. A humidifier of the sort shown in FIG. 60 was prepared as the comparative example 3.

The humidifier was incorporated in a casing whose external dimensions were 300 mm in height, 230 mm in width and 200 mm in length before being supplied with water from a water supply tank. In a case where water supply pressure was 0.05 kg/cm$^2$, it took 30 minutes to fill up the apparatus with water. When air having a temperature of 20° C. and a humidity of 50% was sent in at a rate of 300 cubic meter/hour, moreover, a moistening quantity of 0.45 kg/hour was obtained, whereas static pressure loss was 5.4 mm in terms of water-gauge pressure.

COMPARATIVE EXAMPLE 4

Figures 58, 59:
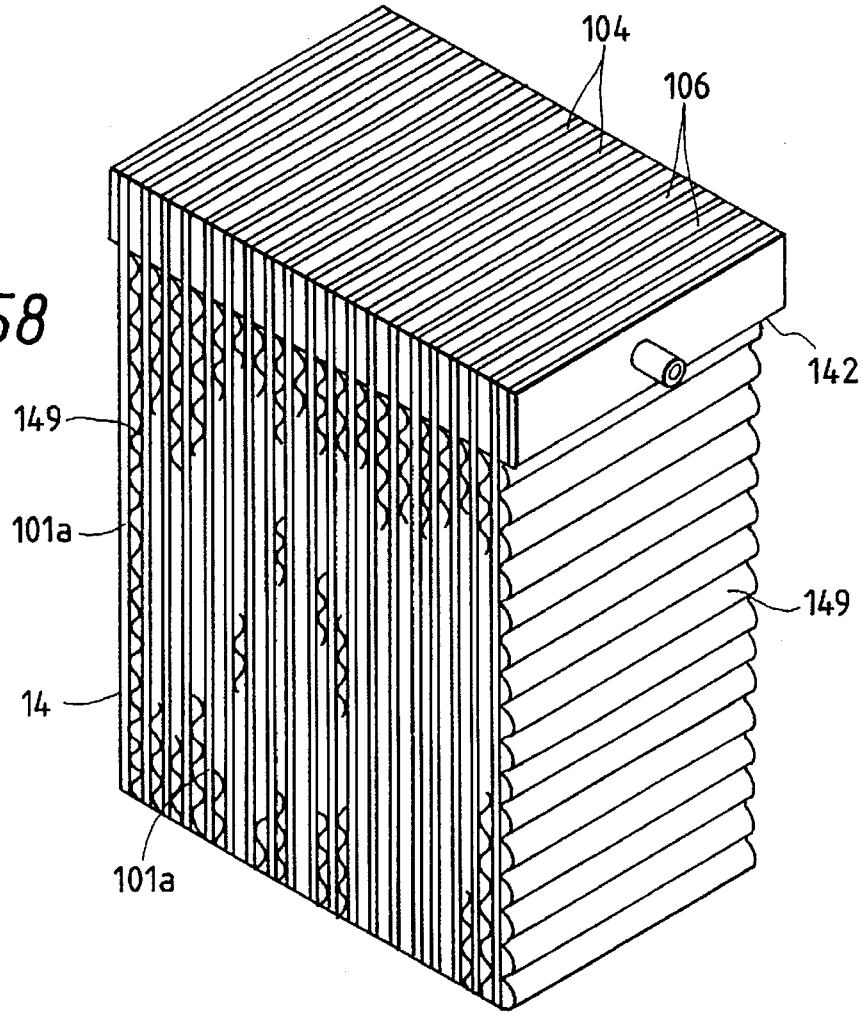
FIG. 58 is a perspective view of a humidifier of Comparative Example 4 used in a test for verifying the performance and characteristics of the embodiments of the present invention.
FIG. 59 is a table showing the test results of the embodiments of the present invention and Comparative Examples 3 and 4.

The corrugated spacer plate 149 having a height of 3.3 mm in place of the rib frame 143 was inserted in between the water guide components 104 of the basic unit 142 used in the testing above and bonded thereto to provide a humidifier of the natural evaporation type as shown in FIG. 58.

The humidifier was incorporated in a casing whose external dimensions were 300 mm in height, 230 mm in width and 180 mm in length before being supplied with water from the water supply tank. In a case where water supply pressure was 0.05 kg/cm$^2$, it took 10 minutes or less to fill up the interlaminar sections each formed by the spacer plates 49 with water. When air having a temperature of 20° C. and a humidity of 50% was sent in at a rate of 300 cubic meter/hour, moreover, a moistening quantity of 0.50 kg/hour was obtained, whereas static pressure loss was 6.4 mm in terms of water-gauge pressure.

FIG. 59 shows a table illustrating the performance of these Comparative Examples 3, 4 together with that of the seventh to eleventh embodiments of the invention. In other words, the humidifier in the seventh to eleventh embodiments including the sixth embodiment of the invention totally exhibit performance higher than and pressure loss lower than those in Comparative Example 3. Moreover, the time required for supplying water is made shorter than what is required in Comparative Example 3. With respect to the humidifier in the ninth embodiment of the invention, the static pressure loss remains unchanged but the moistening quantity actually increases. With respect to the tenth embodiment of the invention in which the number of moistening function members 101 is increased by decreasing the height of the rib 139, the moistening quantity is increased further, though the static pressure loss is slightly increased. With respect to the eleventh embodiment of the invention intended to reduce the size of the humidifier by decreasing the number of moistening function members 101 of the tenth embodiment thereof, the performance obtained thereby is greater than that of Comparative Examples 3, 4 and seventh to ninth embodiments of the invention despite the achievement of size reduction and as for the static pressure loss, it is seen to be lower than that in Comparative Example 3. Although Comparative Example 4 is an improved version of Comparative Example 3 in that the problem of continuous length has been solved, the static pressure loss is greater than that in Comparative Example 3 and any one of the embodiments of the invention, notwithstanding that the moistening quantity is greater than that in Comparative Example 3, but the moistening quantity is lower than that in the ninth to eleventh embodiments of the invention however.

Water supply time in the seventh to eleventh embodiments of the invention is shorter than that in Comparative Example 3, so that water can obviously be supplied for a short time. In a case where the apparatus is large-sized, the time required to supply water is lengthened further as the tubular film member 248 becomes longer with the arrangement of Comparative Example 3. Since the water retention layers 103 are arranged in parallel in each embodiment of the invention above, the time required to supply water is hardly made longer even though the number of layers is increased.

As is obvious from the description of the embodiments of the invention, according to the fifth aspect of the present invention, since water is supplied to the moistening function members in parallel, it does not take much time to supply water thereto. Unlike a corrugated spacer plate, the air supply layer between the water guide components with the ribs remains substantially unrestricted by the rib-to-rib space with respect to its height and since it is free from variation in height as in the case of a corrugated plate, excellent stability of its shape is ensured. Further, it is possible to sufficiently enlarge the area of each air channel and the contact area of the outer surface of the water guide component can be reduced. Therefore, pressure loss concerning the air sent by the air supply layer becomes small and a percentage of loss of the moisture permeable function of the water guide component due to the contact of the ribs is lowered, so that the moistening performance is improved. Consequently, the humidifier can be made producible through relatively simple cutting and laminating processes automatically with high productivity.

According to the sixth aspect of the present invention, water is supplied to the moistening function members in parallel, and the air in the water guide component is allowed to escape simultaneously with the supply of water, so that water is smoothly and speedily supplied thereto. Consequently, even though the water guide component is made of material not or hardly permeable to air, it can properly be dealt with. Unlike a corrugated spacer plate, the air supply layer between the water guide components with the ribs remains substantially unrestricted by the rib-to-rib space with respect to its height and since it is free from variation in height as in the case of a corrugated plate, excellent stability of its shape is ensured and it is possible to sufficiently enlarge the area of each air channel. Therefore, pressure loss concerning the air sent by the air supply layer becomes small and a percentage of loss of the moisture permeable function of the water guide component due to the contact of the ribs is lowered, so that the moistening performance is improved. Consequently, the humidifier can be made producible through relatively simple cutting and laminating processes automatically with high productivity.

According to the seventh aspect of the present invention, since water is supplied to the moistening function members in parallel, it does not take much time to supply water thereto. Unlike a corrugated spacer plate, the air supply layer between the water guide components with the ribs remains substantially unrestricted by the rib-to-rib space with respect to its height and since it is free from variation in height as in the case of a corrugated plate, excellent stability of its shape is ensured. Further, it is possible to sufficiently enlarge the area of each air channel and the contact area of the outer surface of the water guide component can be reduced. Therefore, pressure loss concerning the air sent by the air supply layer becomes small and a percentage of loss of the moisture permeable function of the water guide component due to the contact of the ribs is lowered, so that the moistening performance is improved. Consequently, the humidifier can be made producible through relatively simple cutting and laminating processes automatically with high productivity. Further, since the envelope film member of the water guide component is formed with a thin high-performance moisture permeable film, the performed of the humidifier is improvable further.

According to the eighth aspect of the present invention, since water supply and air venting are made possible only by coupling the plastic frame to one surface of the flat water guide component and even though the water guide component is made of material not or hardly permeable to air, it can properly be dealt with. Consequently, a high-performance humidifier excellent in water absorbability and productivity is obtainable.

According to the ninth aspect of the present invention, the invention has the effect of increasing the freedom of water supply location and improving upon dealing with the equipment, in addition to the effect of the fifth or seventh aspect of the invention.

According to the tenth aspect of the present invention, the invention has the effect of making it possible to supply water from any position different from that of the water supply hole of the moistening function member to the water guide component of each moistening function member, thus not only increasing the freedom of water supply location but also improving upon dealing with the equipment, in addition to the effect of the fifth or seventh aspect of the invention.

According to the eleventh aspect of the present invention, the invention has the effect of making it possible to supply water from any position different from that of the water supply hole of the moistening function member to the water guide component of each moistening function member and moreover making it possible to discharge air escaping from any position different from the air vent hole of the moistening function member to the water guide component of each moistening function member, thus not only increasing the freedom of water supply and air venting locations but also improving upon dealing with the equipment, in addition to the effect of the sixth or eighth aspect of the invention.

According to the twelfth aspect of the present invention, the invention has the effect of making it possible to supply water from any position different from that of the water supply hole of the moistening function member to the water guide component of each moistening function member and moreover making it possible to discharge air escaping from any position different from that of the air vent hole of the moistening function member to the water guide component of each moistening function member, thus not only increasing the freedom of water supply and air venting locations but also improving upon dealing with the equipment, in addition to the effect of the sixth or eighth aspect of the invention.

According to thirteenth aspect of the present invention, the invention has the effect of making it possible to reducing air resistance in the air channel of each air supply layer without instability of the shape and harmonize performance with the stability of the structure in addition to the effect the fifth to ninth aspects of the invention.

According to the fourteenth aspect of the present invention, the invention has the effect of making it possible to optimizing the rib and the water supply member or the plastic frame in accordance with the attributes of the materials concerned such as their formability and adhesion, thus improving the moistening performance further, in addition to the effect of the fourth to eighth aspects of the invention.

What is claimed is:

1. A humidifier, comprising:

a plurality of water guide components, each water guide component including, a water guide member made of porous material permeable to water, and an envelope-shaped film member enclosing the water guide member, the film member being formed of a porous moisture permeable film which prohibits liquid water to permeate therethrough and permits water vapor to permeate therethrough;

first and second plate-like spacers attached to a surface of the water guide component, said first and second plate-like spacers being disposed distant from each other, the first spacer having a water supply hole communicating with the inside of the water guide component to supply water thereto, said water guide component in combination with the first and second spacers constituting a moistening function member, and wherein a plurality of the moistening function members are laid one over another so that the water supply holes communicate with each other and that air supply layers defined by the first and second spacers and the water guide components are arranged one over another.

2. A humidifier according to claim 1, wherein the humidifier is set so that the water supply holes are located at a lower side thereof, and the water supply hole in one of the outermost moistening function members is closed whereas the water supply holes in the other of the outermost moistening function members is provided with a water supply pipe connected thereto for connection to a water supply source.

3. A humidifier according to claim 1, wherein the second spacer has an air vent hole communicating with the inside of the water guide component to allow air to escape from the inside of the water guide component through the air vent hole, wherein when a plurality of moistening function members are laid one over another, the air vent holes of the second spacers communicate with each other.

4. A humidifier as claimed in claim 3, wherein the humidifier is set so that the water supply holes are located at a lower side thereof, the water supply hole in one of the outermost moistening function members is closed whereas the water supply holes in the other of the outermost moistening function members is provided with a water supply pipe connected thereto for connection to a water supply source, and each of the air vent holes in the outermost moistening function members is closed with a porous moisture permeable film which prohibits water to permeate therethrough and permits air to permeate therethrough.

5. A humidifier according to claim 3, further comprising:

rows of ribs fixed to the surface of the water guide component for dividing the air supply layer between the first and second spacers into a plurality of parallel air channels.

6. A humidifier according to claim 5, wherein one of the water retention layers constitutes a functional member for supplying water and air venting which has a water conduit communicating with a water supply source and is used for supplying water from one end of the water conduit to an adjoining moistening function member and is provided with a discharge channel communicating with an air vent pipe for collectively discharging air escaping from the moistening function member, and the functional member for supplying water and air venting is also provided with rows of ribs each for forming air channels.

7. A humidifier according to claim 5, wherein one of the water retention layers constitutes a functional member for supplying water and air venting which has a connection port connected to a water supply source and is equipped with a water conduit for supplying water flowing in from the connection port to an adjoining moistening function member, a discharge channel for collectively discharging air escaping from the moistening function member, and also provided with rows of ribs each for forming air channels.

8. A humidifier according to claim 5, wherein the ribs and the first and second spacers for one water guide component are integrally molded as a plastic frame.

9. A humidifier according to claim 1, further comprising:

rows of ribs fixed to the surface of the water guide component for dividing the air supply layer between the first and second spacers into a plurality of parallel air channels.

10. A humidifier according to claim 9, wherein one of the water retention layers constitutes a functional member for supplying water which has a water conduit communicating with a water supply pipe connected to the water supply source and is used for supplying water from one end of the water conduit to an adjoining moistening function member, and the functional member for supplying water is also provided with rows of ribs each for forming air channels.

11. A humidifier according to claim 9, wherein the ribs and the first spacer for one water guide component are integrally molded as a plastic frame.

12. A humidifier according to claim 9, wherein one of the water retention layers constitutes a water supply function member which has a connection port connected to a water supply source and is equipped with a water conduit for supplying water flowing in from the connection port to an adjoining moistening function member, and provided with rows of ribs each for forming air channels on a surface thereof.

13. A humidifier according to claim 9, wherein the space between the adjacent ribs of the moistening function member is set in the range of three to thirty times the height of the rib.

14. A humidifier according to claim 9, wherein the ribs and the first spacer is formed from one of vinyl chloride resin, polypropylene resin, polyethylene resin, polystyrene resin, ABS resin, nylon, urethane resin, ethylene-vinyl acetate copolymer, ethylene acrylate copolymer, and epoxy resin.

15. A humidifier according to claim 5, wherein the space between the adjacent ribs of the moistening function member is set in the range of three to thirty times the height of the rib.

16. A humidifier according to claim 5, wherein the ribs and the first spacer is formed from one of vinyl chloride resin, polypropylene resin, polyethylene resin, polystyrene resin, ABS resin, nylon, urethane resin, ethylene-vinyl acetate copolymer, ethylene acrylate copolymer, and epoxy resin.

17. A humidifier according to claim 1, wherein the water guide member and the film member are combined together to form a composite structure.

18. A humidifier according to claim 1, wherein said plurality of water guide components are flat.

* * * * *